US010591863B2

(12) United States Patent
Ishida et al.

(10) Patent No.: US 10,591,863 B2
(45) Date of Patent: Mar. 17, 2020

(54) IMAGE FORMING APPARATUS

(71) Applicants: Takashi Ishida, Kanagawa (JP); Goro Katsuyama, Kanagawa (JP)

(72) Inventors: Takashi Ishida, Kanagawa (JP); Goro Katsuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 86 days.

(21) Appl. No.: 15/680,482

(22) Filed: Aug. 18, 2017

(65) Prior Publication Data

US 2018/0081319 A1 Mar. 22, 2018

(30) Foreign Application Priority Data

Sep. 16, 2016 (JP) ..... 2016-182302

(51) Int. Cl.
*G03G 21/16* (2006.01)
*B65H 85/00* (2006.01)
(Continued)

(52) U.S. Cl.
CPC ..... *G03G 21/1619* (2013.01); *B65H 29/52* (2013.01); *B65H 85/00* (2013.01); *G03G 15/6552* (2013.01); *G03G 21/1695* (2013.01); *B65H 2301/33312* (2013.01); *B65H 2402/10* (2013.01); *B65H 2402/45* (2013.01);
(Continued)

(58) Field of Classification Search
CPC ..... G03G 21/161; G03G 15/6552; G03G 21/1695; G03G 2221/1696; B65H 29/52; B65H 85/00; B65H 2301/33312; B65H 2402/10; B65H 2402/45; B65H 2402/63; B65H 2404/6111; B65H 2407/20; B65H 2511/11; B65H 2511/182; B65H 2601/11; B65H 2601/321; B65H 2601/325; B65H 2801/06
See application file for complete search history.

(56) References Cited

U.S. PATENT DOCUMENTS 6,134,418 A * 10/2000 Kato ..... B65H 29/00 271/207
8,960,672 B2 * 2/2015 Takenaka ..... B65H 43/02 271/259
8,960,673 B2 * 2/2015 Yoshida ..... B65H 29/125 271/225
(Continued)

FOREIGN PATENT DOCUMENTS

JP 2002-308479 10/2002
JP 2007-248765 9/2007
(Continued)

*Primary Examiner* — David H Banh
(74) *Attorney, Agent, or Firm* — Harness, Dickey and Pierce, P.L.C.

(57) ABSTRACT

An image forming apparatus includes an apparatus body, a wall face of the apparatus body having an ejection opening from which a sheet conveyed in a first direction is ejected, a sheet support to support the sheet discharged from the discharge opening in the first direction, and a mount to mount the sheet support to the apparatus body. The mount includes an abutting portion including an abutting face that contacts a wall face of the apparatus body, and a projection projecting in a second direction opposite to the first direction from the abutting face. The abutting face extends in a vertically downward direction from the projection, and the projection is fixed to the apparatus body in a vertical direction.

16 Claims, 45 Drawing Sheets

(51) Int. Cl.
*B65H 29/52* (2006.01)
*G03G 15/00* (2006.01)

(52) U.S. Cl.
CPC .. *B65H 2402/63* (2013.01); *B65H 2404/6111* (2013.01); *B65H 2407/20* (2013.01); *B65H 2511/11* (2013.01); *B65H 2511/182* (2013.01); *B65H 2601/11* (2013.01); *B65H 2601/321* (2013.01); *B65H 2601/325* (2013.01); *B65H 2801/06* (2013.01); *G03G 2221/1696* (2013.01)

(56) References Cited

U.S. PATENT DOCUMENTS

2004/0032481 A1* 2/2004 Sides, II ..... B41J 13/103 347/108
2006/0051147 A1* 3/2006 Sato ..... G03G 15/6538 399/405
2009/0148210 A1* 6/2009 Takenaka ..... G03G 15/234 399/381
2012/0155943 A1* 6/2012 Taki ..... G03G 15/234 399/401
2014/0183811 A1* 7/2014 Takenaka ..... B65H 43/02 271/3.19
2014/0327926 A1 11/2014 Katsuyama
2014/0328605 A1* 11/2014 Katsuyama ..... G03G 21/1647 399/81
2014/0328606 A1 11/2014 Katsuyama
2014/0334834 A1 11/2014 Katsuyama
2014/0334848 A1 11/2014 Katsuyama
2015/0153700 A1* 6/2015 Fujikawa ..... G03G 21/1619 399/405
2015/0298931 A1* 10/2015 Osaki ..... B65H 43/00 271/265.01
2015/0378305 A1 12/2015 Katsuyama
2016/0318728 A1* 11/2016 Kowase ..... B65H 29/60
2016/0318731 A1* 11/2016 Kowase ..... B65H 43/04

FOREIGN PATENT DOCUMENTS

JP 2008-037528 2/2008
JP 2011-005728 1/2011

* cited by examiner

IMAGE FORMING APPARATUS

CROSS-REFERENCE TO RELATED APPLICATION

This patent application is based on and claims priority pursuant to 35 U.S.C. § 119(a) to Japanese Patent Application No. 2016-182302, filed on Sep. 16, 2016 in the Japan Patent Office, the entire disclosure of which is hereby incorporated by reference herein.

BACKGROUND

Technical Field

Aspects of this disclosure relate to an image forming apparatus.

Related Art

An image forming apparatus is known that has a sheet reverse unit disposed above a sheet stack section on which a plurality of sheets is stacked. The sheet reverse unit reverses a direction of conveyance of a sheet fed from the image forming apparatus, and returns the sheet to the apparatus.

SUMMARY

In an aspect of this disclosure, a novel image forming apparatus includes an apparatus body, a wall face of the apparatus body having a ejection opening from which a sheet conveyed in a first direction is ejected, a sheet support to support the sheet ejected from the discharge opening in the first direction, and a mount to mount the sheet support to the apparatus body. The mount includes an abutting portion including an abutting face that contacts the wall face of the apparatus body, and a projection projecting in a second direction opposite to the first direction from the abutting face. The abutting face extends in a vertically downward direction from the projection, and the projection is fixed to the apparatus body in a vertical direction.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
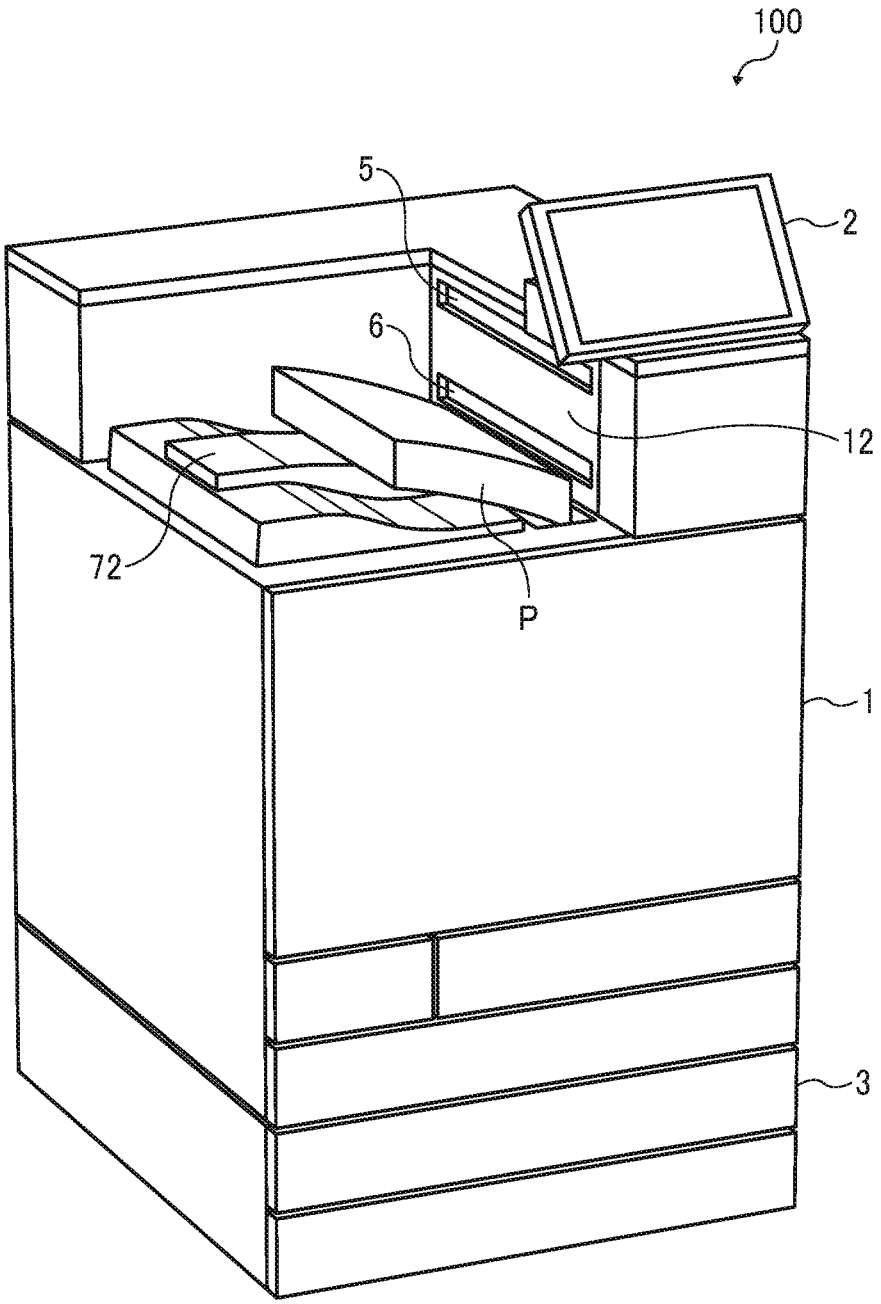
FIG. 1 is a perspective view of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

Descriptions are given below of an embodiment of the present disclosure applied to an electrophotographic image forming apparatus, in this case a printer.

FIG. 1 is an external perspective view of a printer 100 according to an embodiment of the present disclosure.

As illustrated in FIG. 1, the printer 100 includes an operation panel 2 and an auxiliary sheet supply tray 3. The operation panel 2 is fixed to a right front side of an upper face of an apparatus body 1 of the printer 100. The operation panel 2 acts as an operational section by which the user can operate the printer 100. The auxiliary sheet supply tray 3 is disposed at the bottom of the apparatus body 1.

The printer 100 includes an ejection tray 72 at a top left side of the apparatus body 1. The top left side of the apparatus body 1 is disposed lower than the top right side of the apparatus body 1. The ejection tray 72 stacks a stack of sheets P on which images are formed on the apparatus body 1.

The printer 100 includes a reversal opening 5 and a stack opening 6. The reversal opening 5 and the stack opening 6 are disposed on an ejection wall face 12 extending vertically at one end portion of the ejection tray 72. The stack opening 6 ejects the sheet P toward the ejection tray 72. The sheet P, the direction of which is to be reversed, passes through the reversal opening 5.

Figure 2:
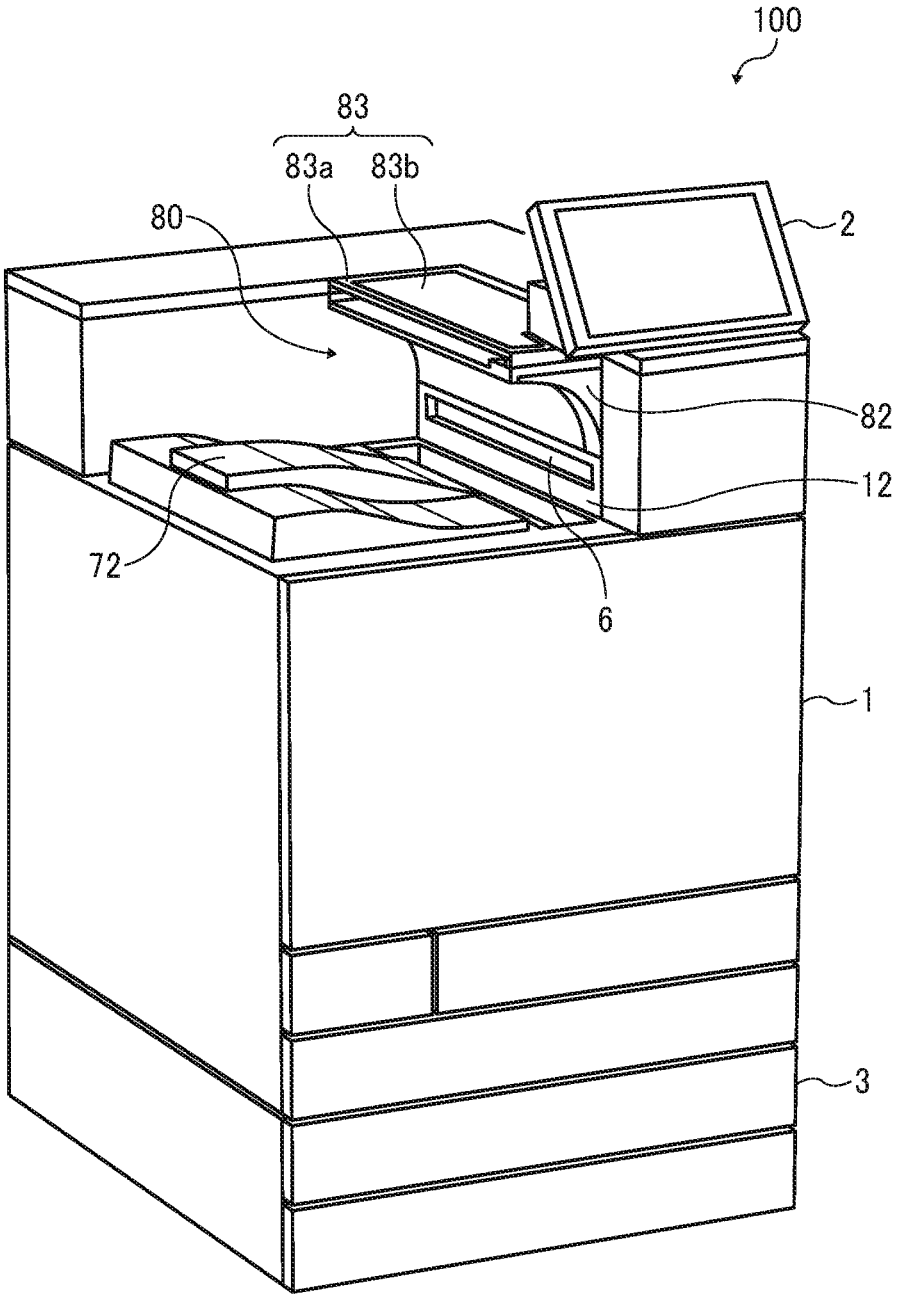
FIG. 2 is a perspective view of the printer to which a sheet reversing section is attached from the state illustrated in FIG. 1.

FIG. 2 is an external perspective view of the printer 100. The printer 100 includes a sheet reversing section 80 mounted where the sheet reversing section 80 faces the reversal opening 5 of the printer 100.

As illustrated in FIG. 2, the sheet reversing section 80 includes a reversing tray 82 and a reversing-tray cover 83. The reversing-tray cover 83 includes a cover fixing portion 83*a* and an openably closable cover 83*b*. The cover fixing portion 83*a* is fixed to the reversing tray 82. The openably closable cover 83*b* is openably closable against the cover fixing portion 83*a*.

Figure 3:
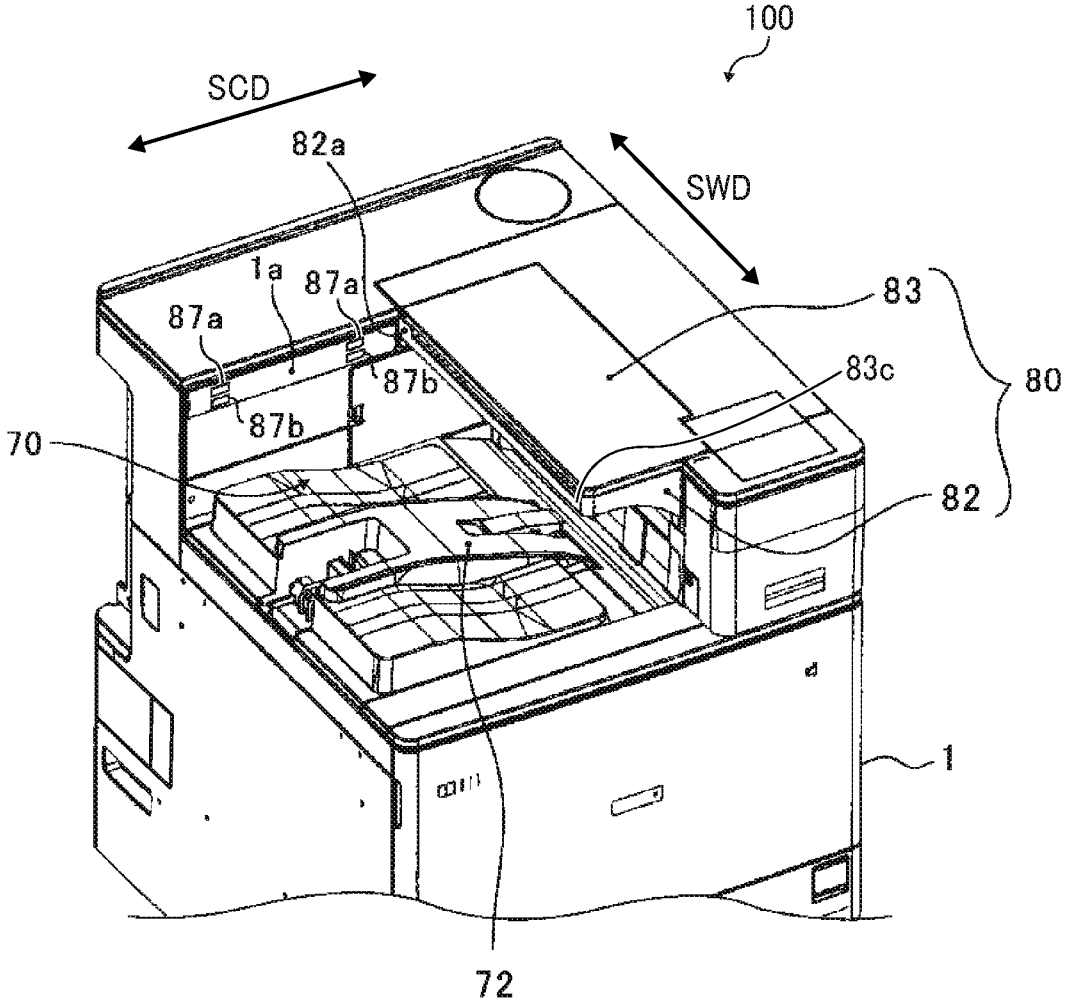
FIG. 3 is a perspective view of the printer from which an operation panel and an auxiliary sheet supply tray are removed from the state illustrated in FIG. 2.

FIG. 3 is an external perspective view of the printer 100 in a state in which the operation panel 2 and the auxiliary sheet supply tray 3 are removed from the printer 100.

Figure 4:
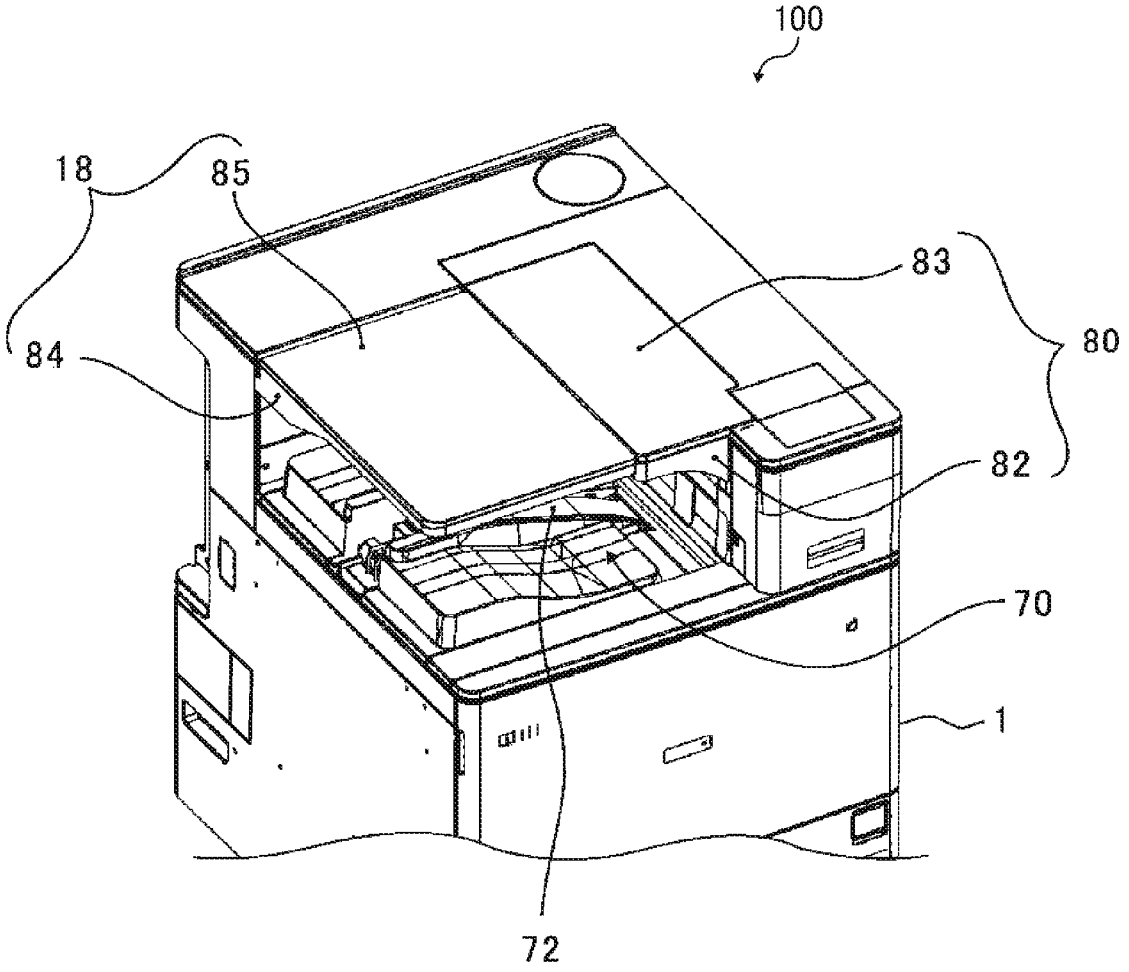
FIG. 4 is a perspective view of the printer to which an extensional-reversing section is attached from the state illustrated in FIG. 3.
Figure 5:
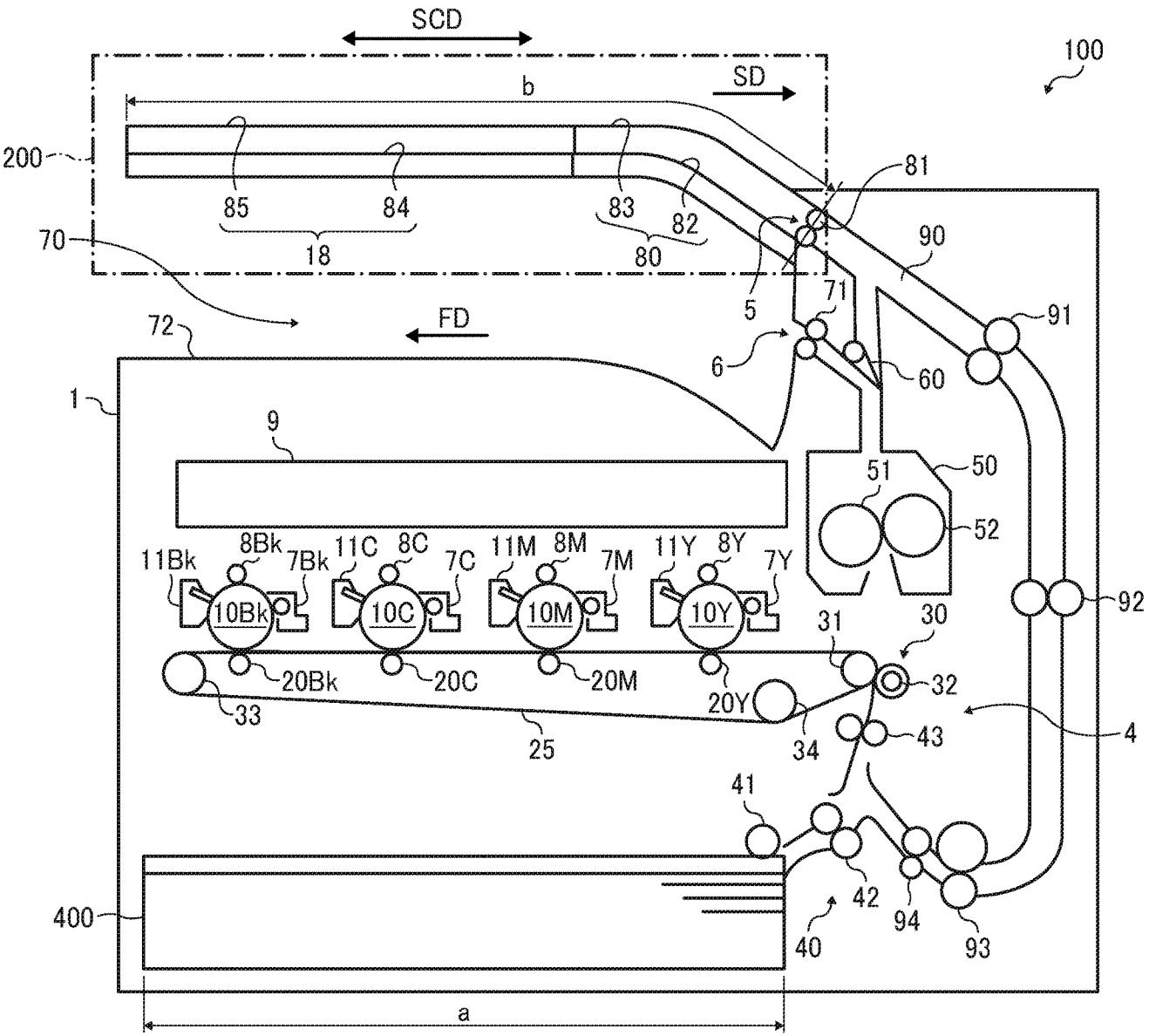
FIG. 5 is a schematic cross-sectional view illustrating a configuration of the printer in a state illustrated in FIG. 4.

FIG. 4 is an external perspective view of the printer 100 in a state in which an extensional-reversing section 18 is mounted on the printer 100 illustrated in FIG. 3. The extensional-reversing section 18 includes an extension tray 84 and an extension-tray cover 85. FIG. 5 is a schematic cross-sectional view illustrating a configuration of the printer 100 in a state as illustrated in FIG. 4. A basic configuration of the printer 100 according to the present embodiment is described below with reference to FIG. 5.

As illustrated in FIG. 5, the printer 100 includes four photoconductor drums 10Y, 10M, 10C, and 10Bk (hereinafter also collectively "photoconductor drums 10") disposed in an image forming section 4 inside the apparatus body 1. The photoconductor drums 10 serve as image bearers. Yellow toner images, magenta toner images, cyan toner images, and black toner images are formed on the four photoconductor drums 10Y, 10M, 10C, and 10Bk, respectively.

The printer 100 further includes an intermediate transfer belt 25 disposed to face with the four photoconductor drums 10Y, 10M, 10C, and 10Bk. A surface of the intermediate transfer belt 25 contacts with each of the four photoconductor drums 10Y, 10M, 10C, and 10Bk. The intermediate transfer belt 25 in the present embodiment is stretched around a driving roller 31, a driven roller 33, and a tension roller 34. The intermediate transfer belt 25 is rotatably supported by these rollers.

Regardless of the color of toner, the configuration and operation to form toner images on the photoconductor drums 10Y, 10M, 10C, and 10Bk are similar. Similarly, the configuration and operation to transfer the toner images onto the intermediate transfer belt 25 are similar regardless of the color of toner. Accordingly, a description is given of the configuration and operation to form black toner images on the photoconductor drum 10Bk and transfer black toner images onto the intermediate transfer belt 25. Descriptions of the configuration and operation regarding other colors (Y, M, and C) are omitted to avoid redundancy.

The photoconductor drum 10Bk is driven and rotated clockwise in FIG. 5, and a charging device 8Bk uniformly charges the surface of the photoconductor drum 10Bk in a negative polarity that is a predetermined polarity. Then, the charged surface of the photoconductor drum 10Bk is irradiated with writing light by an exposure device 9 to form an electrostatic latent image according to image data. As the photoconductor drum 10Bk rotates, the electrostatic latent image formed on the surface of the photoconductor drum 10Bk passes a developing region opposing a developing device 7Bk.

Then, the electrostatic latent image is developed with black toner in the developing device 7Bk into a visible image. Thus, the electrostatic latent images on the photoconductor drum 10Bk are developed into the visible black toner image. A primary transfer roller 20Bk is disposed inside the intermediate transfer belt 25. The primary transfer roller 20Bk faces the photoconductor drum 10Bk via the intermediate transfer belt 25. The primary transfer roller 20Bk contacts the inner face of the intermediate transfer belt 25 to fix a proper primary-transfer-nip between the photoconductor drum 10Bk and the intermediate transfer belt 25.

To the primary transfer roller 20Bk, a primary transfer voltage is applied. The polarity of the primary transfer voltage is opposite to the polarity of the charged black toner of the black toner image formed on the surface of the photoconductor drum 10Bk. In the present embodiment, the primary transfer voltage is in a plus (positive) polarity. Thus, a transfer electrical field is generated between the black photoconductor drum 10Bk and the intermediate transfer belt 25.

The black toner image on the black photoconductor drum 10Bk is electrically transferred onto the intermediate transfer belt 25 that is driven to rotate in synchronization with the black photoconductor drum 10Bk. After the black toner image is transferred onto the intermediate transfer belt 25, a cleaning device 11Bk removes residual toner remaining on the surface of the black photoconductor drum 10Bk to clean the surface of the black photoconductor drum 10Bk.

Similarly, a yellow toner image, a magenta toner image, and a cyan toner image are respectively formed on the photoconductor drums 10Y, 10M, and 10C, and the toner images of respective colors are sequentially superimposed and transferred one after another on the black toner image on the intermediate transfer belt 25.

Disposed in a lower section of the apparatus body 1 are a sheet tray 400 to accommodate sheets P and a sheet feeder 40 to feed the sheets P from the sheet tray 400 to an image forming section 4. As a sheet feeding roller 41 of the sheet feeder 40 rotates, the sheet P on the top in the sheet tray 400 is sent out. Then, a conveyance roller pair 42 transports the sheet P sent out from the sheet tray 400 to a registration roller pair 43.

Then, the registration roller pair 43 conveys the sheet P at a predetermined timing to a secondary transfer nip, in which a portion of the intermediate transfer belt 25 looped around the driving roller 31 contacts a secondary transfer roller 32 of a secondary transfer device 30. At that time, a predetermined secondary transfer voltage is applied to the secondary transfer roller 32 to generate a secondary transfer electrical field between the intermediate transfer belt 25 and the secondary transfer roller 32, and the toner image is secondarily transferred from the intermediate transfer belt 25 onto the sheet P.

The sheet P bearing the toner image is conveyed to a fixing device 50 disposed above the secondary transfer nip in FIG. 5. The fixing device 50 includes a fixing roller 51 and a heating roller 52 disposed in contact with each other to form a fixing nip. The fixing device 50 fixes the toner image on the sheet P with heat and pressure while the sheet P passes through the fixing nip formed by the fixing roller 51 and the heating roller 52.

Then, the sheet P having the toner image fixed thereon is discharged through a discharge path located in an upper section of the apparatus body 1. In single-side image formation to form an image on one side of the sheet P, a switching claw 60 switches a conveyance route of the sheet P to a route leading to a sheet ejection section 70. The sheet ejection section 70 includes an ejection roller pair 71 and an ejection tray 72. The ejection roller pair 71 conveys the sheet P to the sheet ejection section 70 in a first direction FD along a sheet conveyance direction SCD as illustrated in FIG. 5 and discharges the sheet P onto the ejection tray 72. The discharged sheets P are sequentially stacked on the ejection tray 72.

Above the ejection tray 72, a reversing device 200 including the sheet reversing section 80 and the extensional-reversing section 18 are disposed. The reversing tray 82 and the extension tray 84 support and guide the bottom face of the sheet P, the conveyance direction of which is reversed by a reversing roller pair 81 such that the sheet P moves along the upper faces of each of the reversing tray 82 and the extension tray 84 in a second direction SD opposite the first direction FD. The reversing tray 82 acts as a sheet support to support the sheet P that is to be sent to the apparatus body 1 after the conveyance direction of which is reversed to a second direction SD.

In FIG. 5, a distance b extending from the reversing roller pair 81 to an end face of the extension tray 84 in a sheet conveyance direction SCD in the reversing device 200 is longer than a length "a" of the sheet tray 400 in the sheet conveyance direction SCD. The end face of the extension tray 84 is aligned with an end face of the apparatus body 1 in a vertical direction to eliminate the necessity of moving the apparatus body 1 even when the installation space, especially a length in the sheet conveyance direction SCD, is small.

Printer 100 includes the ejection tray 72 and the reversing device 200. The ejection tray 72 acts as a sheet stacker for stacking sheets P. The sheet reversing section 80 and the extensional-reversing section 18 of the reversing device 200 form a reverse conveyance route defining a sheet reverse passage to reverse the direction of conveyance of the sheet P fed thereto and convey the sheet P to the apparatus body 1 in a second direction SD opposite to the first direction FD along the sheet conveyance direction SCD.

An upper side of the reversing tray 82 is covered with a reversing-tray cover 83, and an upper side of the extension tray 84 is covered with an extension-tray cover 85. The extension tray 84 and the extension-tray cover 85 are disposed downstream from the reversing tray 82 and the reversing-tray cover 83, respectively, in the first direction FD in which the sheet P enters the reversing tray 82 from the apparatus body 1.

The sheet reversing section 80 formed by the reversing tray 82 and the reversing-tray cover 83 is fixed to the apparatus body 1 with an assembly as described below. The extensional-reversing section 18 is arbitrary detachably attached to the sheet reversing section 80 and the apparatus body 1.

In a state as illustrated in FIG. 3, the extensional-reversing section 18 is removed from the apparatus body 1. Thus, a right side plate 1*a* of the apparatus body 1 is exposed. The right side plate 1*a* is a side plate disposed on the right hand side of the apparatus body 1 when viewed from upstream to downstream in the sheet conveyance direction SCD. The side plate 1*a* is disposed parallel to the sheet ejection direction in the sheet ejection section 70 of the apparatus body 1. In a state as illustrated in FIG. 3, an end face 82*a* of the reversing tray 82 and an end face 83*c* of the reversing-tray cover 83 are exposed.

The end face 82*a* is disposed at a downstream end of the reversing tray 82 in the sheet conveyance direction SCD. The end face 83*c* is disposed at a downstream end of the reversing-tray cover 83 in the sheet conveyance direction SCD.

In a state as illustrated in FIG. 4, the extension tray 84 is in contact with Two L-shaped faces formed by the side plate 1*a* and the end face 82*a* of the reversing tray 82. The extension-tray cover 85 is in contact with Two L-shaped faces formed by the side plate 1*a* and the end face 83*c* of the reversing-tray cover 83.

As illustrated in FIG. 4, when an upper face of the reversing-tray cover 83 and an upper face of the extension-tray cover 85 of the reversing device 200 are coplanar with upper face of other portions of the printer 100, the height of the printer 100 is reduced, and the printer 100 becomes compact.

During duplex printing, the switching claw 60 illustrated in FIG. 5 switches the conveyance route of the sheet P to the reversing device 200. Thereby, the sheet P bearing an image on one side by the image forming section 4 is conveyed to the reversing device 200. While the reversing roller pair 81 sandwiching a trail end of the sheet P conveyed to the reversing device 200, the reversing roller pair 81 temporarily ejects the sheet P onto the reversing tray 82 and the extension tray 84 from the reversal opening 5. Subsequently, the reversing roller pair 81 is rotated in reverse, with a drive motor to drive the reversing roller pair 81, to feed the sheet P to a re-feed passage 90.

Then, the sheet P fed to the re-feed passage 90 is sequentially conveyed via a plurality of conveyance roller pairs 91, 92, 93, and 94 and the registration roller pair 43 to the transfer section. Then, an image is secondarily transferred from the intermediate transfer belt 25 onto a back side (second side) of the sheet P. The duplex printed sheet P is conveyed from the image forming section 4 toward the stack opening 6. Then, the sheet P is discharged from the stack opening 6 and stacked onto the ejection tray 72.

As illustrated in FIGS. 4 and 5, the extensional-reversing section 18 of the reversing device 200 is attached to the apparatus body 1 and the sheet reversing section 80. Therefore, the reversing tray 82 and the extension tray 84 can support the sheet P that has a conveyable largest length (length "a" of the sheet tray 400 in the sheet conveyance direction SCD) that can be stacked in the sheet tray 400.

Thus, the reversing device 200 attached with the extensional-reversing section 18 has a length to guide the bottom face of the sheet P and cover the upper face of the sheet P in the entire sheet length even when a long sheet P such as A3-size sheets and double-letter (DLT) size sheets are reversed by the reversing device 200.

Thus, the reversing tray 82 (sheet support) has a length enough to cover a leading end of the sheet P that has a conveyable largest length in the printer 100 (image forming apparatus) positioned at a most downstream position in the first direction.

Additionally, with attaching or detaching the extensional-reversing section 18 to the apparatus body 1, the extensional-reversing section 18 can adjust its length to guide the bottom side of the sheet P and cover the upper face of the sheet P.

Figure 6:
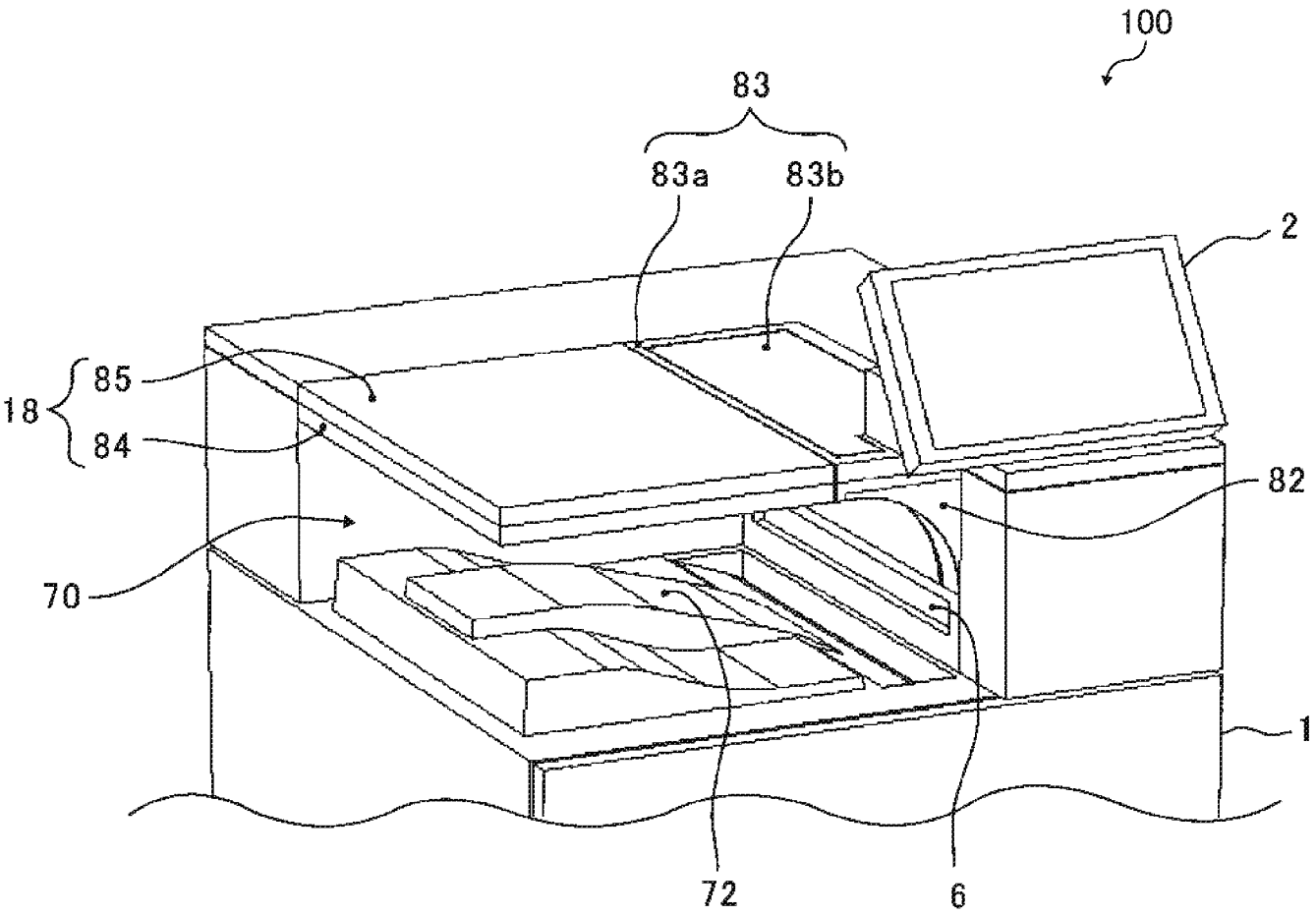
FIG. 6 is a perspective view of the printer to which the extensional-reversing section is attached from the state illustrated in FIG. 2.
Figure 9:
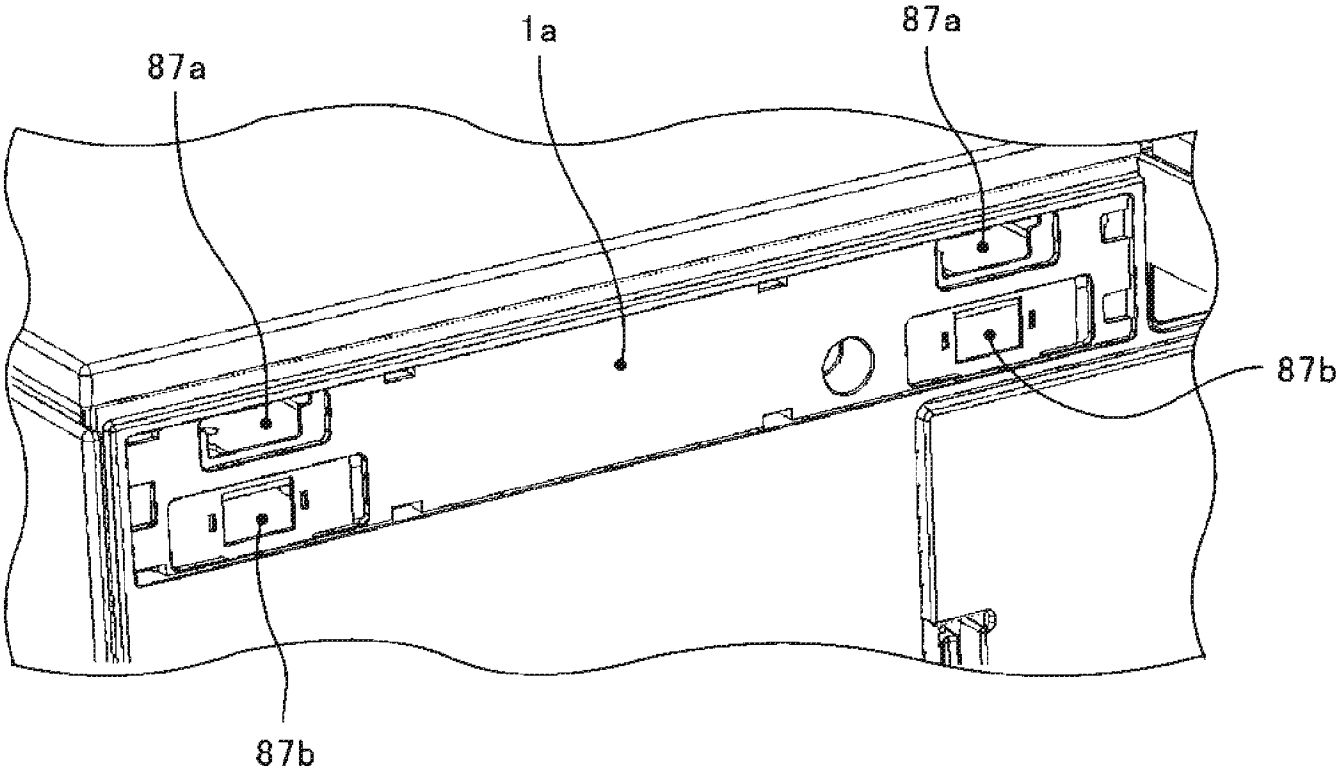
FIG. 9 is an enlarged perspective view of an area in a vicinity of the upper end of the side plate of an apparatus body of the printer.

FIGS. 6 and 9 illustrate a mechanism to attach and detach the extensional-reversing section 18 to the apparatus body 1.

Figure 7:
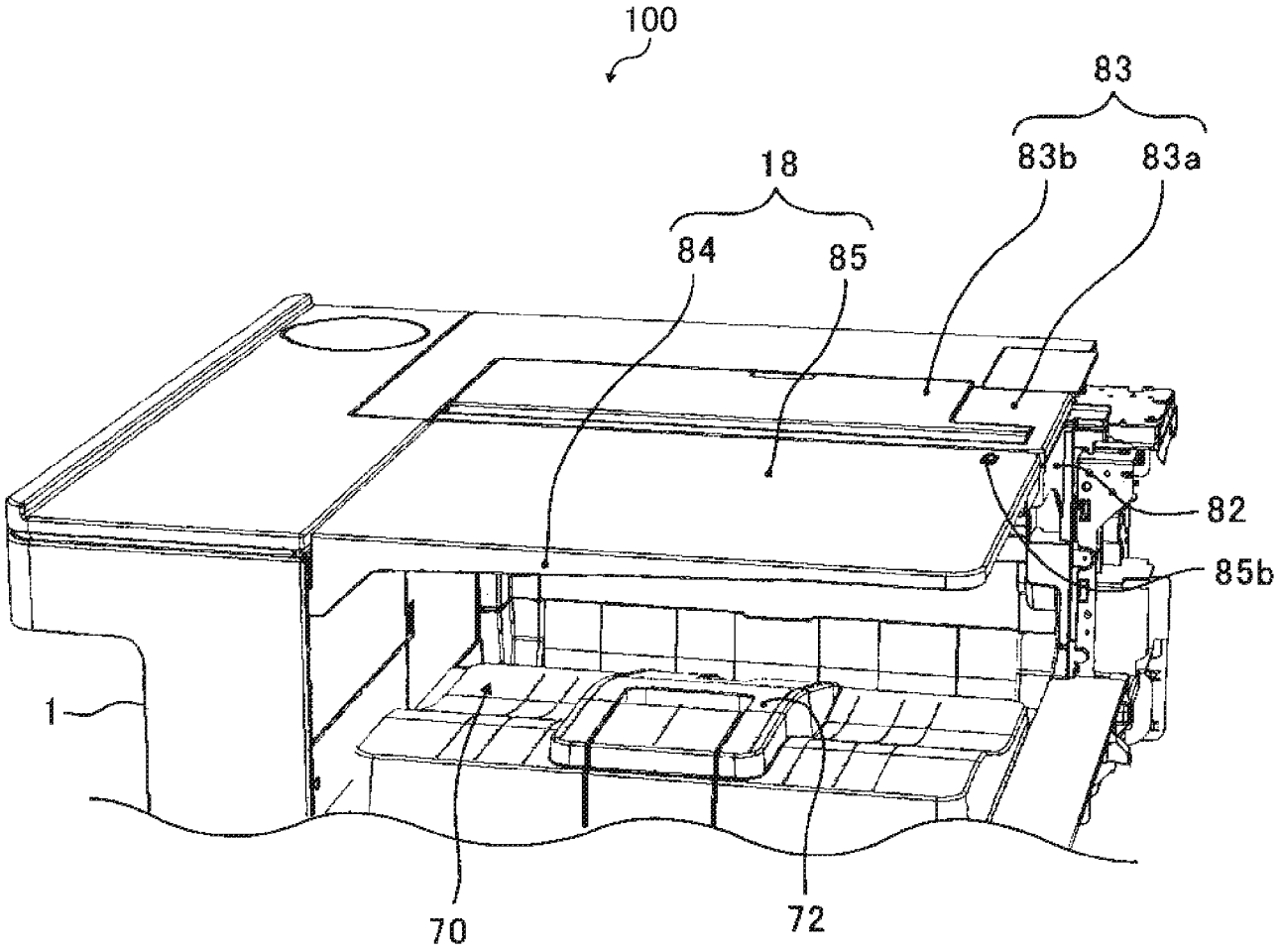
FIG. 7 is a perspective view of the printer in a state in which the operational panel and an exterior cover are detached from the printer illustrated in FIG. 6.
Figure 8:
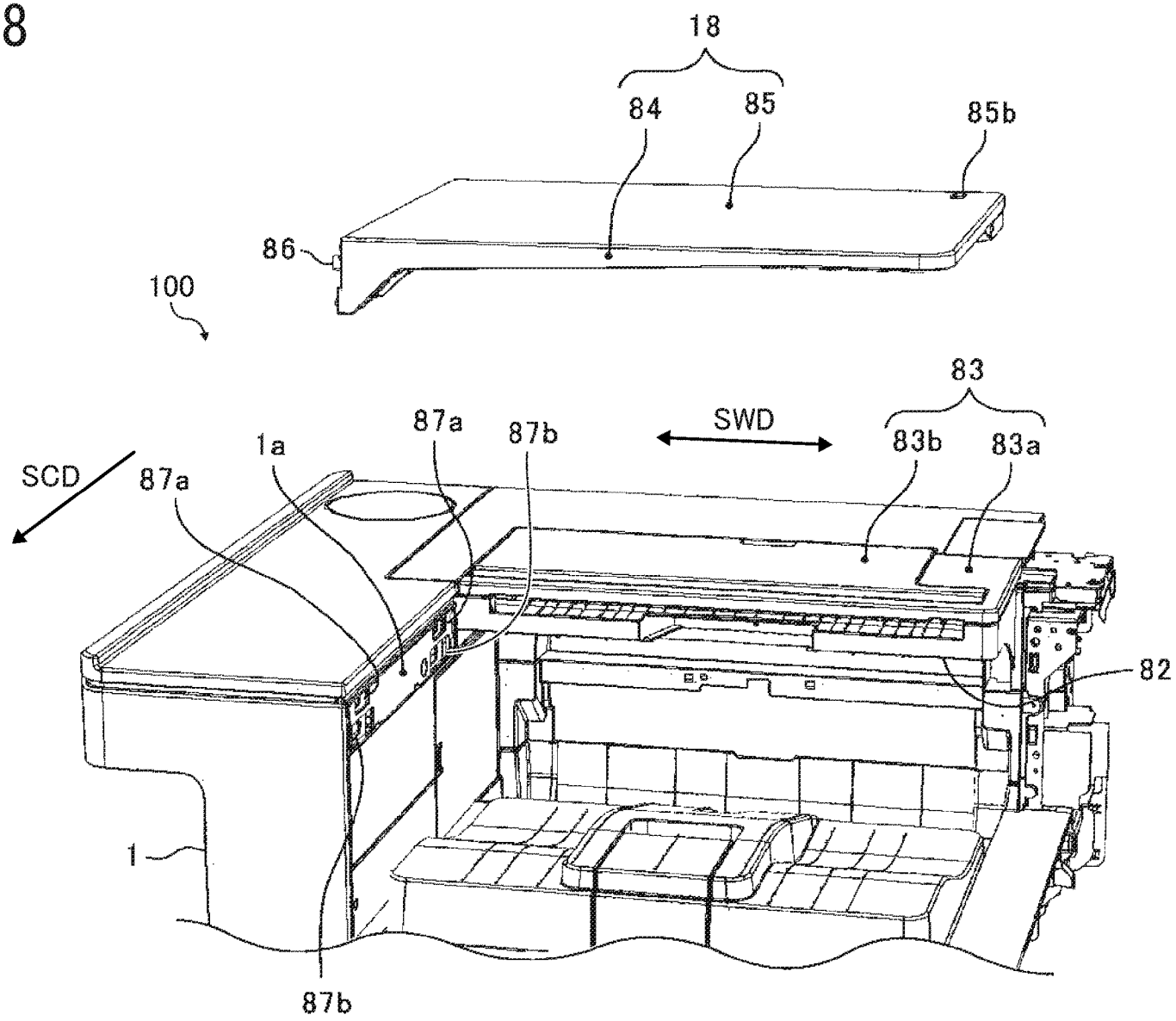
FIG. 8 is a perspective view of the printer from which the sheet reversing section is detached from the printer illustrated in FIG. 7.

FIG. 6 is a perspective view of the printer 100 in a state in which the extensional-reversing section 18 is attached to the printer 100 illustrated in FIG. 2. FIG. 7 is a perspective view of the printer 100 in a state in which the operation panel 2 and an exterior cover in front of the apparatus body 1 are detached from the printer 100 illustrated in FIG. 6. FIG. 8 is a perspective view of the printer 100 in a state in which the extensional-reversing section 18 is detached from the printer 100 illustrated in FIG. 7. FIG. 9 is an enlarged perspective view of an area in a vicinity of the upper end of the side plate 1*a* of the apparatus body 1.

As illustrated in FIGS. 3, 8, and 9, the side plate 1*a* includes coupling parts 87 such as insertion recesses 87*a* and through-holes 87*b* on two places in the sheet conveyance direction SCD. The extension tray 84 and the extension-tray cover 85 are hooked on the insertion recesses 87*a*. The through-holes 87*b* are disposed below the insertion recesses 87*a*.

Figure 10:
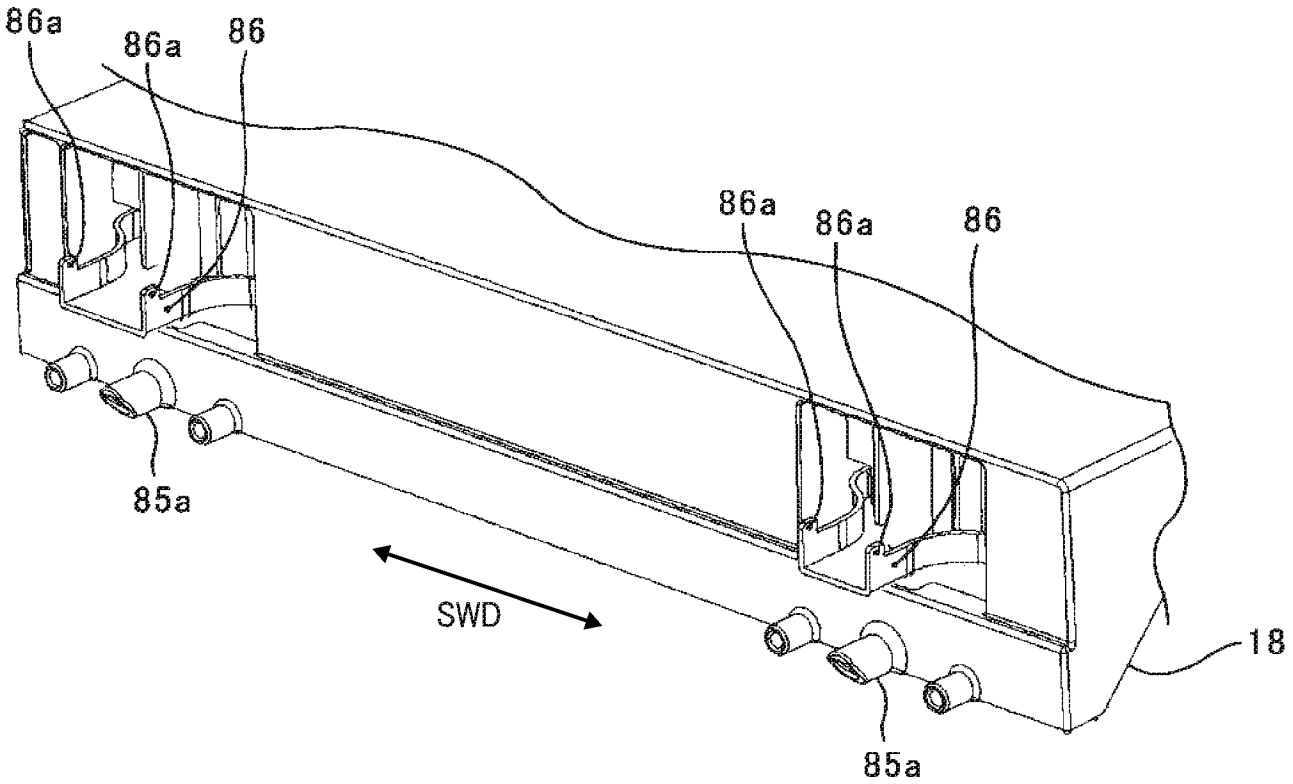
FIG. 10 is an enlarged perspective view of an end face of the extensional-reversing section that faces the side plate.

FIG. 10 is an enlarged perspective view of an end face of the extensional-reversing section 18 that faces the side plate 1*a* when attaching the extensional-reversing section 18 to the apparatus body 1. As illustrated in FIG. 10, the extensional-reversing section 18 includes coupling parts 86 and positioning projections 85*a*. The coupling parts 86 of the extensional-reversing section 18 engage the insertion recesses 87*a* of the side plate 1*a*. The positioning projections 85*a* are disposed below the coupling parts 86 and engage the through-holes 87*b* of the side plate 1*a*.

The coupling parts 86 include hook portions 86*a* at a leading end of the hook portions 86*a*. The hook portions 86*a* project upward. While the hook portions 86*a* are hooked on the insertion recesses 87*a*, the extensional-reversing section 18 is rotated such that the positioning projections 85*a* moves toward the side plate 1*a*. Thereby, two coupling parts 86 engage the two insertion recesses 87*a*, respectively. Further, two positioning projections 85*a* engage the two through-holes 87*b*. Then, mounting the extensional-reversing section 18 to the apparatus body 1 is completed.

In the present embodiment, as illustrated in FIG. 8, a thickness of one end (left end in FIG. 8) of the extension-tray cover 85 in a sheet width direction SWD at which the coupling parts 86 are provided is greater than a thickness of an another end (right end in FIG. 8) of the extension-tray cover 85 in the sheet width direction SWD. This structure increases the rigidity of the attachment side (coupling parts 86 side) of the extension-tray cover 85 that functions as a joint when the extensional-reversing section 18 is attached to the apparatus body 1. Thus, the rigidity of the attachment side (left end in FIG. 8) of the extensional-reversing section 18 becomes greater than the rigidity of the other side (right end in FIG. 8) of the extensional-reversing section 18. Therefore, this structure prevents a deformation of the extensional-reversing section 18. Then, attachment of the extensional-reversing section 18 to the apparatus body 1 is completed.

Thus, the extensional-reversing section 18 is easily attached to the apparatus body 1 without using a tool. As the positioning projections 85*a* are inserted into the through-holes 87*b*, the position of the extensional-reversing section 18 is determined relative to the apparatus body 1.

Figure 11:
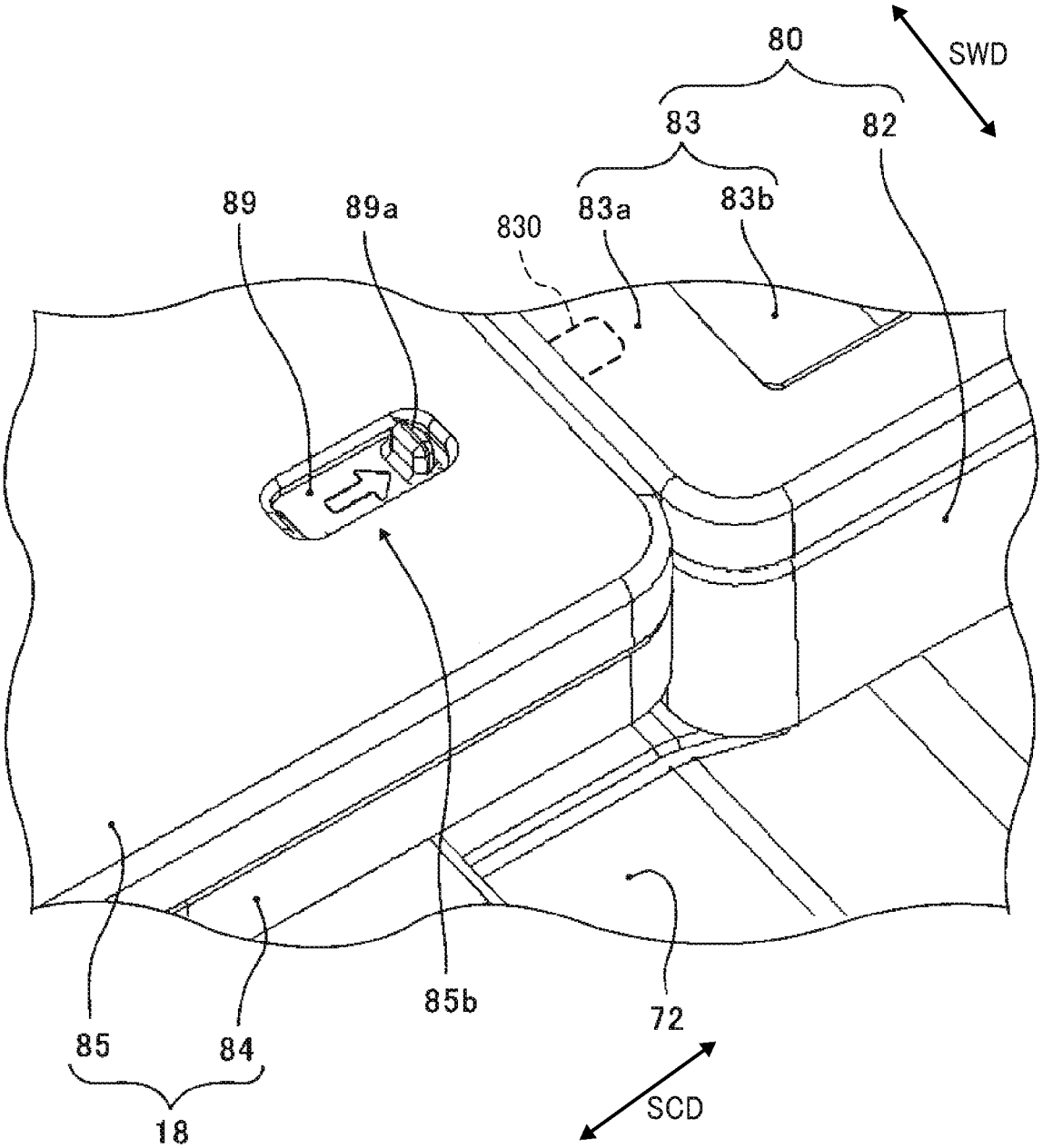
FIG. 11 is an enlarged perspective view of an engagement portion where the extensional-reversing section engages the sheet reversing section.

FIG. 11 is an enlarged perspective view of an engagement portion where the extensional-reversing section 18 engages with the sheet reversing section 80 at a front side (right hand side in FIG. 8) of the apparatus body 1.

The extension-tray cover 85 includes a positioning insert 89. The positioning insert 89 is disposed at vicinity of an end (right end in FIG. 8) of the extension-tray cover 85 opposite the end (left end in FIG. 8) where the coupling parts 86, which engages the coupling parts 87, is provided. Thus, the positioning insert 89 is provided at the extension-tray cover 85 at the front side of the apparatus body 1. The positioning insert 89 is detachably inserted into an insertion hole 830 provided in either the reversing tray 82 or the reversing-tray cover 83 that are fixed to (connected to) the apparatus body 1.

The insertion hole 830 is formed on the end face 82*a* of the reversing tray 82 or the end face 83*c* of the reversing-tray cover 83. The positioning insert 89 of the extensional-reversing section 18 is inserted into the insertion hole 830 formed on an end face of the reversing tray 82 or the reversing-tray cover 83. The end face of the reversing tray 82 and the reversing-tray cover 83 is disposed perpendicular to the side plate 1*a* on which the coupling parts 87 are formed.

The positioning insert 89 on the extension-tray cover 85 is movable (e.g., to approach and move away) relative to the insertion hole 830 back and forth in a direction parallel to the sheet conveyance direction SCD. The positioning insert 89 includes a tab 89*a* to be gripped by the user. The extension-tray cover 85 further includes a window 85*b*, through which the user slides the positioning insert 89. Through the window 85*b*, the user grips the tab 89*a* and slides the positioning insert 89 toward or away from the insertion hole 830. The positioning insert 89 inserted in the insertion hole 830 contacts at least an upper inner wall of the insertion hole 830 to determine the position of the positioning insert 89. Thus, the position of the extensional-reversing section 18 relative to the reversing tray 82 or the reversing-tray cover 83 is determined.

While the hook portions 86*a* and the positioning projections 85*a* are engaged with the insertion recesses 87*a* and through-holes 87*b*, the positioning insert 89 is slide toward the insertion hole 830 of the sheet reversing section 80. Thereby, the extensional-reversing section 18 is fixed to the apparatus body 1. Further, the extensional-reversing section 18 can be detachable from the apparatus body 1 by sliding the positioning insert 89 away (opposite) from the sheet reversing section 80.

With mounting the extensional-reversing section 18 to the apparatus body 1, it is possible to extend the reverse passage of the sheet reversing section 8 to the conveyable largest length of the sheet P in the printer 100. Thus, the extensional-reversing section 18 can protect entire area of the sheet P, the conveyance direction of which is to be reversed.

As a configuration to protect the sheet having largest length, it is not limited to both the extension tray 84 and the extension-tray cover 85 of the extensional-reversing section 18 to have a length to cover the sheet P having largest size. For example, only the extension tray 84 may have a length corresponding to the largest length of the sheet P in order to prevent hanging down of the sheet P when the sheet P is reversed. Further, only the extension-tray cover 85 may have a length corresponding to the largest length of sheet P in order to prevent the user to contact the sheet P when the sheet P is reversed.

The configuration to fix each parts of the extensional-reversing section 18 to the apparatus body 1 is not limited to the engagement portion as described above. A magnet, a lock lever, or a claw may be provided to the extensional-reversing section 18 to fit into the apparatus body 1.

Figure 12:
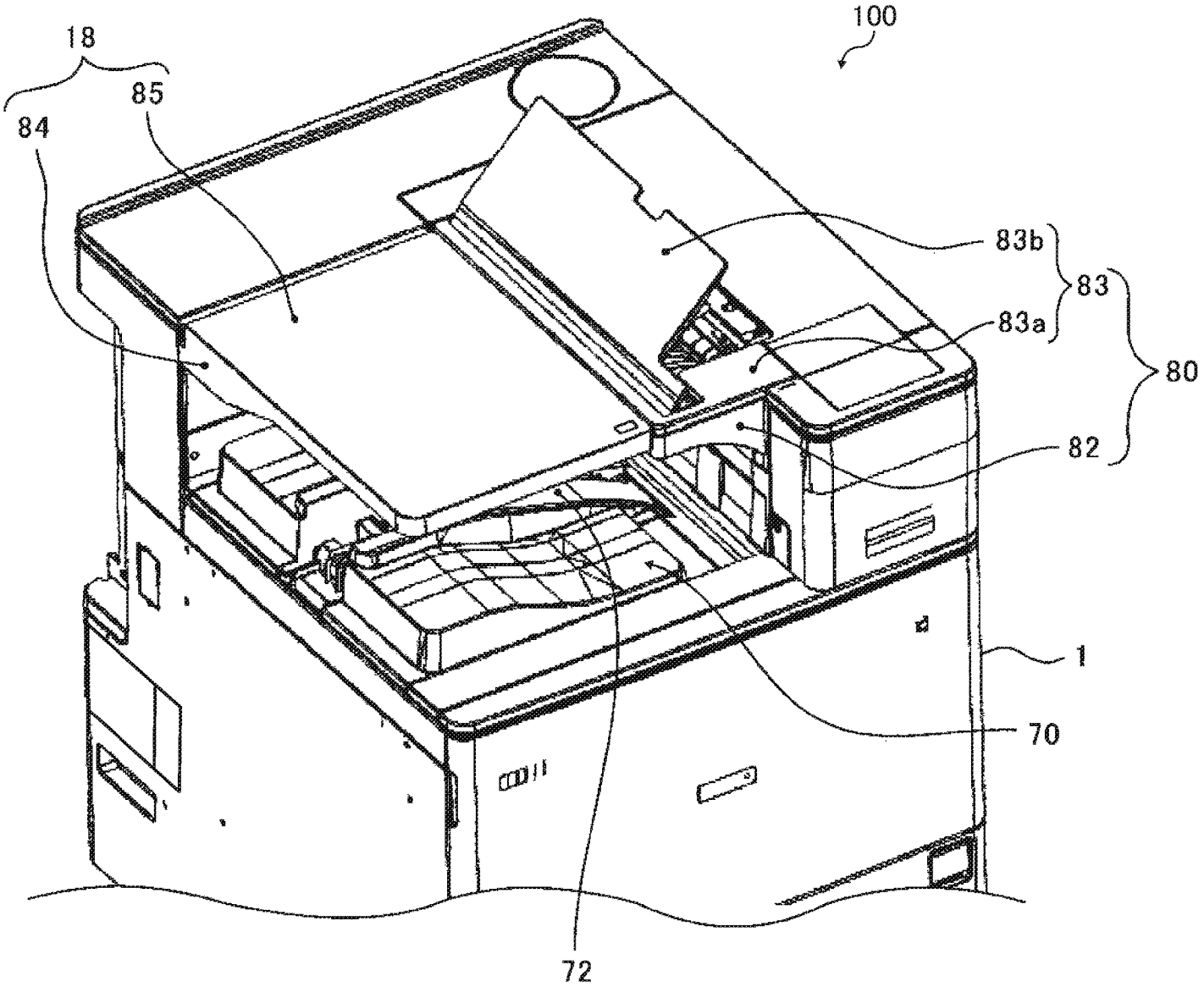
FIG. 12 is a perspective view of the printer in a state in which the openably closable cover of the reversing-tray cover is opened from the state illustrated in FIG. 4.

FIG. 12 is a perspective view of the printer 100 in a state in which the openably closable cover 83*b* of the reversing-tray cover 83 is opened from the state illustrated in FIG. 4. When a paper jam occurs at the reverse passage, the sheet P clogged in the reverse passage can be easily removed by opening the openably closable cover 83*b* as illustrated in FIG. 12.

As illustrated in FIG. 3, when the extensional-reversing section 18 is detached from the printer 100, a leading end of the sheet P to be reversed may project beyond the leading end of the sheet reversing section 80 and hang down. However, an area above the ejection tray 72 covered with the member that constitutes the reversing device 200 can be reduced by detaching the extensional-reversing section 18 and leaving only the sheet reversing section 80.

Thereby, visibility of the ejection tray 72 positioned below the sheet reversing section 80 can be improved. Further, space for an operation such as removing the sheet P from the ejection tray 72 is enlarged. Thus, operability such as removing the sheet P from the ejection tray 72 is improved.

The reversing tray 82 and the extension tray 84 act as a sheet support. At a division portion (connection portion) of the reversing tray 82 and the extension tray 84, a wall that forms the end face 82*a* of the reversing tray 82 acts as a rib to prevent deformation of the sheet support. Therefore, comparing to a structure in which the reversing tray 82 and the extension tray 84 are integrally molded to extend to the length of the extension tray 84, a structure in which more than two members are connected to have the same length can increase stiffness of the sheet support.

Further, the reversing-tray cover 83 and the extension-tray cover 85 act as a cover. At a division portion (connection portion) of the reversing-tray cover 83 and the extension-tray cover 85, a wall that forms the end face 83*c* of the reversing-tray cover 83 acts as a rib to prevent deformation of the cover. Therefore, compared to a structure in which the reversing-tray cover 83 and the extension-tray cover 85 are integrally molded to extend to the length of the extension-tray cover 85, a structure in which more than two members are connected to have the same length can increase stiffness of the cover.

Thus, at least one of the reversing tray 82 (sheet support) and the reversing-tray cover 83 (cover) is divided into two or more connectable parts in a sheet width direction SWD perpendicular to the sheet conveyance direction SCD (first direction and the second direction).

Thus, the deformation of the sheet support and the cover against a load applied from an upper face of the cover can be prevented by increasing the stiffness of the sheet support and the cover.

Next, attachment of the extensional-reversing section 18 to the apparatus body 1 is described.

Figure 13:
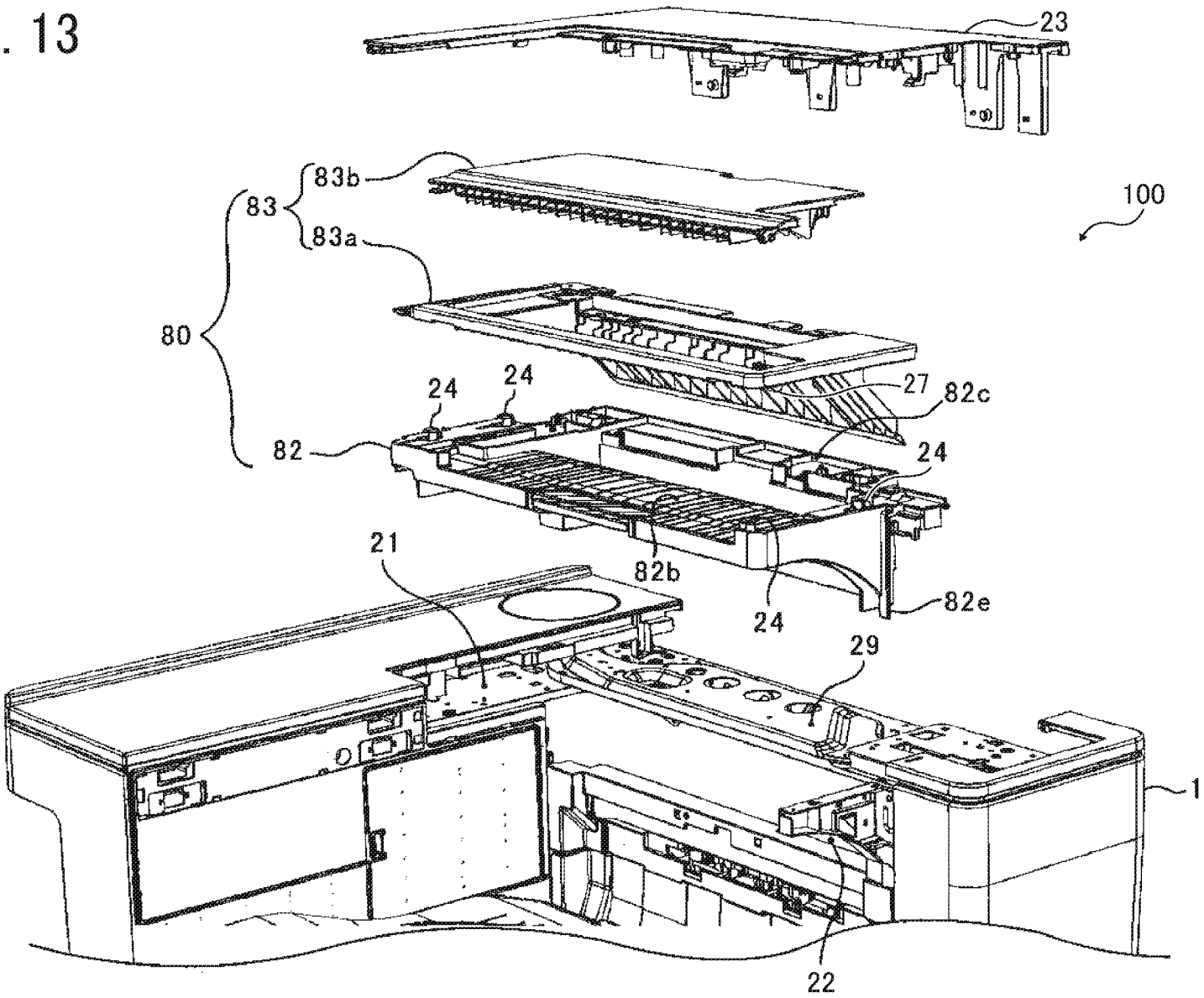
FIG. 13 is an external perspective view of the printer to describe an order of assembling parts that constitute the sheet reversing section to the apparatus body.

FIG. 13 is an external perspective view of an upper part of the printer 100 to describe an order of assembling the parts that constitute the sheet reversing section 80 to the apparatus body 1.

As illustrated in FIG. 13, in a state in which the sheet reversing section 80 is removed (detached) from the apparatus body 1, an upper-face frame 29, an upper-face frame 21, and a bracket 22 of the apparatus body 1 are exposed. The upper-face frame 29 is disposed at an upper right-hand side of the apparatus body 1. The upper-face frame 21 is disposed at an upper rear side of the apparatus body 1. The bracket 22 is disposed at front side of the apparatus body 1.

Figure 14:
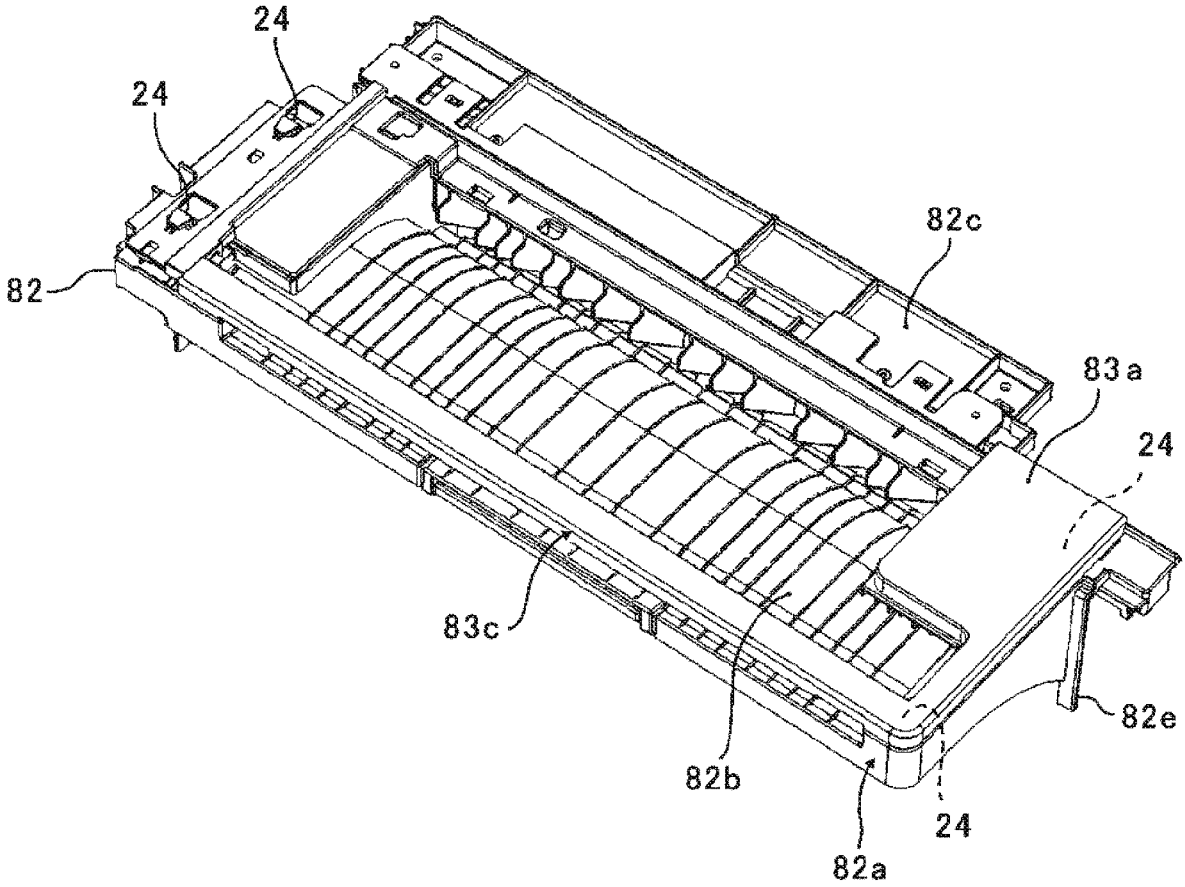
FIG. 14 is a perspective view illustrating the cover fixing portion of the reversing-tray cover is fixed to the reversing tray.

FIG. 14 is a perspective view illustrating the cover fixing portion 83*a* of the reversing-tray cover 83 fixed to the reversing tray 82. As illustrated in FIGS. 13 and 14, the reversing tray 82 includes four engagement claws 24 on top face of the reversing tray 82. The cover fixing portion 83*a* includes four claw engaging parts 27 on a bottom face of the cover fixing portion 83*a*.

The reversing tray 82 and the cover fixing portion 83*a* are connected (fixed) by engaging the four engagement claws 24 of the reversing tray 82 with the four claw engaging parts 27 of the cover fixing portion 83*a*.

Thus, the printer 100 includes the four engagement claws 24 and the four claw engaging parts 27 (fixing portion) to fix (connect) the reversing-tray cover 83 (cover) to the reversing tray 82 (sheet support).

As illustrated in FIG. 14, two engagement claws 24 at the front side (lower right hand side in FIG. 14) of the reversing tray 82 are provided at lower side of the cover fixing portion 83*a* as indicated by broken lines with the reference numeral "24".

Figure 15:
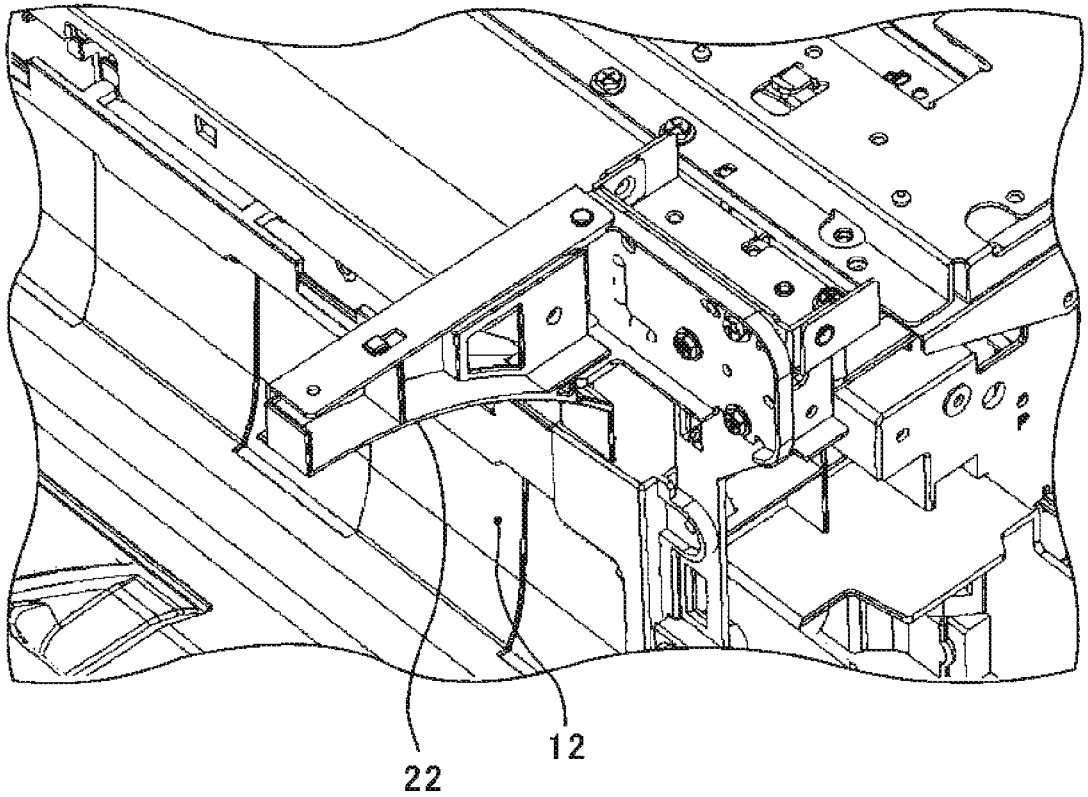
FIG. 15 is an enlarged perspective view of an area around the bracket illustrated in FIG. 13.

FIG. 15 is an enlarged perspective view of an area around the bracket 22 illustrated in FIG. 13.

The reversing tray 82 is assembled and fixed to the apparatus body 1 as illustrated in FIG. 13, and the reversing-tray cover 83 is fixed to the reversing tray 82. The reversing-tray cover 83 is assembled by integrally fixing (connecting) the cover fixing portion 83*a* and the openably closable cover 83*b* as one body. Finally, a top cover 23 is fixed to the sheet reversing section 80. The top cover 23 is disposed at a top right-hand side of the apparatus body 1.

Figure 16:
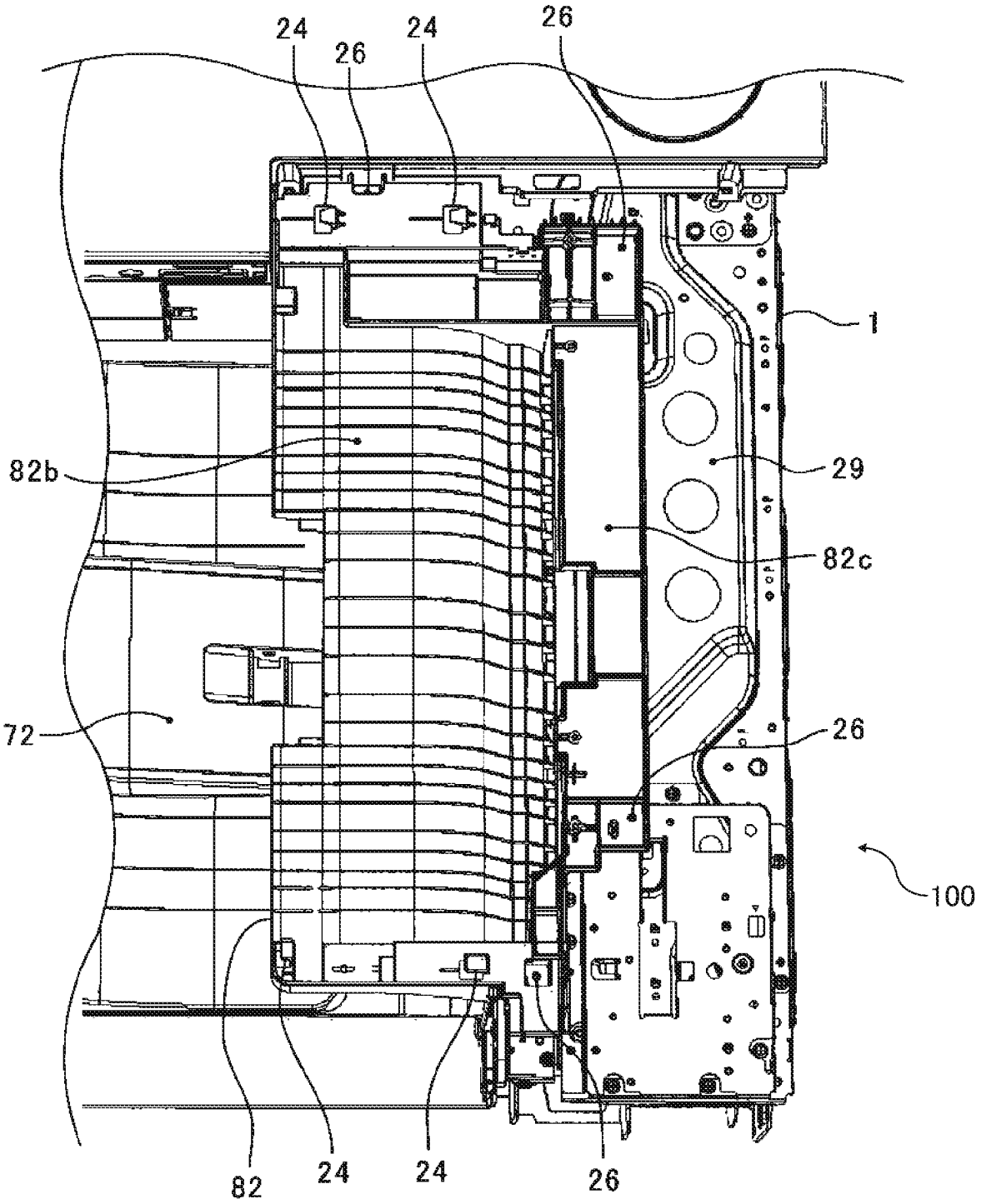
FIG. 16 is a plan view of the printer in a state in which the reversing tray is attached to the apparatus body.

FIG. 16 is a plan view of the printer 100 in a state in which the reversing tray 82 is attached to the apparatus body 1. The reversing tray 82 is fixed to the apparatus body 1 by inserting the screw holes 26 disposed at four places on the reversing tray 82 and screwing the reversing tray 82 against the upper-face frame 29 of the apparatus body 1. In a state as illustrated in FIG. 16, the reversing tray 82 covers the bracket 22, and the bracket 22 supports a front end (lower end in FIG. 16) of the reversing tray 82.

The reversing-tray cover 83 is assembled by integrally fixing (connecting) the cover fixing portion 83*a* and the openably closable cover 83*b* with fitting claws.

Figure 17:
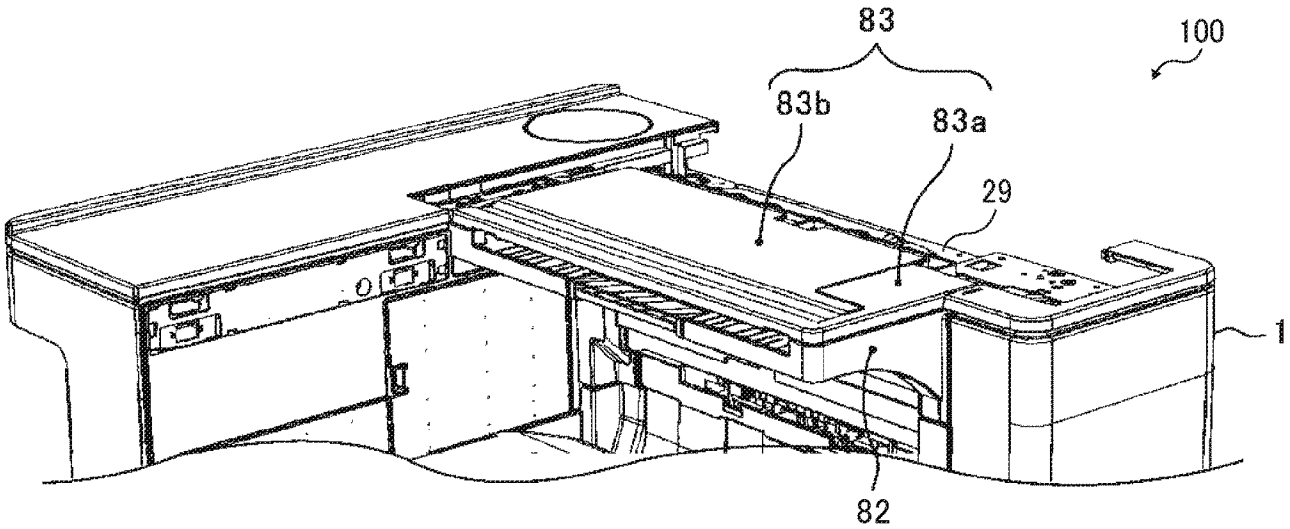
FIG. 17 is a perspective view of the printer in a state in which the reversing-tray cover is attached to the printer in a state as illustrated in FIG. 16.

FIG. 17 is a perspective view of the printer 100 in a state in which the reversing-tray cover 83 is attached to the printer 100 in a state illustrated in FIG. 16.

As illustrated in FIG. 13, the reversing-tray cover 83 is fixed (connected) to the reversing tray 82 by engaging the claw engaging parts 27 provided on a bottom face of the reversing-tray cover 83 with the engagement claws 24 of the reversing tray 82 and fixing the reversing-tray cover 83 and the reversing tray 82 with screws.

Thereby, the sheet reversing section 80 has a strength enough to prevent paper jam and breakage even when goods are stacked on a top face of the reversing-tray cover 83. To fix the reversing tray 82 to the apparatus body 1 or to fix the reversing-tray cover 83 to the reversing tray 82, not only screws but also a lock lever or fitting claws may be used.

Figure 18:
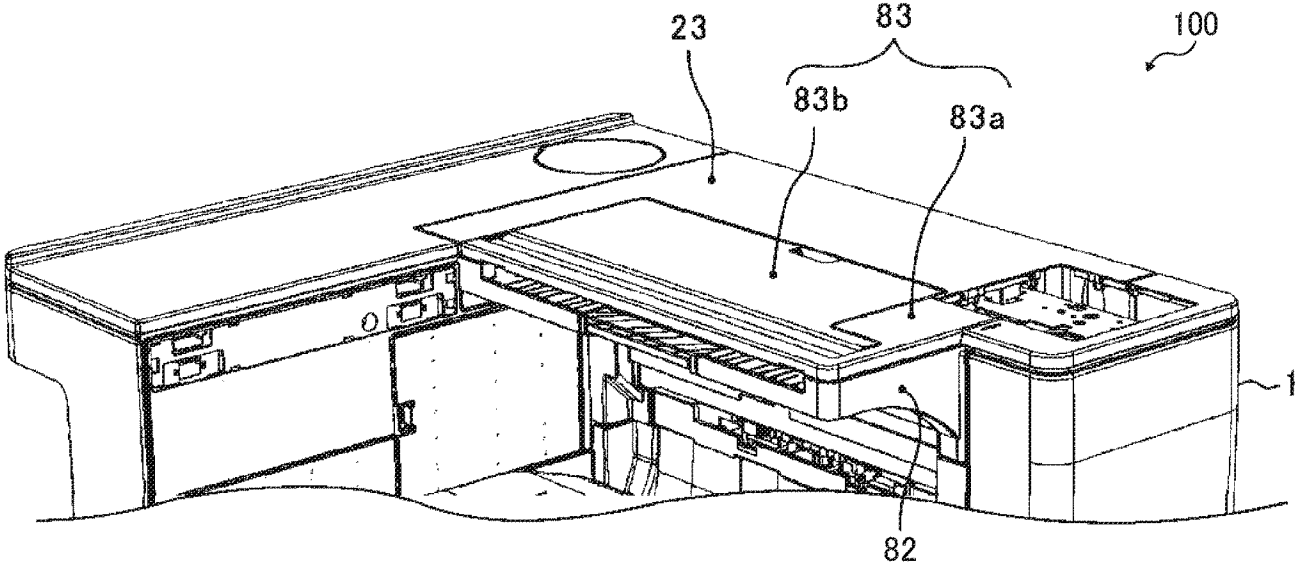
FIG. 18 is a perspective view of the printer in a state in which the top cover is attached to the printer illustrated in FIG. 17.

FIG. 18 is a perspective view of the printer 100 in a state in which the top cover 23 is attached to the printer 100 in a state illustrated in FIG. 17. The top cover 23 is attached to the sheet reversing section 80 to cover an upper part of the upper-face frame 29.

Next, fixing the sheet reversing section 80 to the apparatus body 1 is described.

Figure 19A:
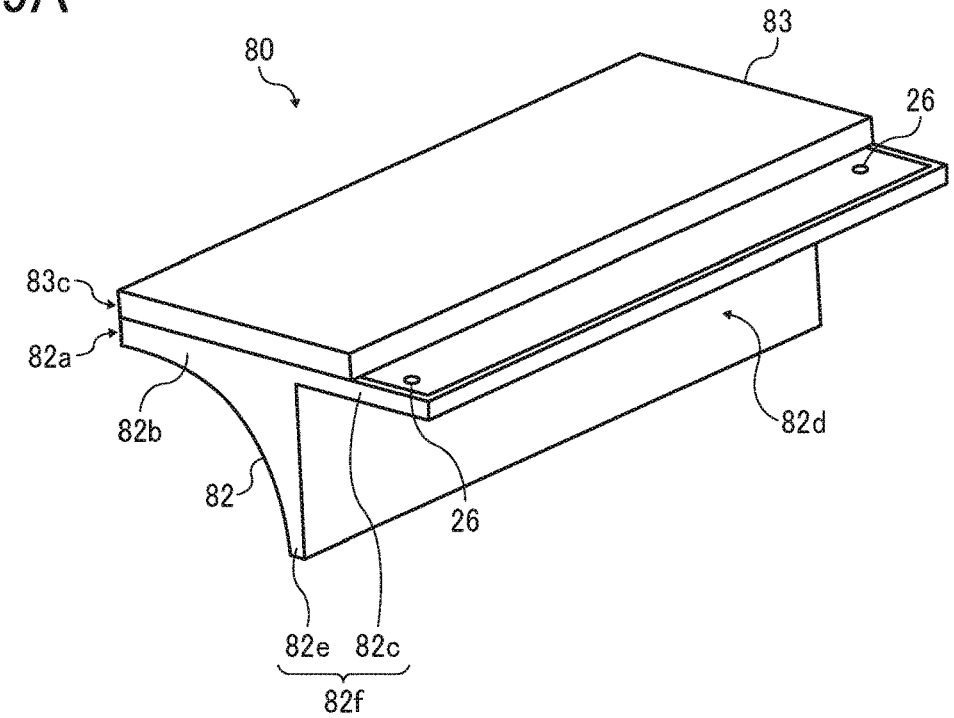
FIGS. 19A and 19B illustrate a configuration to fix the sheet reversing section to the apparatus body.
Figure 19B:
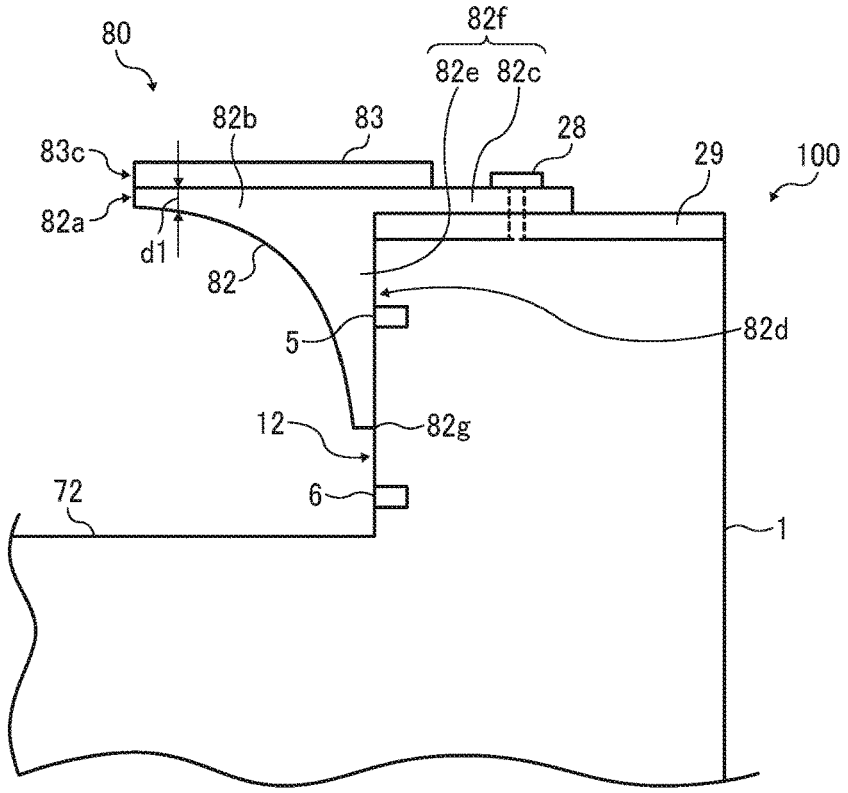

FIGS. 19A and 19B illustrate a configuration to fix the sheet reversing section 80 to the apparatus body 1. FIG. 19A is a schematic perspective view of the sheet reversing section 80. FIG. 19B is a schematic front view of the printer 100 in a state in which the sheet reversing section 80 is fixed to the apparatus body 1.

As illustrated in FIG. 5, the printer 100 includes the reversing roller pair 81 that forms a part of the reversing device 200. The reversing roller pair 81 reverses the conveyance direction of the sheet P fed from the reversal opening 5 from the first direction FD to the second direction SD and conveys the reversed sheet P inside the apparatus body 1 in the second direction SD. The reversal opening 5 is a sheet ejection opening provided at the ejection wall face 12 that is one of wall faces of the apparatus body 1 to form the sheet ejection section 70.

As illustrated in FIG. 19B, the printer 100 includes the reversing tray 82 that projects laterally from the ejection wall face 12. The reversing tray 82 includes a sheet guide 82*b* that is a sheet support to support a bottom face of the sheet P fed from the reversal opening 5.

The reversing tray 82 includes an abutting portion 82*e* that forms an abutting face 82*d* to contact the ejection wall face 12 of the apparatus body 1. The abutting face 82*d* extends in a vertical downward direction at the right hand side (the side that faces the reversal opening 5) of the end of the sheet guide 82*b* in FIGS. 19A and 19B. Further, the reversing tray 82 includes a projection 82*c* that projects from the abutting face 82*d* in the second direction (to the right hand side in FIG. 19A) opposite to the first direction (to the left hand side in FIG. 19A). The first direction is a projection direction of the sheet guide 82*b*.

The printer 100 includes fixing screws 28 to fix the projection 82*c* to the upper-face frame 29 of the apparatus body 1. The upper-face frame 29 is a structural body of the apparatus body 1.

The reversing tray 82 includes a mounting portion 82*f* that is constituted by the abutting portion 82*e* and the projection 82*c*. The mounting portion 82*f* is provided to the reversing tray 82 for mounting the reversing tray 82 to the apparatus body 1.

Further, the printer 100 includes a reversing-tray cover 83. The reversing-tray cover 83 positions at upper part of the sheet guide 82*b*. The reversing-tray cover 83 forms a reverse passage together with the sheet guide 82*b*. The sheet P passes through the reverse passage so that the conveyance direction of the sheet P is reversed.

When the user put goods on the top face of the reversing-tray cover 83 of the printer 100, a load acts on the sheet guide 82*b* via the reversing-tray cover 83.

At this time, a moment acts on the reversing tray 82 in a rotational direction such that a leading end (end face 82*a* side) of the sheet guide 82*b* moves downward as a rotational movement that rotates around a root 82*g* of the sheet guide 82*b* as a center. At this time, the abutting face 82*d* abuts the ejection wall face 12 of the apparatus body 1. Thereby, the sheet reversing section 80 of the present embodiment can prevent the reversing tray 82 to be deformed by rotating around the root 82*g* of the sheet guide 82*b*.

Further, a following moment acts on the reversing tray 82 when the load acts on the sheet guide 82*b* and the abutting face 82*d* abuts on the ejection wall face 12.

The moment acts on the reversing tray 82 such that an upper end of the abutting face 82*d* rotates around a lower end (root 82*g*) of the abutting face 82*d* as a center to move left hand side in FIG. 19B. The printer 100 includes screw holes 26 on the projection 82*c* that projects from the abutting face 82*d* in a right hand direction (second direction) in FIG. 19B.

Next, projection 82*c* is fixed to the upper-face frame 29 of the apparatus body 1 by screwing the fixing screws 28 through screw holes 26 of the reversing tray 82 against the upper-face frame 29 of the apparatus body 1. Fixing the projection 82*c* to the apparatus body 1 can prevent the upper end of the abutting face 82*d* to move left hand side in FIG. 19B.

When the moment described above is applied around the lower end (root 82*g*) of the abutting face 82*d* as a center, a tensile stress acts on the projection 82*c* along a projection direction (second direction) of the projection 82*c* fix on the apparatus body 1 with the fixing screws 28. The projection 82*c* has a plate-like shape so that the projection 82*c* can prevent the deformation occurred by an application of the tensile stress on the projection 82*c*. The plate-like projection 82*c* has an area extending in a sheet width direction SWD.

Thus, the sheet reversing section 80 of the present embodiment can prevent the displacement of the sheet guide 82*b* and the abutting portion 82*e* from a fixing position of the fixing screws 28 even when the above described moment acts on the sheet reversing section 80.

The fixing screws 28 fix the vertical position of the projection 82*c* relative to the upper-face frame 29 of the apparatus body 1. Thereby, the fixing screws 28 can prevent the projection 82*c* to be separate from the upper-face frame 29 when the load acts on the sheet guide 82*b*.

The above-described configuration prevents displacement of the reversing tray 82 relative to the apparatus body 1 when the load acts on the sheet guide 82*b*. Further, the above-described configuration ensures an assembling strength of the reversing tray 82 to the apparatus body 1. Thus, the above-described configuration can prevent the reversing tray 82 to be fallen off from the apparatus body 1 due to the application of the load on the sheet guide 82*b*.

The printer 100 can prevent the hanging down of the sheet P during reversing the conveyance direction of the sheet P by supporting the bottom face of the sheet P with the sheet guide 82*b* of the reversing tray 82. The reversing-tray cover 83 can prevents the user's hand to contact with the sheet P during reversing the conveyance direction of the sheet P.

The reversing-tray cover 83 and the reversing tray 82 are integrally fixed with each other to configure the sheet reversing section 80 by engaging the claw engaging parts 27 of the reversing-tray cover 83 with the engagement claws 24 of the reversing tray 82 and fixing the reversing-tray cover 83 and the reversing tray 82 with the fixing screws 28.

As illustrated in FIGS. 19A and 19B, a thickness d1 of the abutting face 82*d* of the abutting portion 82*e* in a height direction is greater than a thickness d1 of the end face 82*a* of the leading face of the sheet guide 82*b* in the height direction.

Thus, as illustrated in FIGS. 19A and 19B, a thickness d1 in a height direction of an upstream end (right end) in the second direction of at least one of the reversing tray 82 (sheet support) and the reversing-tray cover 83 (cover) is greater than a thickness d1 in the height direction of a downstream end (left end) in the first direction of the at least one of the reversing tray 82 (sheet support) and the reversing-tray cover 83 (cover).

This shape of the sheet guide 82*b* can restrain the deformation of the sheet guide 82*b* when the load acts on the sheet guide 82*b*.

In the printer 100 of the present embodiment, the projection 82*c* of the reversing tray 82 is fixed to the upper-face frame 29. In the above-described configuration, the projection 82*c* is pulled in a laterally left-hand direction in FIG. 19B when the load acts on the sheet guide 82*b*. This direction of the pulling force is perpendicular to an insertion direction (vertical direction) of the fixing screws 28.

Thus, the fixing screws 28 do not come out from the projection 82*c* even when the load acts on the sheet guide 82*b*. Further, the sheet reversing section 80 can prevent the abutting portion 82*e* to move in a direction (left hand direction in FIG. 19B) to separate the abutting face 82*d* from the ejection wall face 12.

In the printer 100 of the present embodiment, the position where the abutting portion 82*e* contacts with the upper end of the ejection wall face 12 becomes the upper end of the abutting face 82*d* in the sheet reversing section 80. Further, the abutting face 82*d* abuts the ejection wall face 12 when the load acts on the sheet guide 82*b* in the printer 100 of the present embodiment.

Thus, the sheet reversing section 80 of the present embodiment can prevent the position of the abutting face 82*d* contacting with the upper end of the ejection wall face 12 to be separate from the ejection wall face 12. Further, the sheet reversing section 80 of the present embodiment can prevent the sheet guide 82*b* to deform in a way hanging down toward the ejection tray 72.

Variations of the sheet reversing section 80 are described below.

Variation 1

Figure 20:
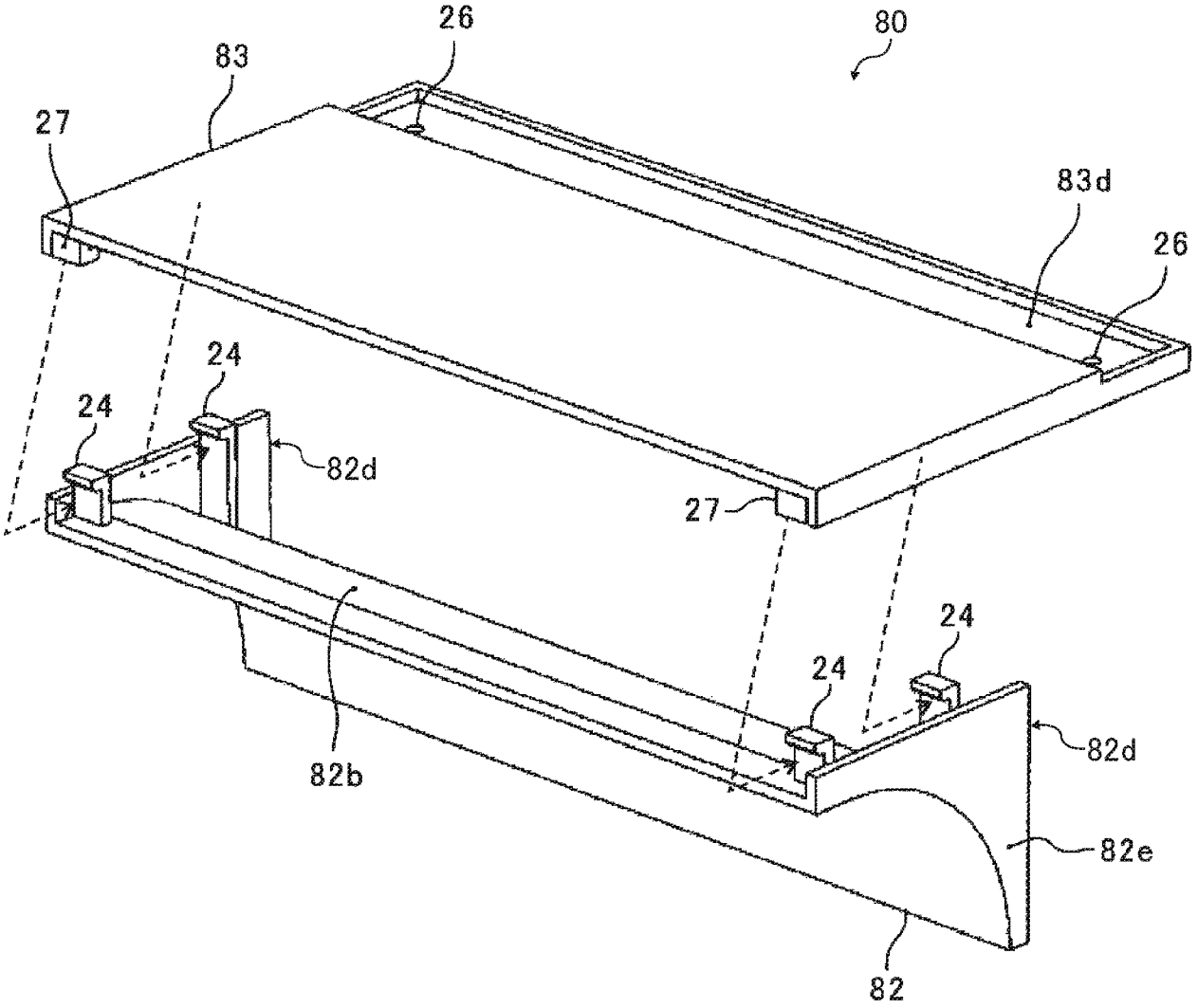
FIG. 20 is a schematic exploded perspective view of the sheet reversing section according to a first variation.

FIG. 20 is a schematic exploded perspective view of the sheet reversing section 80 according to a first variation (Variation 1).

Further, the sheet reversing section 80 of Variation 1 illustrated in FIG. 20 includes a projection 83*d* to ensure the assembling strength. The projection 83*d* is provided on the reversing-tray cover 83. The projection 83*d* projects in a direction opposed to the sheet guide 82*b* from the abutting face 82*d*.

In the sheet reversing section 80 of Variation 1, the reversing-tray cover 83 and the reversing tray 82 are integrally fixed with each other by engaging the claw engaging parts 27 of the reversing-tray cover 83 with the engagement claws 24 of the reversing tray 82 as indicated by a broken arrow in FIG. 20.

Then, the sheet reversing section 80 is fixed to the apparatus body 1 by inserting the fixing screws 28 through the screw holes 26 provided at projection 83*d* of the reversing-tray cover 83 and screwing the fixing screws 28 to the upper-face frame 29 of the apparatus body 1.

The above-described configuration prevents the displacement of the sheet reversing section 80 relative to the apparatus body 1 when the load acts on a portion of the reversing-tray cover 83 that covers the sheet guide 82*b*. Thus, the above-described configuration ensures the assembling strength of the sheet reversing section 80 with the apparatus body 1. Thus, the above-described configuration can prevent the sheet reversing section 80 to be fallen off from the apparatus body 1 by the application of the load on the portion of the reversing-tray cover 83 that covers the sheet guide 82*b*.

Variation 2

Figure 21:
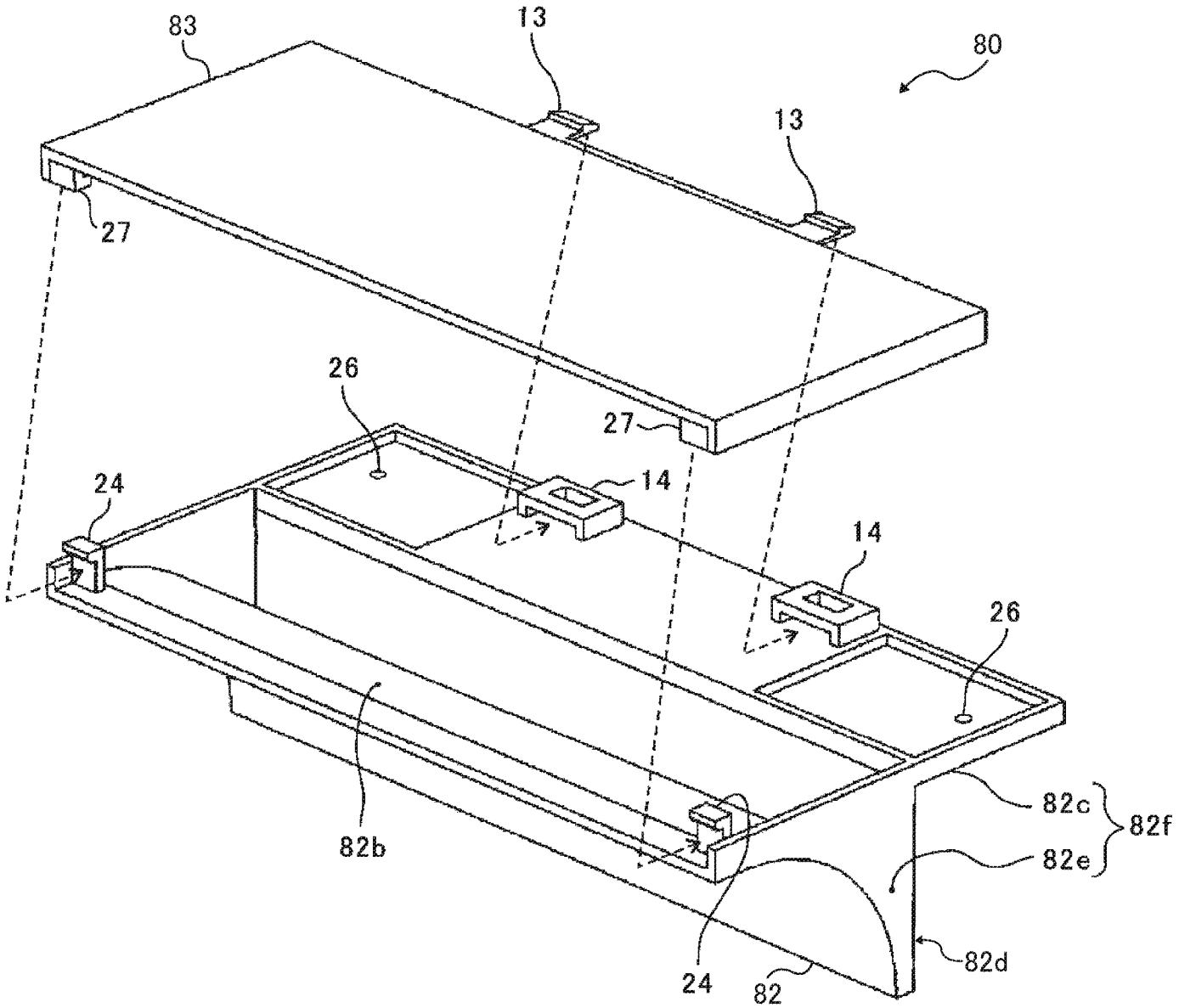
FIG. 21 is a schematic exploded perspective view of the sheet reversing section according to a second variation.

FIG. 21 is a schematic exploded perspective view of the sheet reversing section 80 according to a second variation (Variation 2).

The sheet reversing section 80 of Variation 2 illustrated in FIG. 21 includes a projection 82*c* to ensure the assembling strength. The projection 82*c* is provided on the reversing tray 82. The projection 82*c* projects in a direction opposed to the sheet guide 82*b* from the abutting face 82*d*.

In the sheet reversing section 80 of Variation 2, the reversing-tray cover 83 has two claw engaging parts 27, and reversing tray 82 has two engagement claws 24. Further, the sheet reversing section 80 of Variation 2 has a snap-fit configuration to engage the reversing-tray cover 83 and the reversing tray 82. For example, two engagement convex parts 13 are provided on two places of the reversing-tray cover 83, and two engagement receiving parts 14 are provided on two places of the reversing tray 82. The two engagement convex parts 13 are snap-fitted to and engage the two engagement receiving parts 14.

In the sheet reversing section 80 of Variation 2, the reversing-tray cover 83 and the reversing tray 82 are integrally fixed with each other by engaging the claw engaging parts 27 of the reversing-tray cover 83 with the engagement claws 24 of the reversing tray 82 and engaging the engagement convex parts 13 of the reversing-tray cover 83 and the engagement receiving parts 14 of the reversing tray 82 as indicated by a broken arrow in FIG. 21.

Thereby, the reversing tray 82 and the reversing-tray cover 83 are integrated as one body. Then, the sheet reversing section 80 is fixed to the apparatus body 1 by inserting the fixing screws 28 through the screw holes 26 provided at projection 82*c* of the reversing tray 82 and screwing the fixing screws 28 to the upper-face frame 29 of the apparatus body 1.

The above-described configuration prevents the displacement of the sheet reversing section 80 relative to the apparatus body 1 when the load acts on a portion of the reversing-tray cover 83 that covers the sheet guide 82*b*. Thus, the above-described configuration ensures the assembling strength of the sheet reversing section 80 with the apparatus body 1. Thus, the above-described configuration can prevent the sheet reversing section 80 to be fallen off from the apparatus body 1 by the application of the load on the portion of the reversing-tray cover 83 that covers the sheet guide 82*b*.

In the sheet reversing section 80 of Variation 2, snap-fit is used to fix the reversing-tray cover 83 and the reversing tray 82, thus the reversing-tray cover 83 and the reversing tray 82 are firmly fixed with each other.

Variation 3

Figure 22:
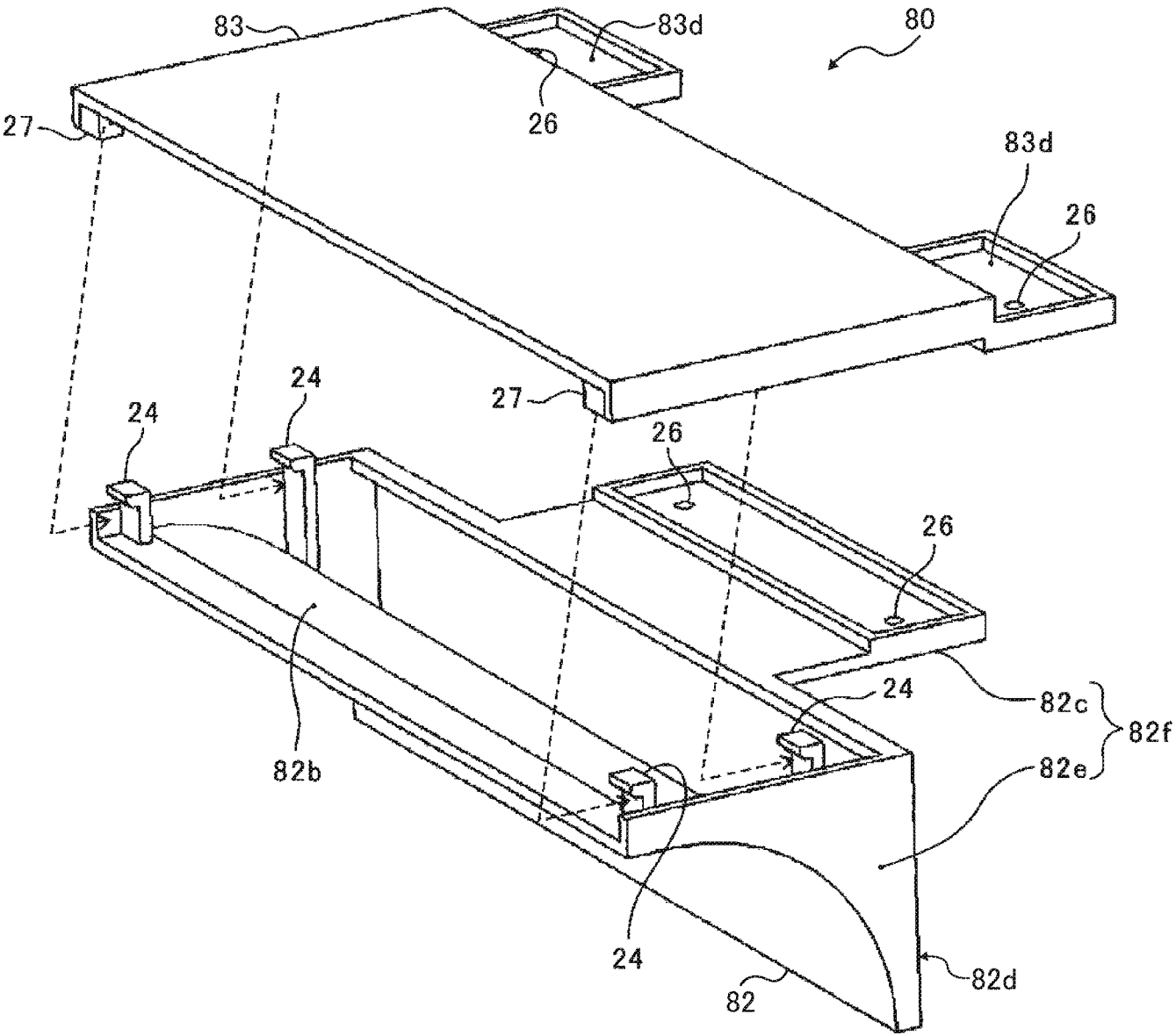
FIG. 22 is a schematic exploded perspective view of the sheet reversing section according to a third variation.

FIG. 22 is a schematic exploded perspective view of the sheet reversing section 80 according to third variation (Variation 3).

In the sheet reversing section 80 of the variation 3, the reversing tray 82 includes a projection 82*c* that projects from the abutting face 82*d* in a direction opposite to a projection direction of the sheet guide 82*b*. The sheet reversing section 80 of the present embodiment ensures the assembly strength by fixing the two projections to the upper-face frame 29 of the apparatus body 1.

In the sheet reversing section 80 of Variation 3, the reversing-tray cover 83 and the reversing tray 82 are integrally fixed with each other by engaging the claw engaging parts 27 of the reversing-tray cover 83 with the engagement claws 24 of the reversing tray 82 as indicated by a broken arrow in FIG. 22.

Then, the sheet reversing section 80 is fixed to the apparatus body 1 by inserting the fixing screws 28 through the screw holes 26 provided at projection 82*c* of the reversing tray 82 and screwing the fixing screws 28 to the upper-face frame 29 of the apparatus body 1.

Then, the sheet reversing section 80 is fixed to the apparatus body 1 by inserting the fixing screws 28 through the screw holes 26 provided at projection 83*d* of the reversing-tray cover 83 and screwing the fixing screws 28 to the upper-face frame 29 of the apparatus body 1. Thus, in Variation 2 and 3, the sheet reversing section 80 is fixed to the apparatus body 1 by screwing the projection 82*c* (Variation 2) or 83*d* (Variation 3) to the upper-face frame 29 of the apparatus body 1.

The above-described configuration prevents the displacement of the sheet reversing section 80 relative to the apparatus body 1 when the load acts on a portion of the reversing-tray cover 83 that covers the sheet guide 82*b*. Thus, the above-described configuration ensures the assembling strength of the sheet reversing section 80 with the apparatus body 1. Thus, the above-described configuration can prevent the sheet reversing section 80 to be fallen off from the apparatus body 1 by the application of the load on the portion of the reversing-tray cover 83 that covers the sheet guide 82*b*.

Variation 4

Figure 23A:
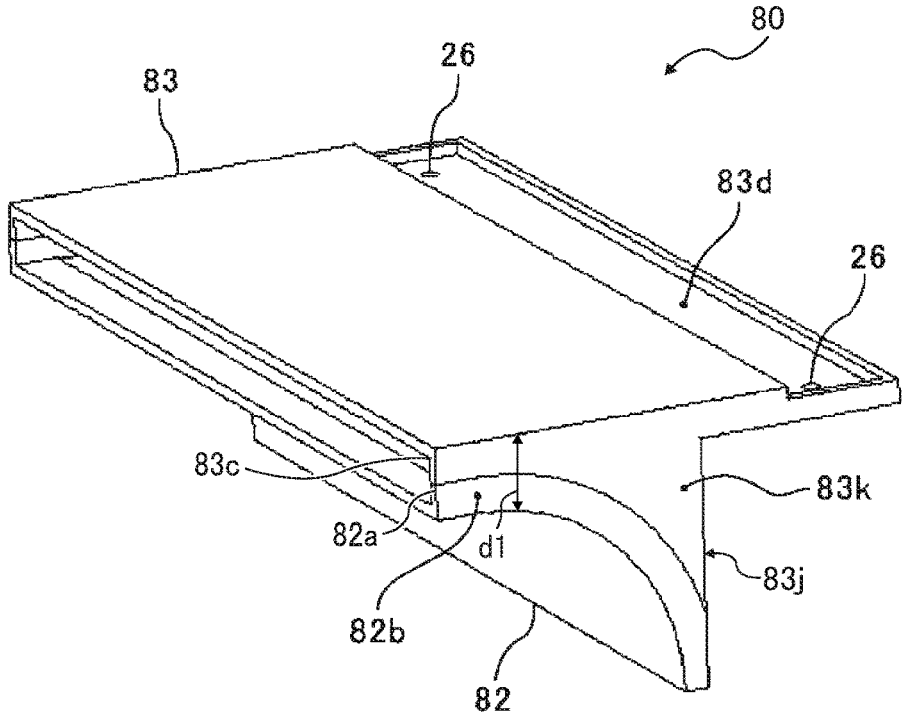
FIGS. 23A and 23B are schematic perspective views of the sheet reversing section according to a fourth variation.
Figure 23B:
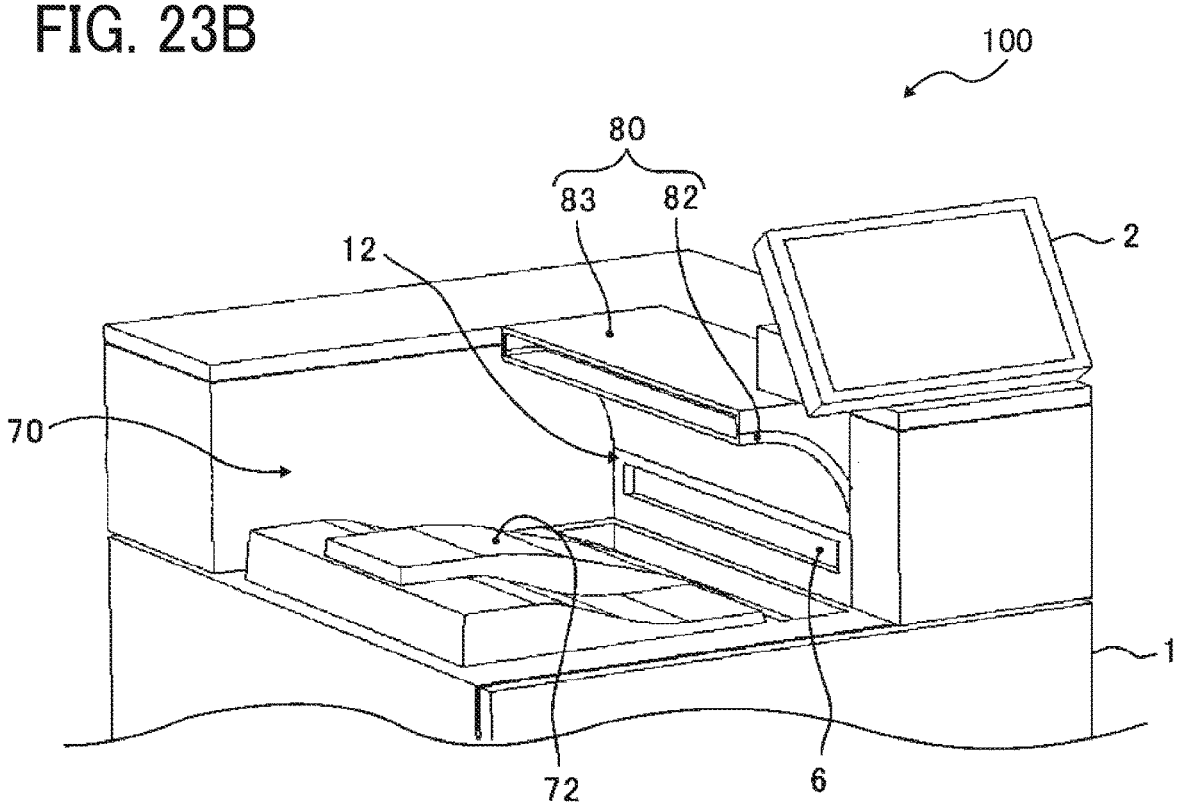

FIGS. 23A and 23B are schematic perspective views of the sheet reversing section 80 according to fourth variation (Variation 4).

FIG. 23A is a perspective view of the sheet reversing section 80 according to the fourth variation.

FIG. 23B is an external perspective view of the printer 100 including the sheet reversing section 80 according to the fourth variation.

The sheet reversing section 80 of Variation 4 illustrated in FIG. 23 includes an abutting portion 83*k* provided on the reversing-tray cover 83. The abutting portion 83*k* acts as an abutting portion that has an abutting face 83*j* to contact with the ejection wall face 12. Thus, the abutting face 83*j* of the abutting portion 83*k* contacts with the ejection wall face 12 of the apparatus body 1. The reversing-tray cover 83 of Variation 4 illustrated in FIG. 23A includes a projection 83*d* that is fixed to the apparatus body 1.

The projection 83*d* projects in a direction opposed to the sheet guide 82*b* from the abutting face 83*j*. The sheet reversing section 80 of Variation 4 includes the abutting portion 83*k* and the projection 83*d*. Thus, the sheet reversing section 80 of Variation 4 can ensure the assembling strength between the sheet reversing section 80 and the apparatus body 1 as similar to the above described sheet reversing section 80.

As illustrated in FIG. 23A, a thickness d1 in a height direction of the abutting face 83*j* of the abutting portion 83*k* is greater than a thickness d1 in a height direction of the end face 83*c* of the reversing-tray cover 83. This shape of the reversing-tray cover 83 can restrain the deformation of the reversing-tray cover 83 and the reversing tray 82 when the load acts on the reversing-tray cover 83.

In the sheet reversing section 80 of Variation 4, the reversing-tray cover 83 and the reversing tray 82 are integrally fixed with each other by engaging the claw engaging parts 27 of the reversing-tray cover 83 with the engagement claws 24 of the reversing tray 82 as illustrated in FIG. 20 of Variation 1. Then, the sheet reversing section 80 is fixed to the apparatus body 1 by inserting the fixing screws 28 through the screw holes 26 provided at projection 83*d* of the reversing-tray cover 83 while the abutting the abutting face 83*j* against the ejection wall face 12 and screwing the fixing screws 28 to the upper-face frame 29 of the apparatus body 1. Thereby, the sheet reversing section 80 is fixed to the apparatus body 1.

The above-described configuration prevents the displacement of the sheet reversing section 80 relative to the apparatus body 1 when the load acts on a portion of the reversing-tray cover 83 that covers the sheet guide 82*b*. Thus, the above-described configuration ensures the assembling strength of the sheet reversing section 80 with the apparatus body 1. Thus, the above-described configuration can prevent the sheet reversing section 80 to be fallen off from the apparatus body 1 by the application of the load on the portion of the reversing-tray cover 83 that covers the sheet guide 82*b*.

The sheet reversing sections 80 according to Variations 1 to 4 use the fixing screws 28 to fix the sheet reversing section 80 to the apparatus body 1. However, lock levers or claws may be used to fix the sheet reversing section 80 to the apparatus body 1.

As a configurations to engage the reversing-tray cover 83 and the reversing tray 82 that constitutes the sheet reversing section 80, there is a configuration to engage the claw engaging portions with the engaging claws, a configuration that engagement convex parts are snap-fitted to and engage the two engagement receiving parts, and a configuration that has both of the engaging claws and the snap-fit.

Further, any types of combinations of such as screws, lock levers, and claws may be used to integrally fix the reversing tray 82 and the reversing-tray cover 83.

Figure 24:
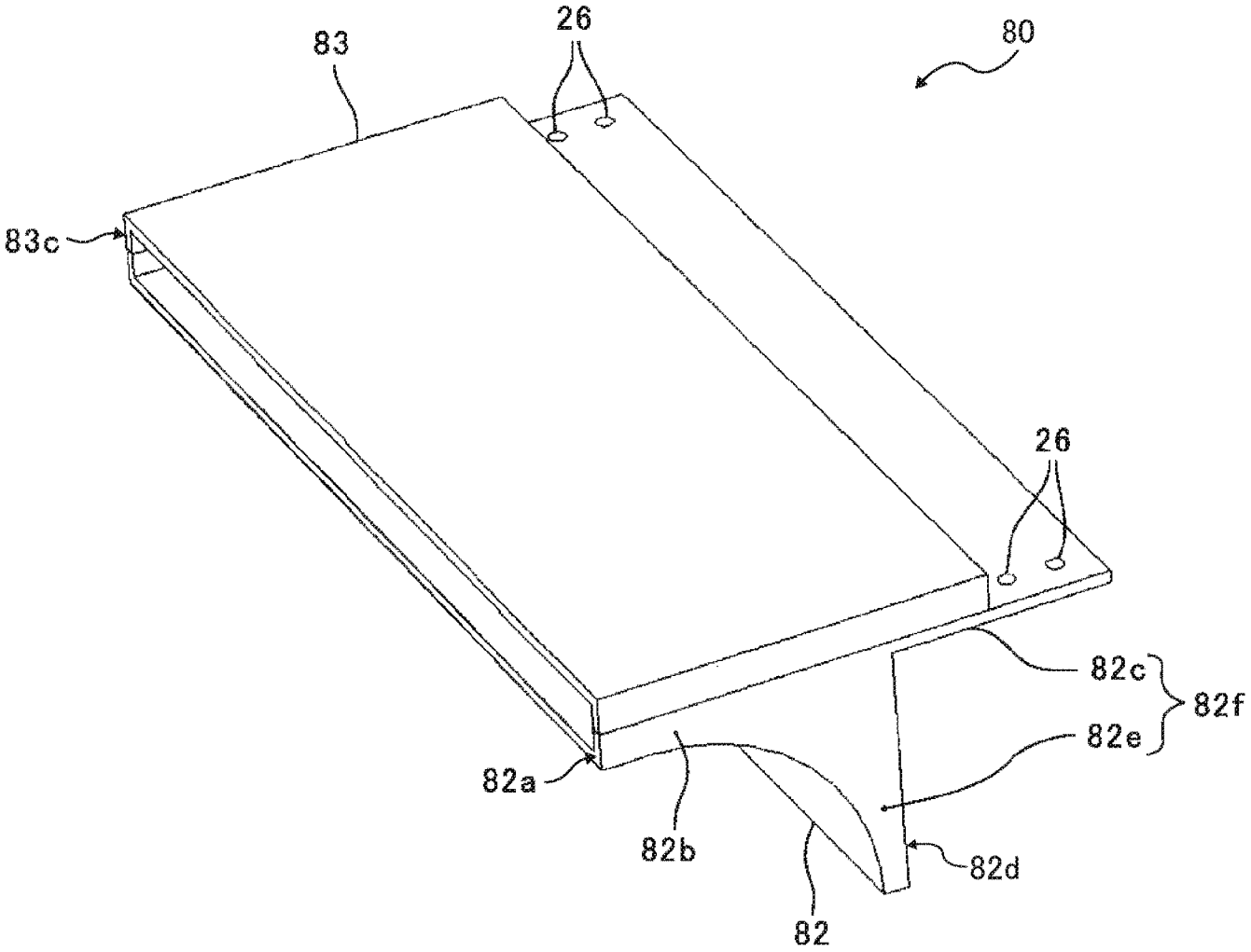
FIG. 24 is schematic perspective views of the sheet reversing section having a configuration similar to the sheet reversing section illustrated in FIGS. 19A and 19B.

FIG. 24 is schematic perspective views of the sheet reversing section 80 having a configuration similar to the sheet reversing section 80 illustrated in FIG. 19A. The view in FIG. 24 is from the direction different from the view in FIG. 19A.

The sheet reversing section 80 as illustrated in FIG. 24 is different from the sheet reversing section 80 as illustrated in FIG. 19 in that the sheet reversing section 80 in FIG. 24 has four screw holes 26 provided at projection 82*c*. The sheet reversing section 80 as illustrated in FIG. 19 has two screw holes 26.

Figure 25:
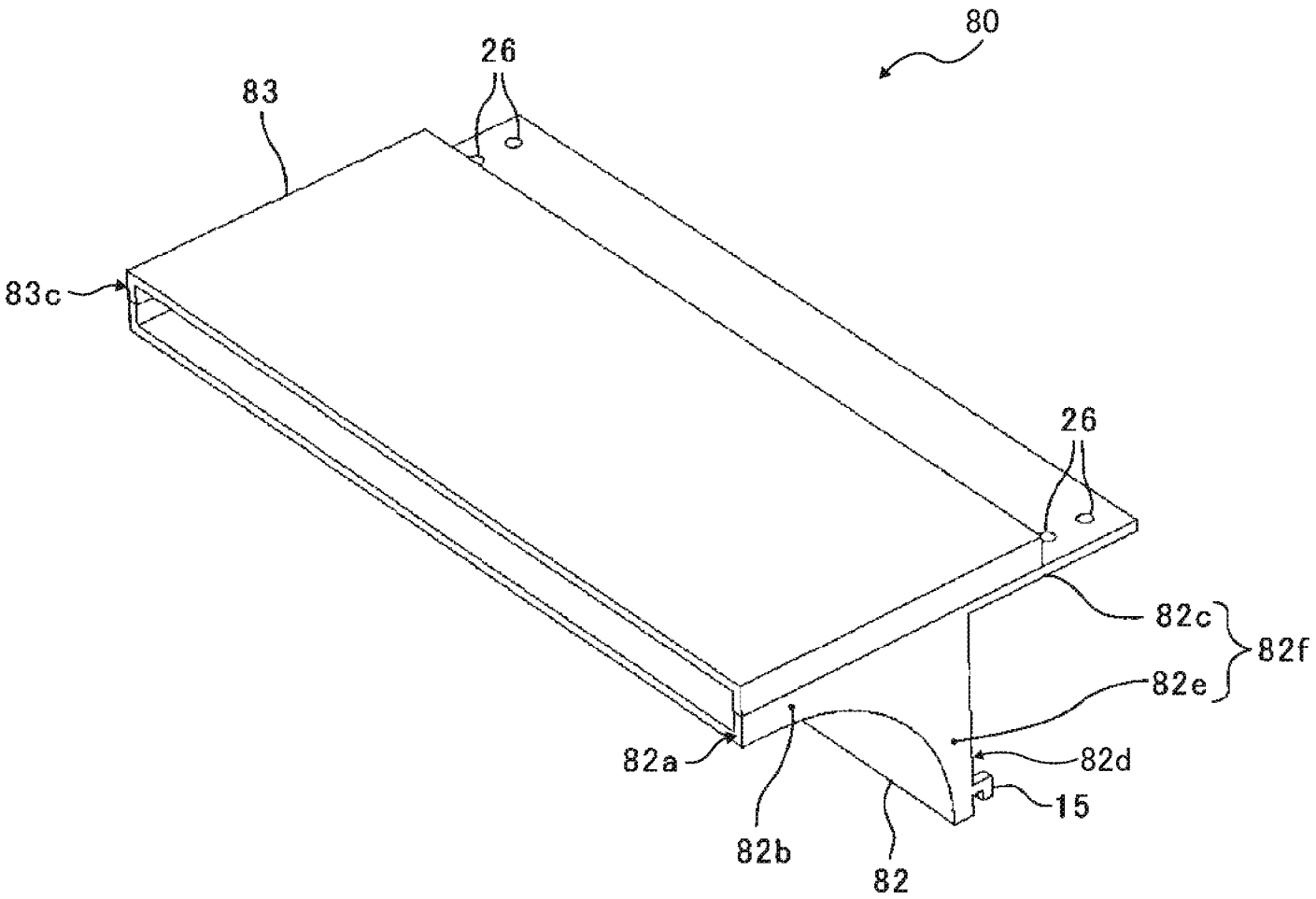
FIG. 25 is a perspective view of a variation of the sheet reversing section to which fixing portions is added to the sheet reversing section illustrated in FIG. 24.

FIG. 25 is a perspective view of a variation of the sheet reversing section 80 illustrated in FIG. 24. Compared to the configuration of the sheet reversing section 80 in FIG. 24, the sheet reversing section 80 in FIG. 25 further includes fixing portions 15 that fix the abutting face 82*d* to the ejection wall face 12.

The above described sheet reversing sections 80 in FIGS. 2 through 24 has an abutting face 82*d* that faces to and contacts with the ejection wall face 12, but these abutting face 82*d* do not have fixing portions to fix the abutting face 82*d* to the ejection wall face 12.

As illustrated in FIG. 19B, sheet guide 82*b* of the sheet reversing section 80 positions above the ejection tray 72 in the printer 100.

Therefore, the user's hand may hit a bottom face of the sheet guide 82*b* when the user takes the sheet P out of the ejection tray 72, and a load directed upward may be applied on the sheet reversing section 80. At this time, if the abutting face 82*d* is not fixed to the ejection wall face 12, the sheet reversing section 80 may move relative to the apparatus body 1 such that the lower end of the abutting face 82*d* is separated from the ejection wall face 12.

Further, apparatus body may occur when the sheet reversing section 80 moves while the sheet P is reversed inside the sheet reversing section 80. Further, paper jam may occur when the sheet reversing section 80 moves while the sheet P is reversed inside the sheet reversing section 80.

On the other hand, the sheet reversing section 80 illustrated in FIG. 25 fixes the abutting face 82*d* and the ejection wall face 12 with the fixing portions 15 Thereby, the present embodiment can prevent the separation movement of the sheet reversing section 80 from the ejection wall face 12 when the load directed upward acts on the sheet reversing section 80.

The configuration as illustrated in FIG. 25 uses hooking claws as the fixing portions 15. The hooking claws engage claw engagement portions provided on the ejection wall face 12 However, a fixing mechanism other than claws such as screws or magnets may be used as the fixing portions 15.

Figure 26:
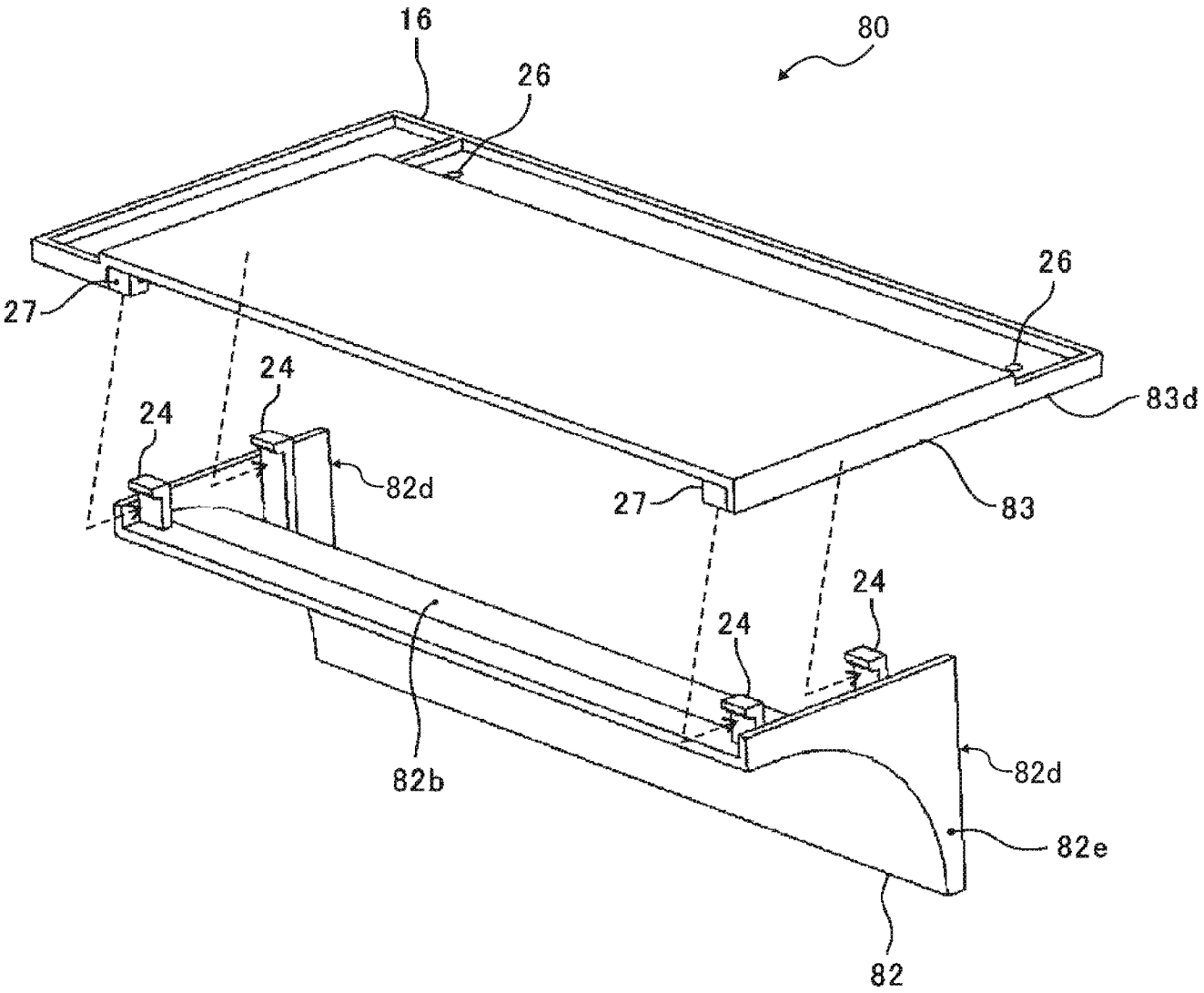
FIG. 26 is exploded perspective view of the sheet reversing section to which a rear projection is provided to the sheet reversing section of the first variation.

FIG. 26 is exploded perspective view of the sheet reversing section 80 having a configuration similar to the sheet reversing section 80 of Variation 1 illustrated in FIG. 20. The sheet reversing section 80 in FIG. 26 includes a rear projection 16 that faces the upper-face frame 21 of the apparatus body 1.

Before the sheet reversing section 80 is fixed to the apparatus body 1, the reversing tray 82 and the reversing-tray cover 83 are assembled and integrated as one body as similar to the Variation 1. Then, the fixing screws 28 are inserted through the screw holes 26 provided at the projection 83*d* of the reversing-tray cover 83 and screwed to the upper-face frame 29 of the apparatus body 1.

The rear projection 16 of the reversing-tray cover 83 overlaps the upper-face frame 21 in a state in which the rear projection 16 is mounted on the upper-face frame 21 and the sheet reversing section 80 is fixed to the apparatus body 1 with the fixing screws 28.

Figure 27:
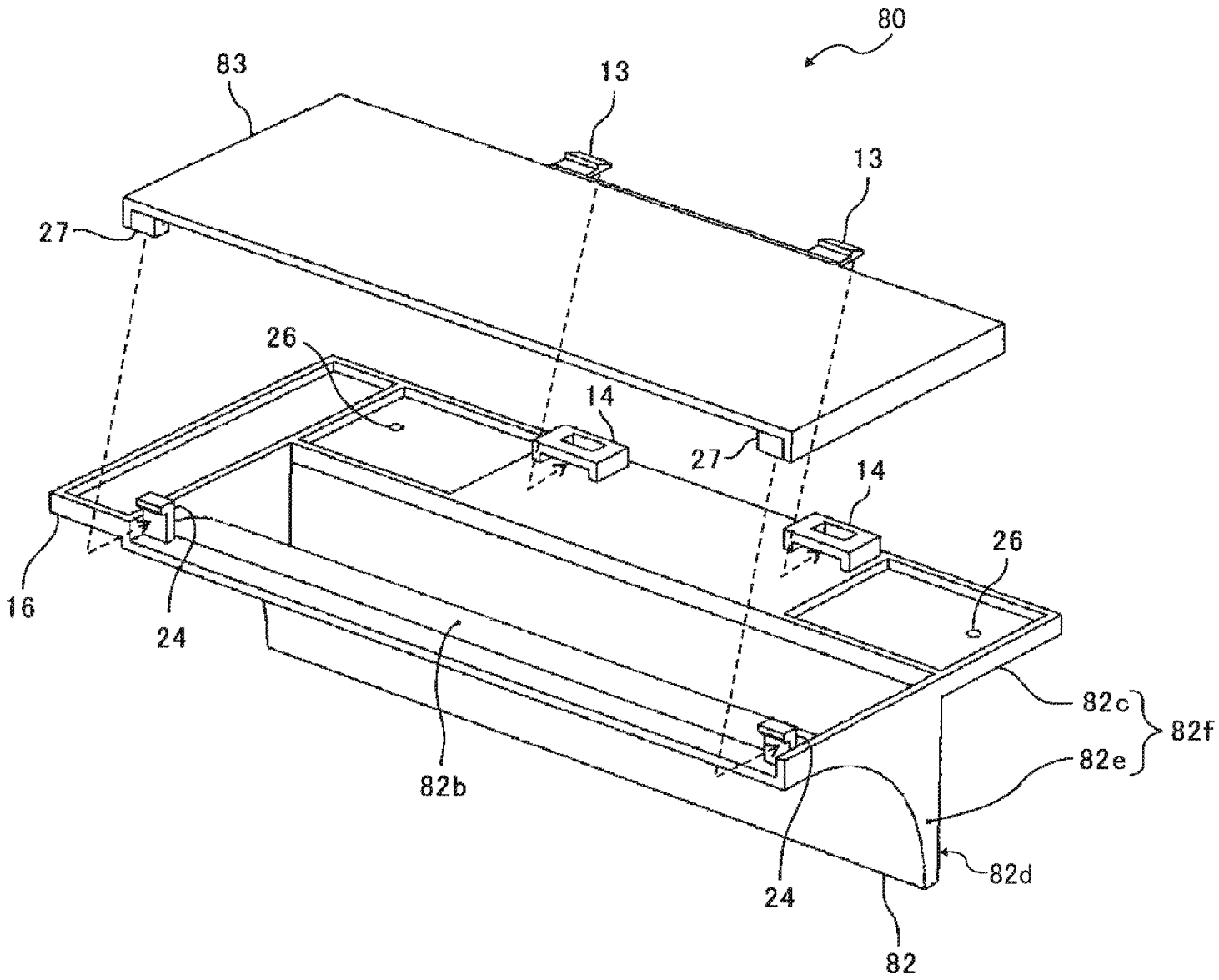
FIG. 27 is exploded perspective view of the sheet reversing section to which the rear projection is provided to the sheet reversing section of the second variation.

FIG. 27 is exploded perspective view of the sheet reversing section 80 having a configuration similar to the sheet reversing section 80 of Variation 2 illustrated in FIG. 21. The sheet reversing section 80 in FIG. 27 includes a rear projection 16 that faces the upper-face frame 21 of the apparatus body 1.

Before the sheet reversing section 80 is fixed to the apparatus body 1, the reversing tray 82 and the reversing-tray cover 83 are assembled and integrated as one body as similar to the Variation 2. Then, the sheet reversing section 80 is fixed to the apparatus body 1 by inserting the fixing screws 28 through the screw holes 26 provided at projection 82*c* of the reversing tray 82 and screwing the fixing screws 28 to the upper-face frame 29 of the apparatus body 1.

The rear projection 16 of the reversing tray 82 overlaps the upper-face frame 21 in a state in which the sheet reversing section 80 is fixed to the apparatus body 1 with the fixing screws 28.

Figure 28:
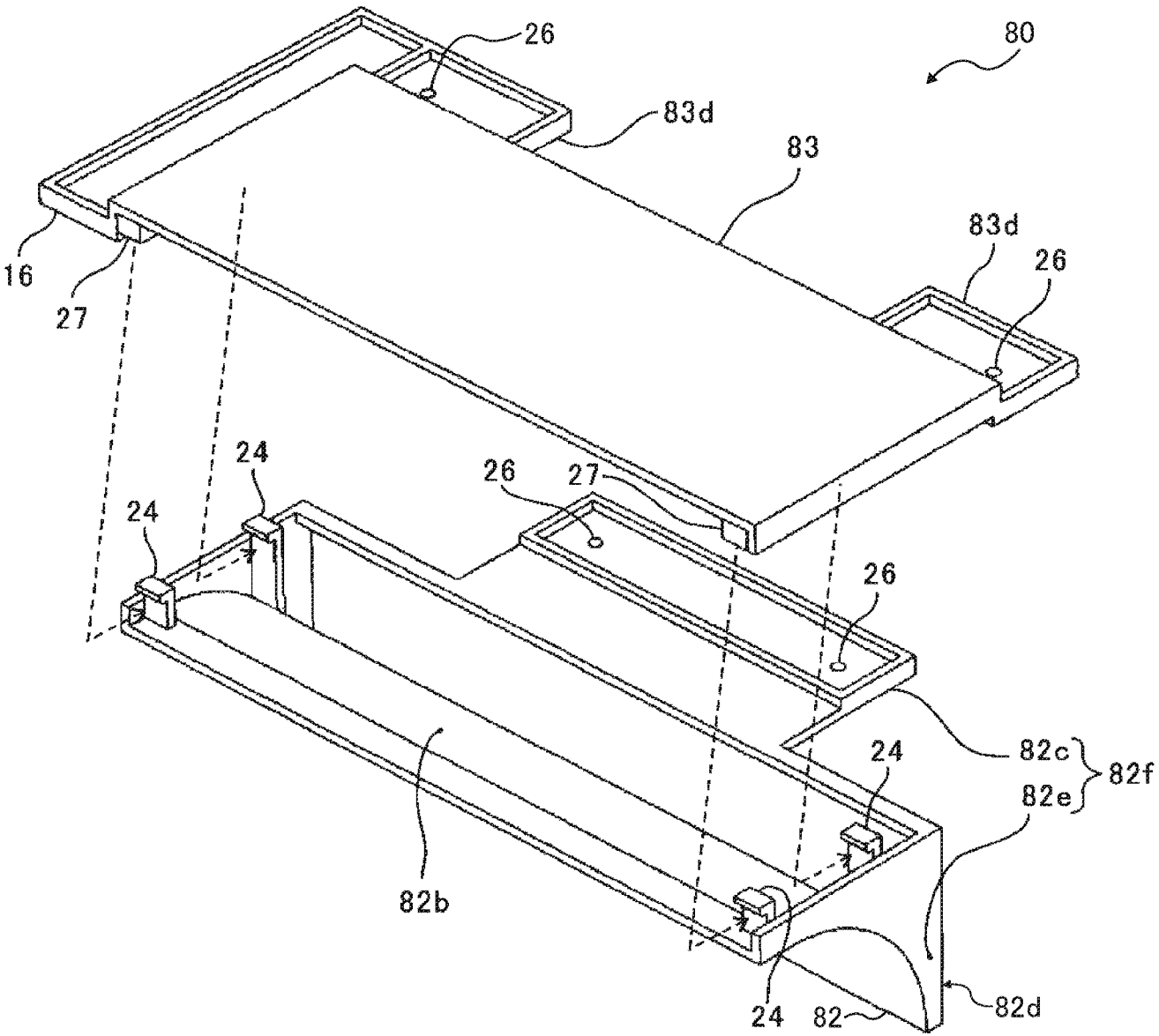
FIG. 28 is exploded perspective view of the sheet reversing section to which the rear projection is provided to the sheet reversing section of third variation.

FIG. 28 is exploded perspective view of the sheet reversing section 80 having a configuration similar to the sheet reversing section 80 of Variation 3 illustrated in FIG. 22. The sheet reversing section 80 in FIG. 28 includes a rear projection 16 that faces the upper-face frame 21 of the apparatus body 1.

Before the sheet reversing section 80 is fixed to the apparatus body 1, the reversing tray 82 and the reversing-tray cover 83 are assembled and integrated as one body as similar to the Variation 3. Then, the sheet reversing section 80 is fixed to the apparatus body 1 by inserting the fixing screws 28 through the screw holes 26 provided at projection 82*c* of the reversing tray 82 and screwing the fixing screws 28 to the upper-face frame 29 of the apparatus body 1.

Then, the fixing screws 28 is screwed through the screw holes 26 provided at the projection 83*d* of the reversing-tray cover 83 and screwed to the upper-face frame 29 of the apparatus body 1. The rear projection 16 of the sheet reversing section 80 overlaps the upper-face frame 21 in a state in which the sheet reversing section 80 is fixed to the apparatus body 1 with the fixing screws 28.

The sheet reversing section 80 as illustrated in FIGS. 26 to 28 overlaps from above the upper-face frames 21 and 29 of a frame of the apparatus body 1. Further, the sheet reversing section 80 as illustrated in FIGS. 26 to 28 includes the screw holes 26 only on the projection 83*d*. The rear projection 16 merely overlaps the upper-face frame 21. The sheet reversing section 80 as illustrated in FIGS. 26 to 28 includes a portion that overlaps from above the frame of the apparatus body 1 and is supported from below in addition to the configuration of the sheet reversing section 80 as illustrated in FIGS. 20 to 22.

The portion is provided not only on the right hand side of the apparatus body 1 but also on the rear side of the apparatus body 1 in a view from FIGS. 12 and 13. This configuration can improve the assembling strength of the sheet reversing section 80 to the apparatus body 1. The portion where the rear projection 16 overlaps the apparatus body 1 is not limited to a frame of the upper-face frame 21, but it can be anything that can support the rear projection 16 of the sheet reversing section 80 from below such as an exterior cover of the apparatus body 1.

Figure 29:
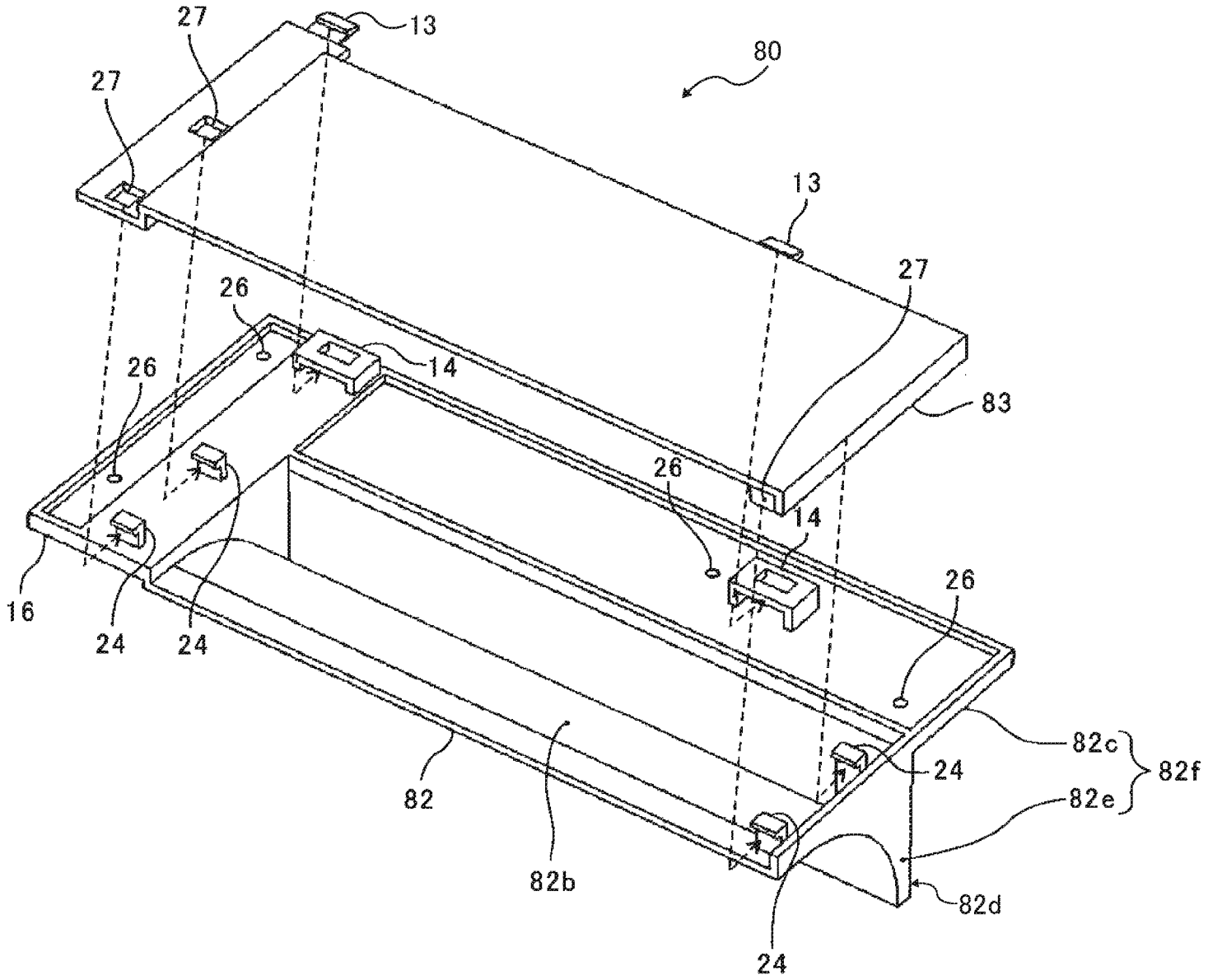
FIG. 29 is exploded perspective view of the sheet reversing section according to still another embodiment to which the rear projection is provided.

FIG. 29 is a schematic exploded perspective view of another example of the sheet reversing section 80 including the rear projection 16.

The sheet reversing section 80 illustrated in FIG. 29 includes a projection 82*c* to ensure the assembling strength. The projection 82*c* is provided on the reversing tray 82. The projection 82*c* projects in a direction opposed to the sheet guide 82*b* from the abutting face 82*d*.

The sheet reversing section 80 in FIG. 29 includes four claw engaging parts 27 of the reversing-tray cover 83 and four engagement claws 24 of the reversing tray 82 disposed at four places, respectively. Further, the sheet reversing section 80 in FIG. 29 has a snap-fit configuration to engage the reversing-tray cover 83 and the reversing tray 82. The sheet reversing section 80 in FIG. 29 includes two engagement convex parts 13 on two places of the reversing-tray cover 83 and two engagement receiving parts 14 on two places of the reversing tray 82. The two engagement convex parts 13 are snap-fitted to and engage the two engagement receiving parts 14.

The sheet reversing section 80 in FIG. 29 is fixed to the apparatus body 1 by inserting the fixing screws 28 through the screw holes 26 provided at the projection 82*c* of the reversing tray 82 and screwing the fixing screws 28 to the upper-face frame 29 of the apparatus body 1. Further, the fixing screws 28 is inserted through the screw holes 26 provided at the rear projection 16 of the reversing tray 82 and screwed to the upper-face frame 21 of the apparatus body 1.

As indicated by a broken arrow in FIG. 29, the reversing-tray cover 83 and the reversing tray 82 are integrally fixed with each other by engaging the claw engaging parts 27 of the reversing-tray cover 83 with the engagement claws 24 of the reversing tray 82 and engaging the engagement convex parts 13 of the reversing-tray cover 83 with the engagement receiving parts 14 of the reversing tray 82.

Thereby, the present embodiment integrates the reversing tray 82 and the reversing-tray cover 83 and fixes the sheet reversing section 80 to the apparatus body 1.

The sheet reversing section 80 as illustrated in FIG. 29 includes a portion to be fixed to the frame of the apparatus body 1. The portion is provided not only on the right hand side of the apparatus body 1 but also on the rear side of the apparatus body 1 in a view from FIGS. 12 and 13. The sheet reversing section 80 in FIG. 29 further includes four or more of the claw engaging parts 27 and the engagement claws 24 to integrate the reversing tray 82 and the reversing-tray cover 83.

Further, the sheet reversing section 80 in FIG. 29 includes two or more screw holes 26 to fix the sheet reversing section 80 to the frame of the apparatus body 1. The above-described configuration increases the strength of the sheet reversing section 80 and improves the assembling strength of the sheet reversing section 80 to the apparatus body 1.

Figure 30:
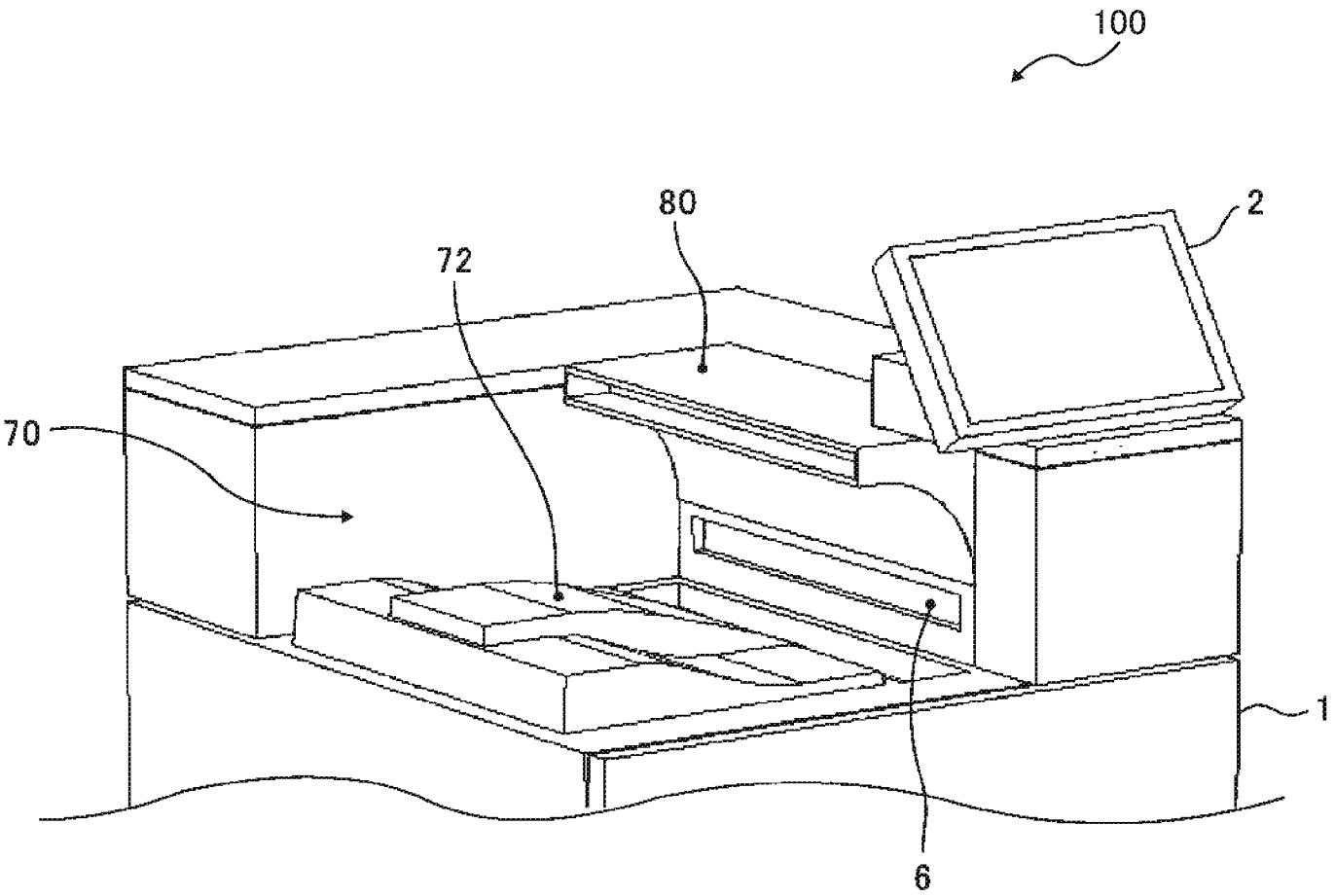
FIG. 30 is an external perspective view of an upper part of the printer including the sheet reversing section integrally formed with the printer.

FIG. 30 is an external perspective view of an upper part of the printer 100 including the sheet reversing section 80 as similar to the above described embodiments of the printer 100. That is, the present embodiment has a configuration in which the reversing tray 82 and the reversing-tray cover 83 are made of one part instead of a plurality of parts as described above. For example, the reversing tray 82 and the reversing-tray cover 83 may be integrally molded.

The sheet reversing section 80 of printer 100 in FIG. 30 has a similar function with the above described reversing tray 82. Thus, the sheet reversing section 80 in FIG. 30 can prevent the reversing tray 82 to be fallen off from the apparatus body 1 by the application of the load on an upper face of the sheet reversing section 80.

Figure 31:
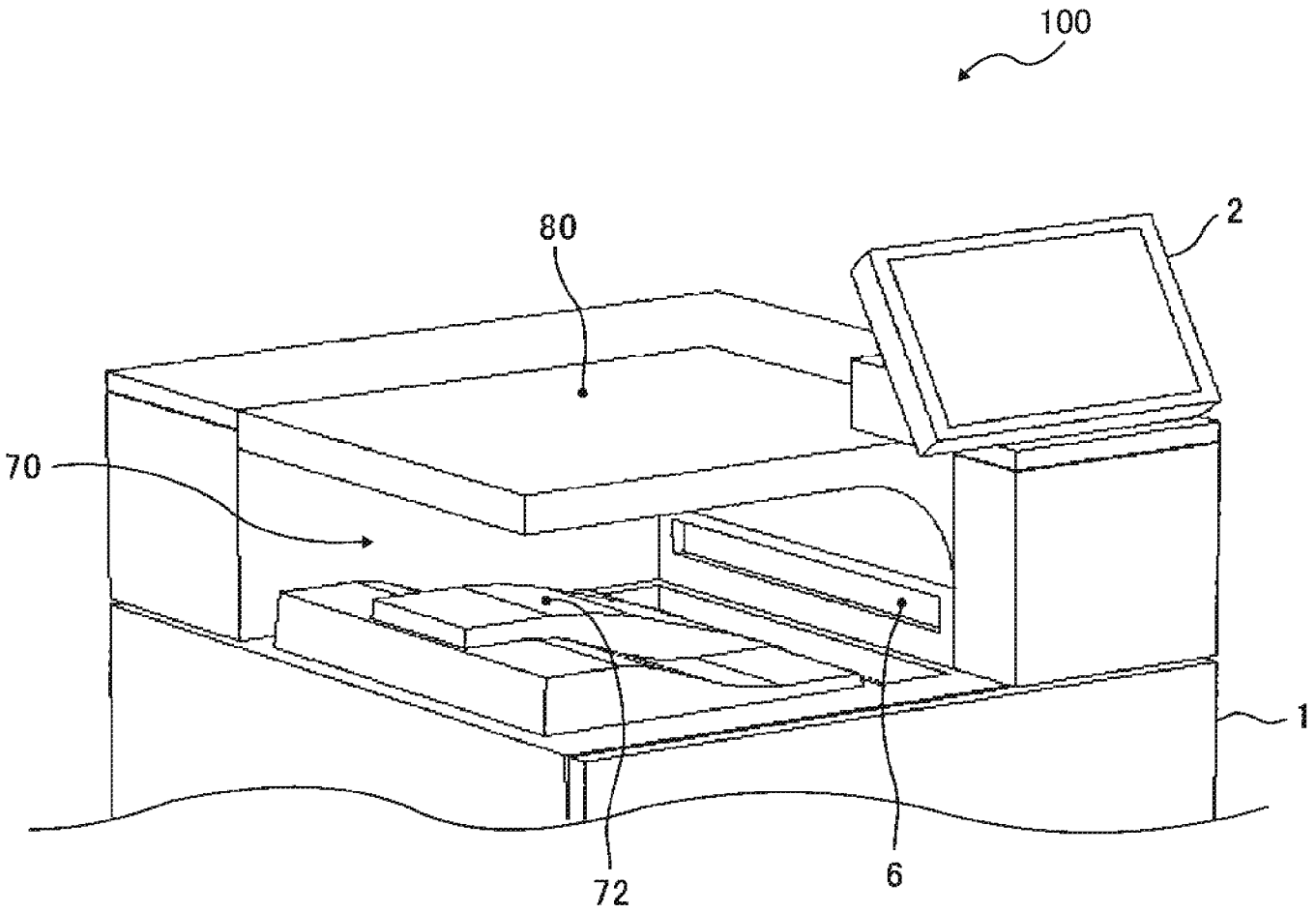
FIG. 31 is an external perspective view of an upper part of the printer.

FIG. 31 is an external perspective view of an upper part of the printer 100. The printer 100 in FIG. 31 has a shape that the sheet reversing section 80 of the above described printer 100 and the extensional-reversing section 18 illustrated in FIGS. 4 to 12 are integrally formed into one body.

That is, the sheet reversing section 80 and the extensional-reversing section 18 is integrally formed by one member instead of constituted by a plurality of members of the reversing tray 82, the reversing-tray cover 83, the extension tray 84, and the extension-tray cover 85.

The sheet reversing section 80 of the printer in FIG. 31 has a function similar to the reversing tray 82 in the above described embodiment. Thus, the sheet reversing section 80 can prevent to the reversing tray 82 to be fallen off from the apparatus body 1 by the application of the load on the upper face of the sheet reversing section 80.

Figure 32:
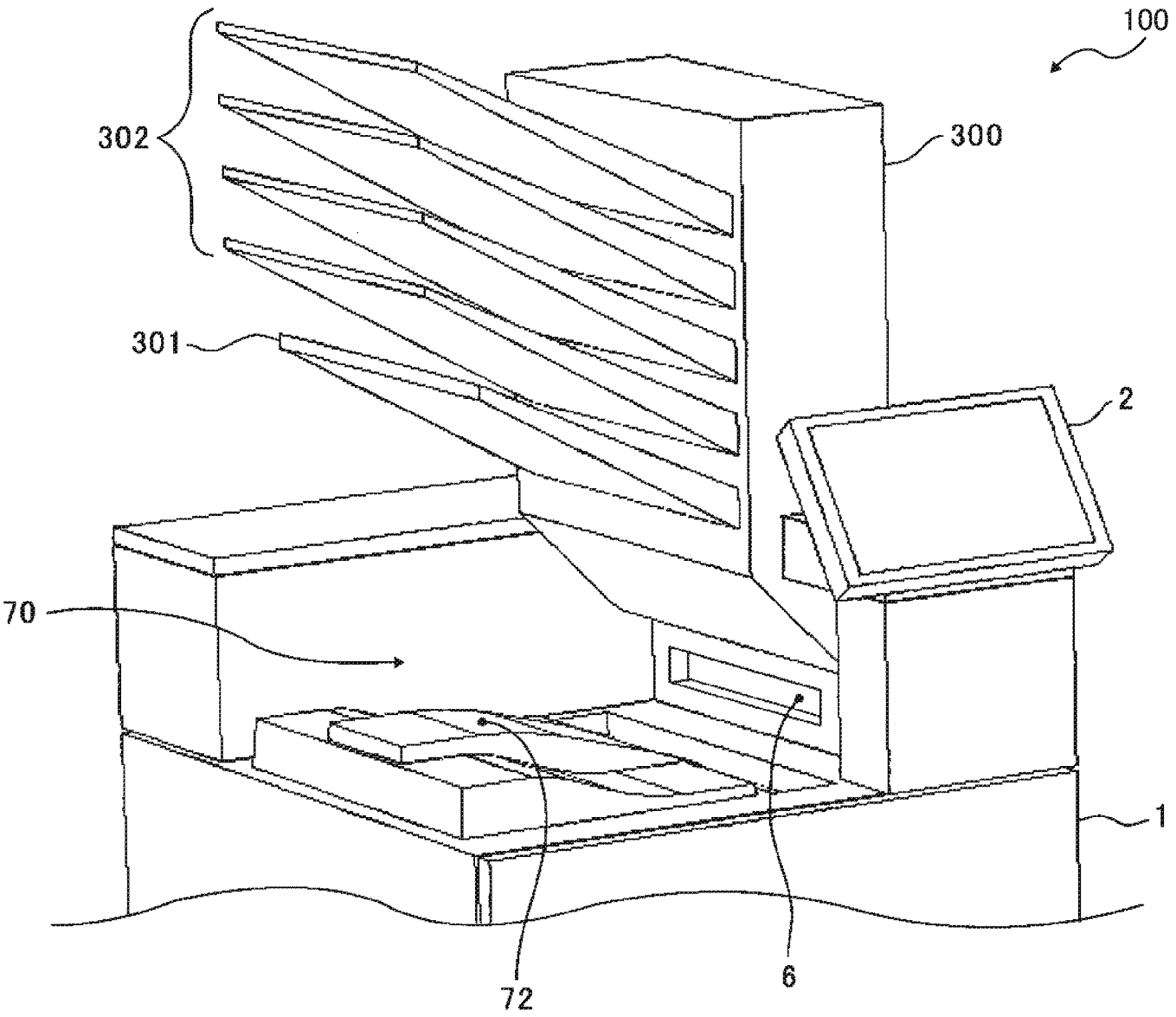
FIG. 32 is an external perspective view of an upper part of the printer to which an external device is mounted.

FIG. 32 is an external perspective view of an upper part of the printer 100 to which an external device 300 is mounted instead of the sheet reversing section 80. The external device 300 includes a support tray 301 and multiple ejection trays 302.

As described above, the fixing screws 28 fix the sheet reversing section 80 to the apparatus body by fixing the sheet reversing section 80 on the upper face of the frame of the apparatus body 1. The sheet reversing section 80 can easily be removed from the apparatus body 1 by removing the top cover 23 and exposing the fixing screws 28. Thus, the printer 100 in FIG. 32 makes easier to replace the sheet reversing section 80 with other units such as external device 300.

Figure 33A:
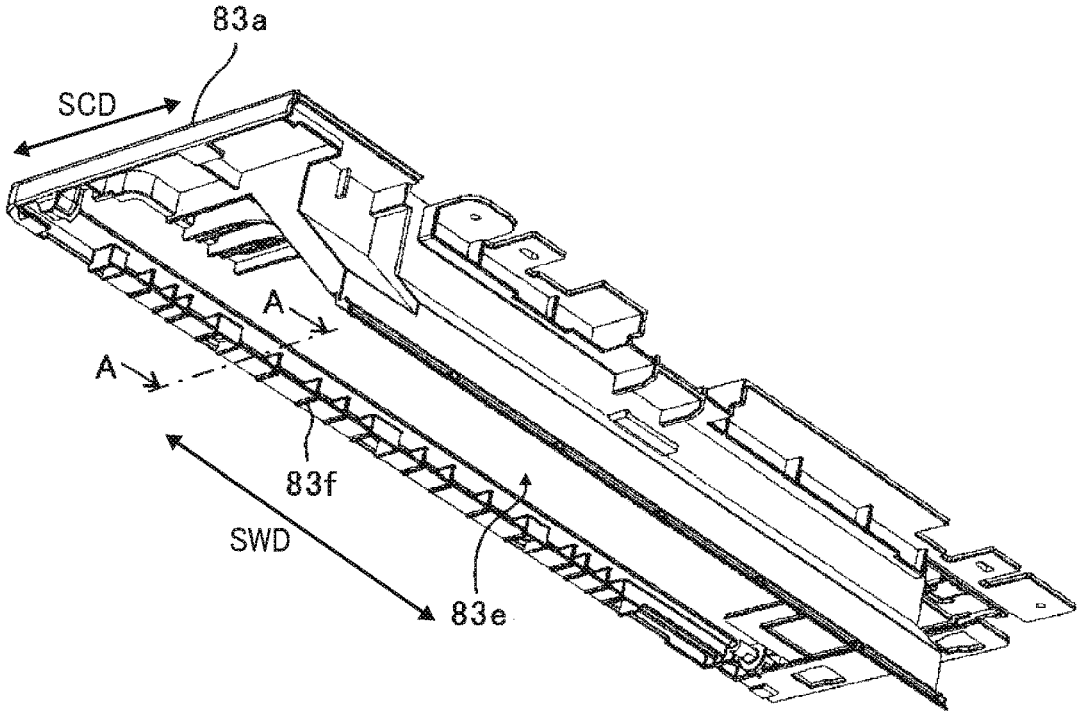
FIGS. 33A and 33B are perspective view of a cover fixing portion of the reversing-tray cover according to the present embodiment.
Figure 33B:
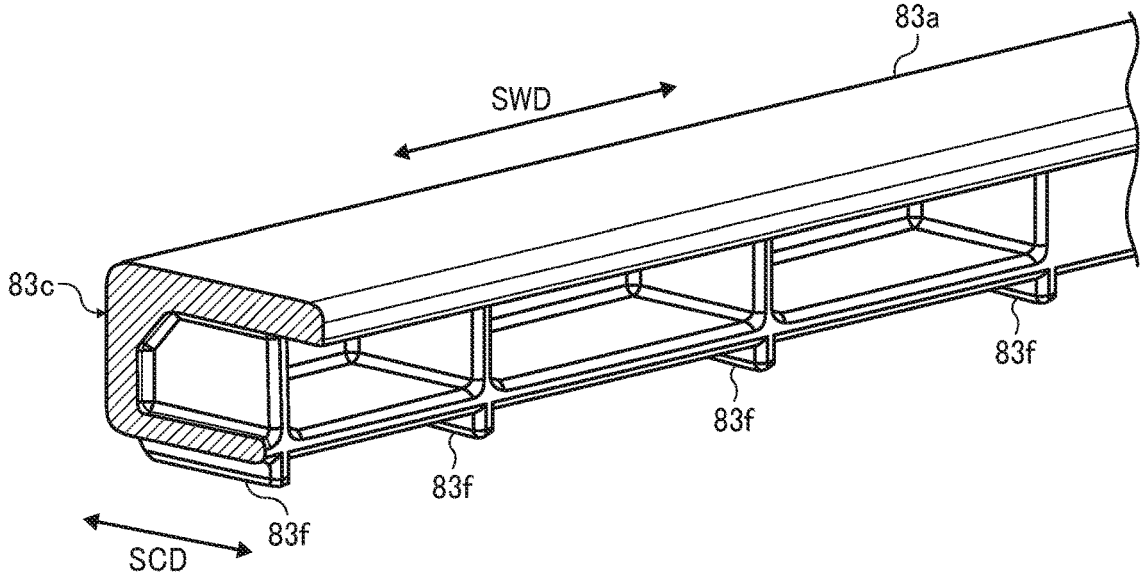

FIGS. 33A and 33B are perspective view illustrating the cover fixing portion 83*a* of the reversing-tray cover 83 of the sheet reversing section 80 according to the present embodiment.

FIG. 33A is a perspective view of the cover fixing portion 83*a* seen from an obliquely downward position. FIG. 33B is a cross-sectional perspective view of a vicinity of leading end of the cover fixing portion 83*a* in a cross section A-A in FIG. 33A.

As illustrated in FIG. 33B, a leading end of the cover fixing portion 83*a* has a shape in which a leading end of an upper face of the cover fixing portion 83*a* is folded down. The folded leading end of the cover fixing portion 83*a* forms the end face 83*c*. With this folded shape, the present embodiment can increase stiffness of the cover fixing portion 83*a*.

Further, as illustrated in FIG. 33B, the cover fixing portion 83*a* of the reversing-tray cover 83 includes a plurality of vertical ribs 83*f* in the sheet width direction SWD. The vertical ribs 83*f* extends along the sheet conveyance direction SCD of sheet P inside the reverse passage. Thus, the vertical ribs 83*f* can ensure the stiffness of the leading end of the cover fixing portion 83*a*.

Further, reinforcing the cover fixing portion 83*a* with the vertical ribs 83*f* can prevent bending of the reversing-tray cover 83 when the load acts on the upper face of the reversing-tray cover 83. Thereby, the vertical ribs 83*f* can prevent the paper jam inside the reverse passage occurred by bending of the reversing-tray cover 83.

Thus, the reversing-tray cover 83 (cover) includes vertical ribs 83*f* (a rib) disposed on a bottom face of vicinity of a leading end of the reversing-tray cover 83 (cover).

The vertical ribs 83*f* are formed on the cover fixing portion 83*a* by resin molding. However, the vertical ribs 83*f* may be provided to the cover fixing portion 83*a* as a separate resin part. The vertical ribs 83*f* may be formed by metal plate.

As illustrated in FIG. 33*a*, a central part of the cover fixing portion 83*a* has an opening 83*e*. This opening 83*e* is provided for mounting the openably closable cover 83*b*.

Further, as illustrated in FIG. 23A, the cover fixing portion 83*a* of the reversing-tray cover 83 has a shape in which a length (thickness) in height direction in leading end is smaller than that of trail end. In other words, the length (thickness) in height direction gradually increases from leading end toward trail end of the cover fixing portion 83*a*.

This shape of the reversing-tray cover 83 can increase the stiffness of the reversing-tray cover 83. Thus, this shape can restrain the deformation of the reversing-tray cover 83 when the load acts on an upper face of the reversing-tray cover 83. Thereby, this shape can prevent the paper jam occurred inside the reverse passage by deformation of the reversing-tray cover 83.

Further, bearing the load applied on the reversing-tray cover 83 with the reversing-tray cover 83 can reduce the load applied on the reversing tray 82. Thereby, the reversing-tray cover 83 of the present embodiment can prevent the reversing tray 82 from falling off from the apparatus body 1 and deformation of the reversing tray 82.

Figure 34A:
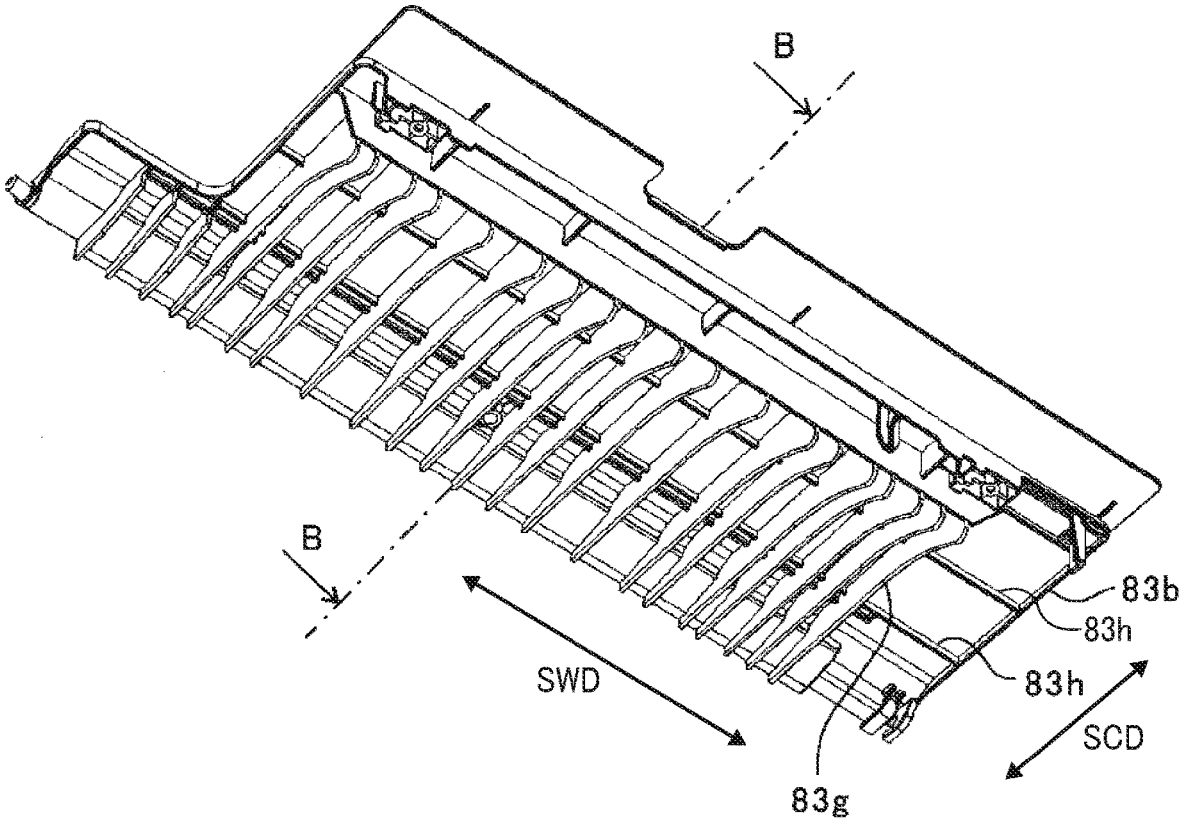
FIGS. 34A and 34B are perspective view of the openably closable cover according to the present embodiment.
Figure 34B:
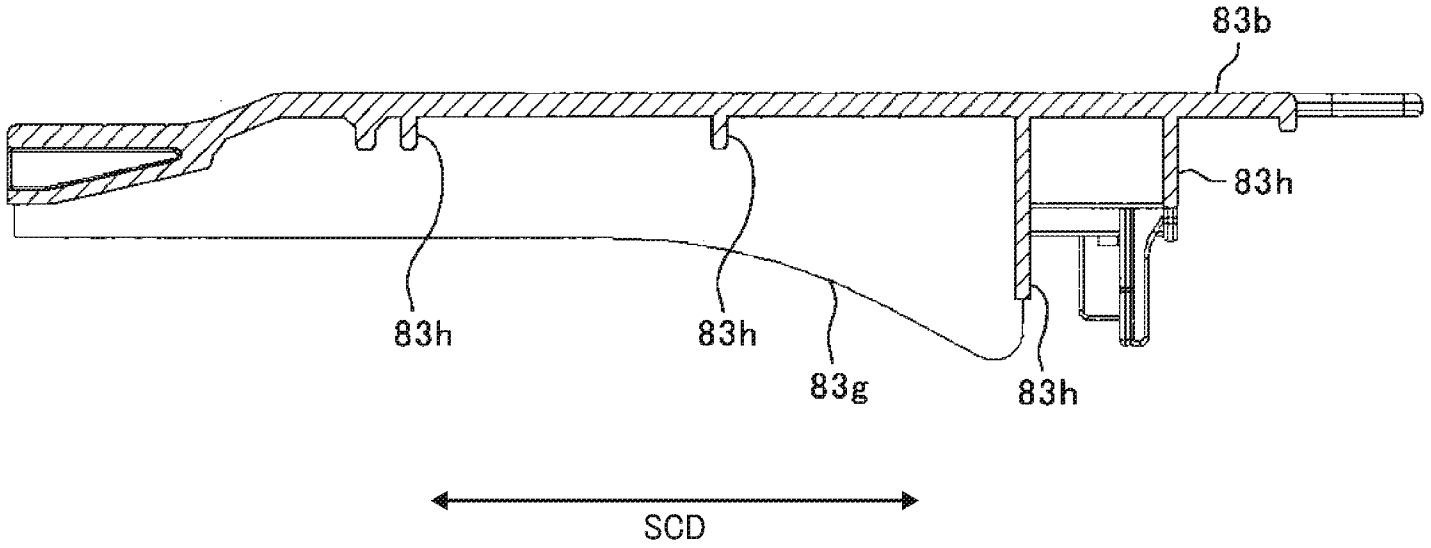

FIGS. 34A and 34B illustrate the openably closable cover 83*b* of the reversing-tray cover 83 of the sheet reversing section 80 according to the present embodiment. FIG. 34A is a perspective view of the openably closable cover 83*b* seen from an obliquely downward position. FIG. 34B is a cross-sectional view of the openably closable cover 83*b* in a cross section B-B in FIG. 34A. The sheet conveyance direction SCD illustrated in FIG. 34B indicates the sheet conveyance direction SCD of the sheet P when the sheet reversing section 80 that has the openably closable cover 83*b* of the reversing-tray cover 83 is attached to the apparatus body 1.

As illustrated in FIGS. 34A and 34B, an openably closable cover 83*b* of the reversing-tray cover 83 includes a plurality of sheet-passage ribs 83*g* in the sheet width direction SWD. The sheet-passage ribs 83*g* extends along the sheet conveyance direction SCD of sheet P inside the reverse passage. Further, as illustrated in FIG. 34B, the cover fixing portion 83*a* of the reversing-tray cover 83 includes a plurality of crossing ribs 83*h* in the sheet conveyance direction SCD. The crossing ribs 83*h* extend along the sheet width direction SWD perpendicular to the sheet conveyance direction SCD of the sheet P. Thus, these sheet-passage ribs 83*g* and the crossing ribs 83*h* can ensure the stiffness of the openably closable cover 83*b*.

As illustrated in FIGS. 34A and 34B, the strength of the openably closable cover 83*b* is increased by the sheet-passage ribs 83*g* project downward from the crossing ribs 83*h*. Further, the sheet P is not likely to be hooked by the sheet-passage ribs 83*g*.

An upper face of the openably closable cover 83*b* illustrated in FIGS. 34A and 34B is planer. However, the strength of the openably closable cover 83*b* can be increased by making a central part of the openably closable cover 83*b* to have shell structure. For example, the central part the openably closable cover 83*b* may become the top most part of the openably closable cover 83*b*.

Figure 35:
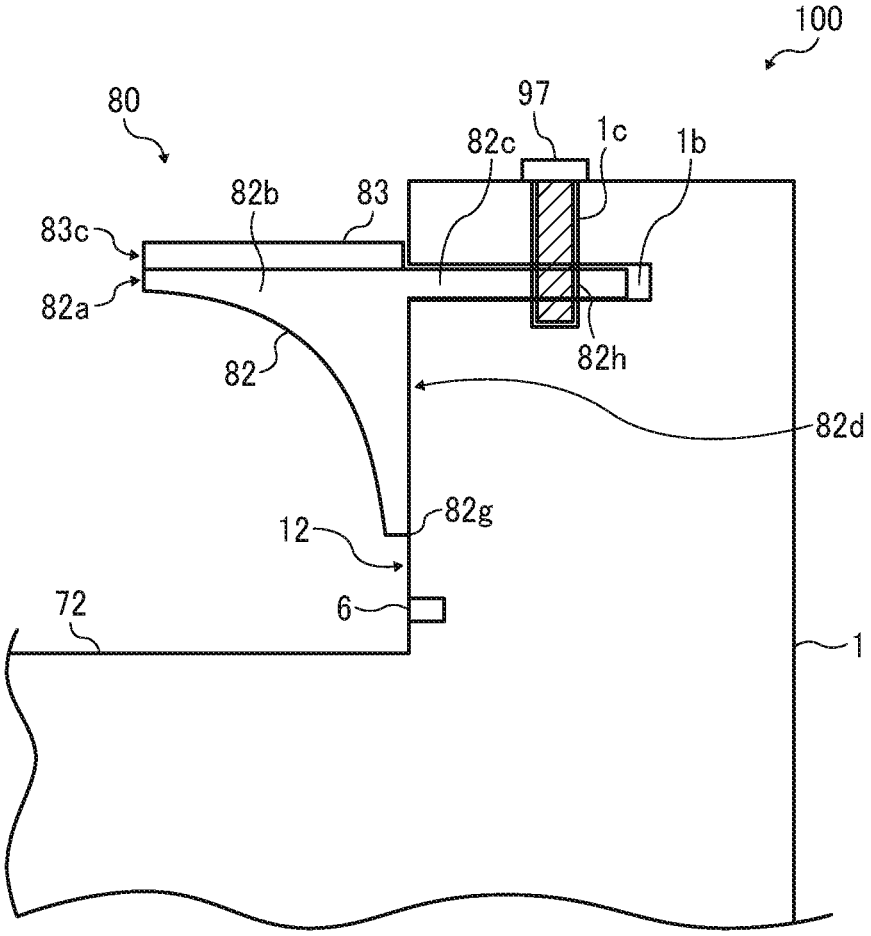
FIG. 35 is a cross-sectional view of a right upper part of the printer according to the present embodiment.

FIG. 35 is a cross-sectional view of a right upper part of the printer 100 according to the present embodiment. The printer 100 in FIG. 35 includes variations of fixing portions to fix the projection 82*c* to the apparatus body 1.

The printer 100 illustrated in FIG. 25 includes an insertion slot 1*b* to which projection 82*c* is inserted. The insertion slot 1*b* is formed on the ejection wall face 12 of the apparatus body 1. The insertion slot 1*b* can prevent the displacement of the reversing tray 82 relative to the apparatus body 1 when the load acts on the sheet guide 82*b*.

As illustrated in FIG. 35, a movement of the projection 82*c* in a vertical direction can be restricted by insertion of the projection 82*c* into the insertion slot 1*b*. As similar to the above described embodiments, the moment acts on the reversing tray 82 when the load acts on the sheet guide 82*b* and the abutting face 82*d* abuts on the ejection wall face 12. This moment is applied to move an upper end of the abutting face 82*d* leftward around the lower end 82*g* of the abutting face 82*d* as a center in FIG. 35.

With this moment, a force acts on the leading end of the projection 82*c* to rotate the leading end of the projection 82*c* (right end of the projection 82*c* in FIG. 35) around the lower end 82*g* of the abutting face 82*d* as a center in a counter clockwise direction. This force forces the leading end of the projection 82*c* tries to move upward. However, the insertion slot 1*b* restricts the movement of the projection 82*c* in a vertical direction. Further, the insertion slot 1*b* prevents the above described moment to move the sheet reversing section 80.

With this configuration of the insertion slot 1*b*, the printer 100 illustrated in FIG. 35 restrains the displacement of the reversing tray 82 relative to the apparatus body 1 during the application of the load on the sheet guide 82*b*. Further, the printer 100 ensures the assembling strength of the reversing tray 82 to the apparatus body 1. Thus, the above-described configuration can prevent the reversing tray 82 to be fallen off from the apparatus body 1 due to the application of the load on the sheet guide 82*b*.

Further, there is a configuration that squeezes the projection 82*c* into the insertion slot 1*b*. The configuration to prevent the movement of projection 82*c* is not limited as described above. The configuration may be such as a snap-fit or a screw 97 that can prevent the sheet reversing section 80 to laterally move relative to the apparatus body 1 in FIG. 35. The projection 82*c* includes a hole 82*h*, and the apparatus body 1 includes a hole 1*c* on an upper face of the apparatus body 1. By inserting and screwing the screw 97 through the hole 82*h* of the projection 82*c* and the hole 1*c* of the apparatus body 1, the projection 82*c* is fixed to the apparatus body 1.

Figure 36A:
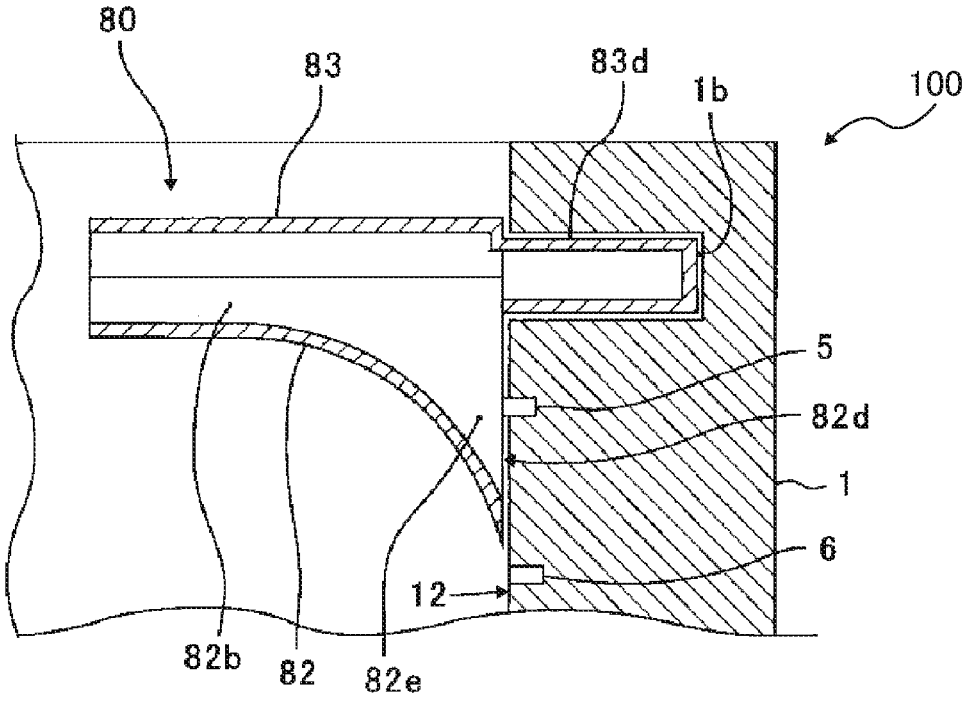
FIGS. 36A and 36B illustrate another embodiment of the printer including a similar configuration with FIG. 35.
Figure 36B:
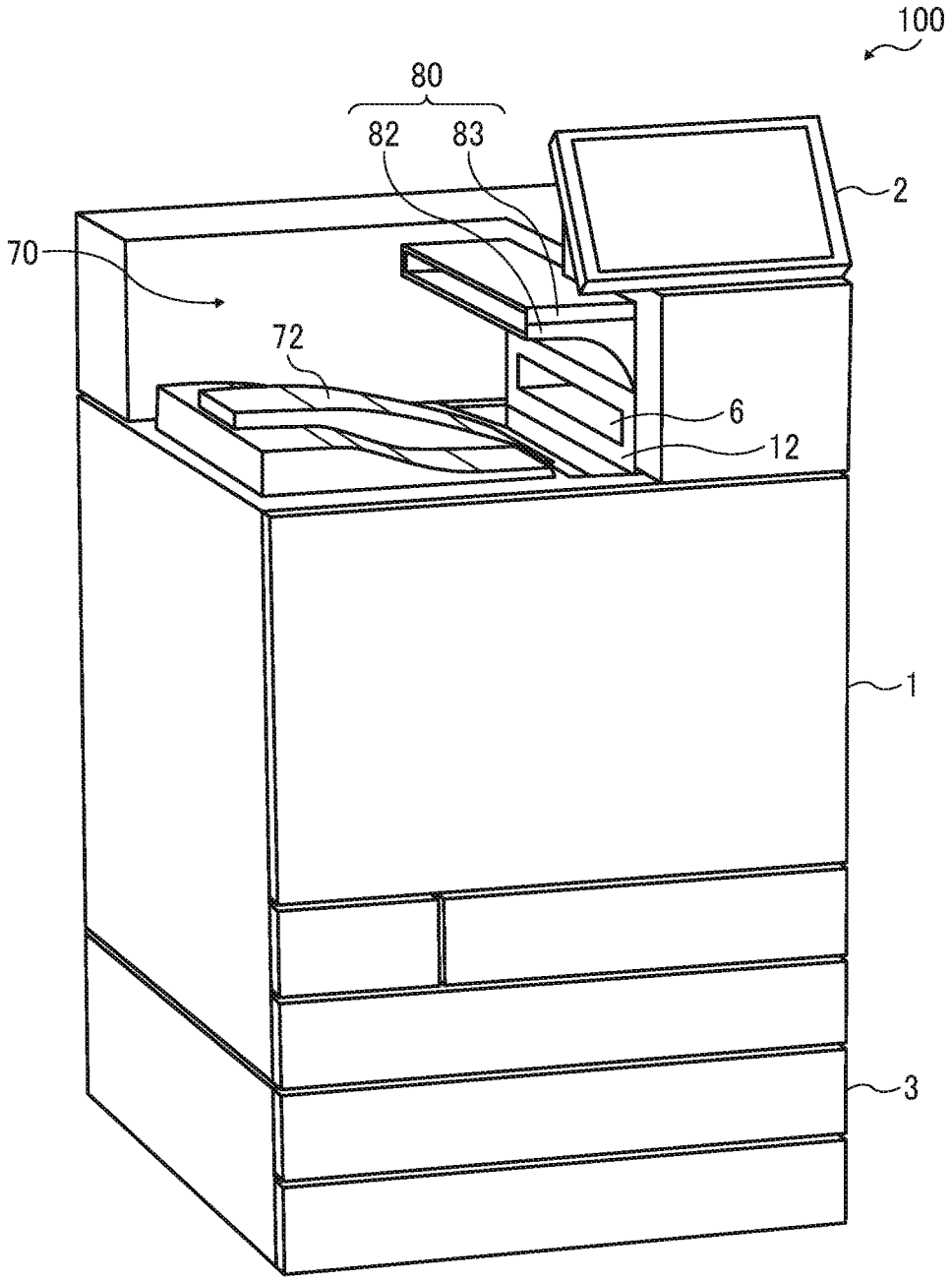

FIGS. 36A and 36B illustrate another embodiment of the printer 100. The embodiment illustrated in FIGS. 36A and 36B has a fixing device similar to the variation described in FIG. 35. FIG. 36A is a schematic cross-sectional view of a right upper part of the printer 100. FIG. 36B is an external perspective view of the printer 100.

The printer 100 as illustrated in FIG. 36A includes a projection 83*d* on the reversing-tray cover 83. The projection 83*d* acts as a projection of the sheet reversing section 80 to be inserted into the insertion slot 1*b* of the apparatus body 1. The projection 83*d* in FIG. 36A is different from the projection 82*c* in FIG. 35. Contrary to the projection 82*c* in FIG. 35 provided on the reversing tray 82, the projection 83*d* in FIG. 36A is provided on the reversing-tray cover 83.

As illustrated in FIG. 36A, a movement of the projection 83*d* in a vertical direction can be restricted by insertion of the projection 83*d* into the insertion slot 1*b*. The moment acts on the reversing tray 82 when the load acts on the sheet guide 82*b* via the reversing-tray cover 83 and the abutting face 82*d* abuts on the ejection wall face 12. This moment is applied to move an upper end of the abutting face 82*d* leftward around the bottom end of the abutting face 82*d* as a center in FIG. 36A.

The printer 100 as illustrated in FIG. 36A can prevent the above described moment to move the sheet reversing section 80 as similar to the printer 100 as illustrated in FIG. 35 by inserting the projection 83*d* into the insertion slot 1*b*. Thus, the above-described configuration can prevent the reversing tray 82 to be fallen off from the apparatus body 1 due to the application of the load on the sheet guide 82*b*.

Further, as a configuration to prevent the projection 82*c* to laterally move inside the insertion slot 1*b* in FIG. 36A, the fixing portions 15 as illustrated in FIG. 25 may be provided on the reversing tray 82.

FIGS. 37 to 44 illustrate a plurality of variations of the printers 100. These printers 100 have a configuration to prevent the reversing tray 82 to fall off from the apparatus body 1.

Figure 37:
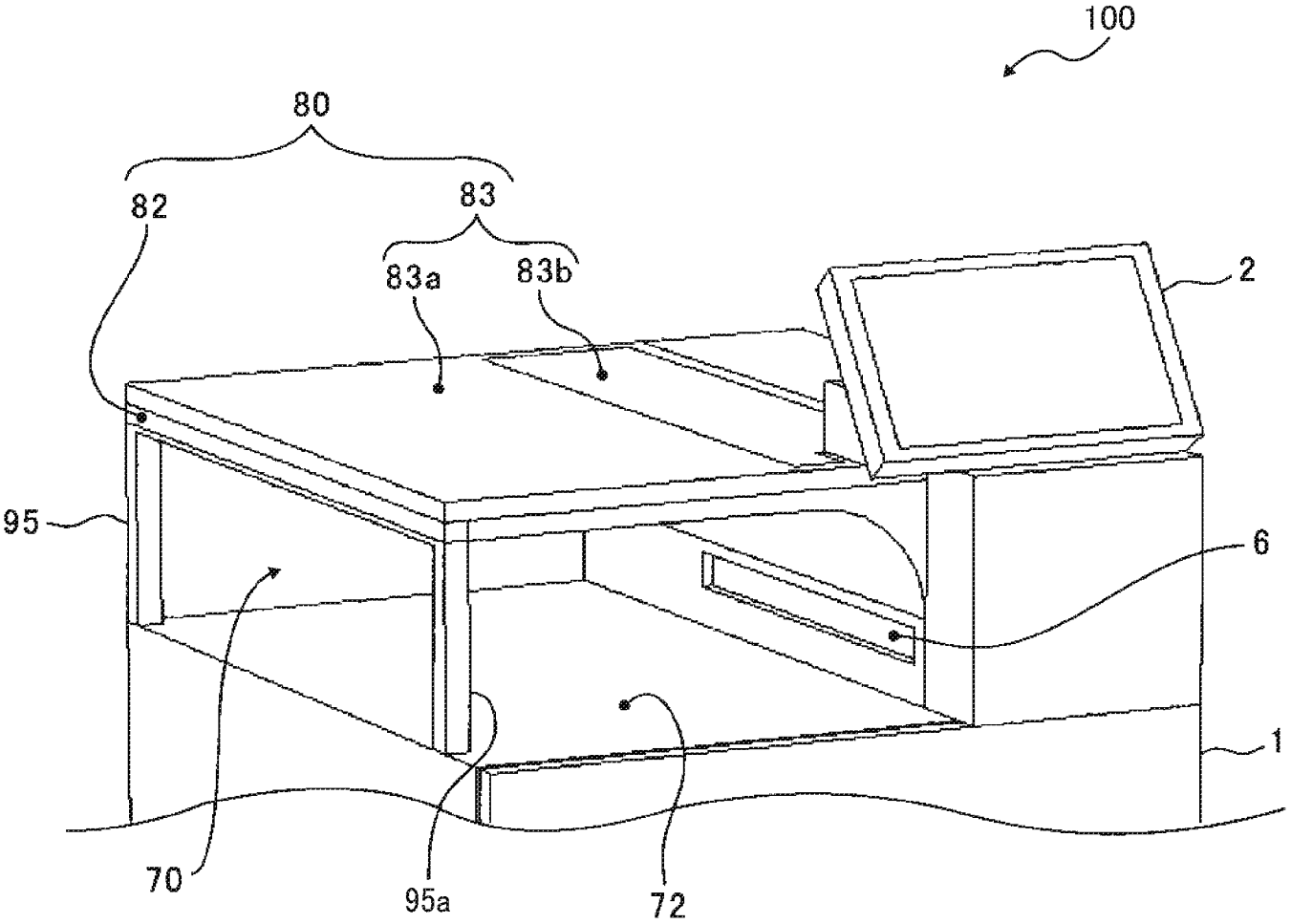
FIG. 37 is a schematic perspective view of an upper part of the printer including pillar-like supports.

FIG. 37 is a schematic perspective view of an upper part of the printer 100. The printer 100 in FIG. 37 includes pillar-like supports 95*a* that support and fix the sheet reversing section 80. The pillar-like supports 95*a* are provided on two corners on a left ends of the apparatus body 1 as illustrated in FIG. 37. The printer 100 in FIG. 37 has openings that open to three directions of front, rear, and left in the sheet ejection section 70. The sheet ejection section 70 forms an in-body sheet ejection part. Thus, the user can take out the sheet P discharged to the sheet ejection section 70 from three directions of front, rear, and left in the printer 100 as illustrated in FIG. 37.

Figure 38:
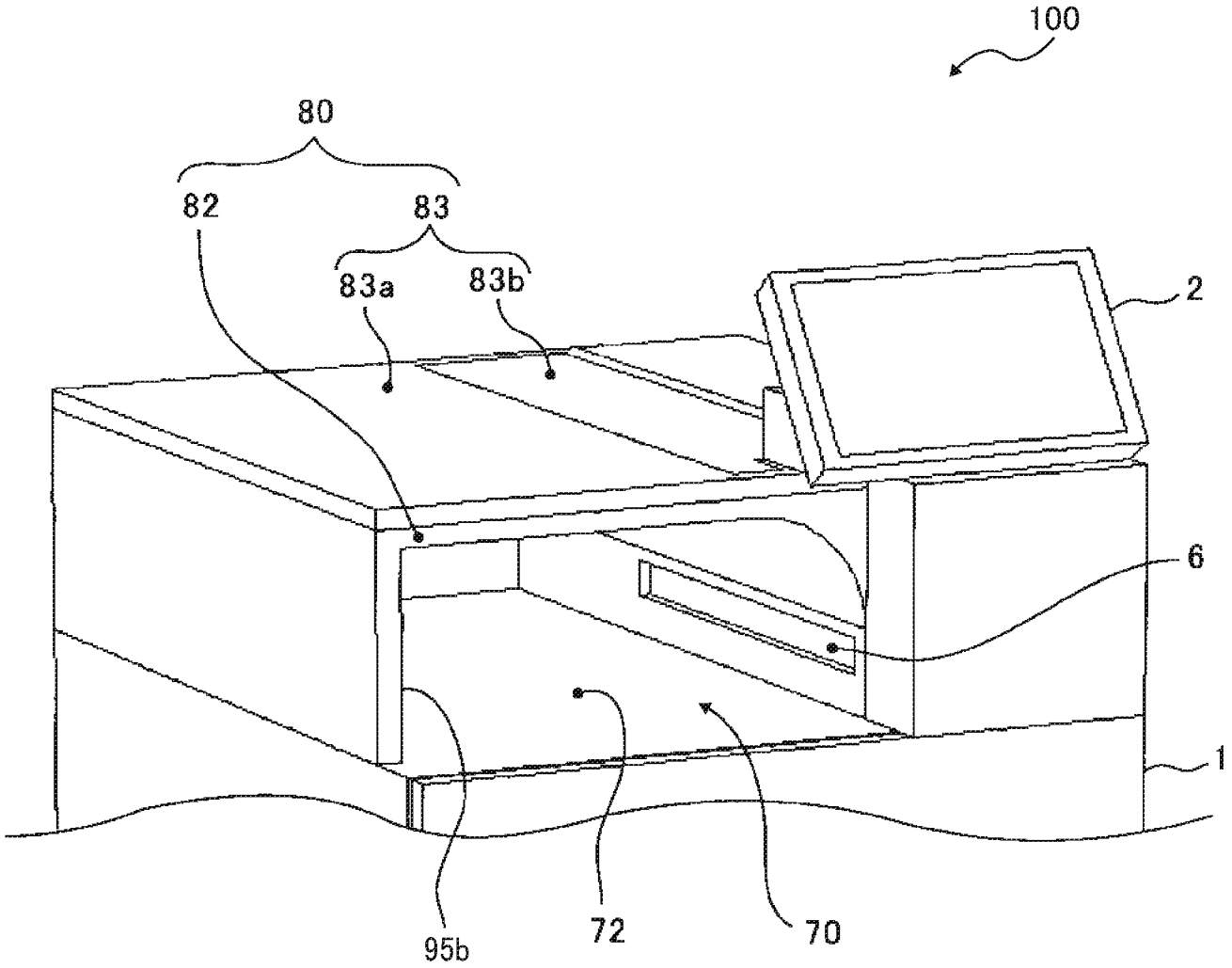
FIG. 38 is a schematic perspective view of an upper part of the printer including wall-like supports.

FIG. 38 is a schematic perspective view of an upper part of the printer 100. The printer 100 in FIG. 38 includes a wall-like support 95*b* that support and fix the sheet reversing section 80. The wall-like support 95*b* is provided on left end of the apparatus body 1 as illustrated in FIG. 38. The printer 100 in FIG. 38 has openings that open to two directions of front and rear in the sheet ejection section 70. The sheet ejection section 70 forms an in-body sheet ejection part. Thus, the user can take out the sheet P discharged to the sheet ejection section 70 from two directions of front and rear in the printer 100 as illustrated in FIG. 38.

Thus, the printer 100 includes pillar-like supports 95*a* or a wall-like support 95*b* (support) having a pillar-like shape or a wall-like shape to support a downstream end in the first direction of the reversing tray 82 (sheet support).

The printer 100 as illustrated in FIGS. 37 and 38 supports the lower end of the sheet reversing section 80. Thus, the printer 100 can reduce the moment applied on a bottom part of the sheet guide 82*b* when the load acts on the sheet guide 82*b*. This configuration can prevent the fall off of the sheet reversing section 80 having the reversing tray 82 from the apparatus body 1.

Figure 39:
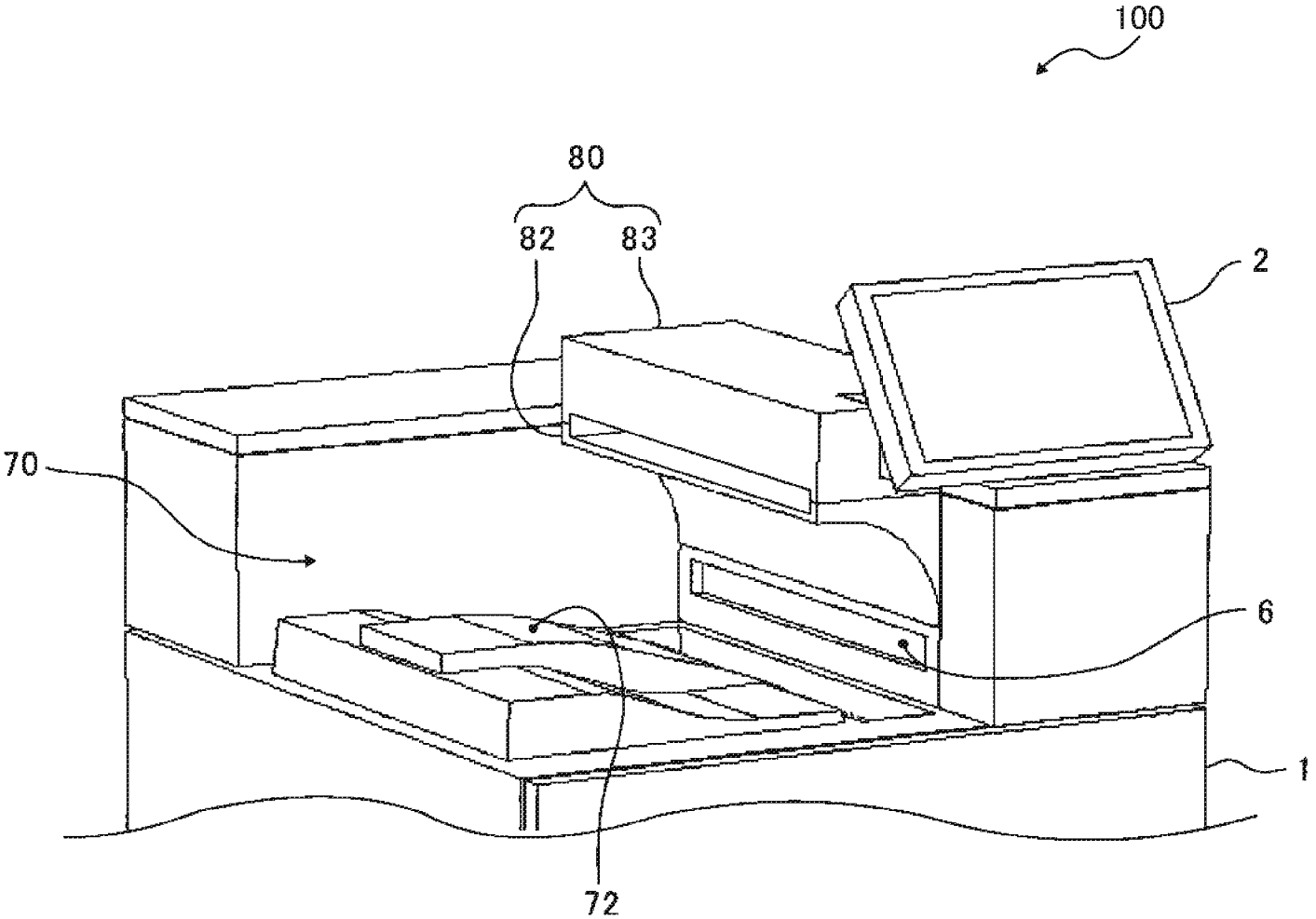
FIG. 39 is an external perspective view of an upper part of the printer.
Figure 40:
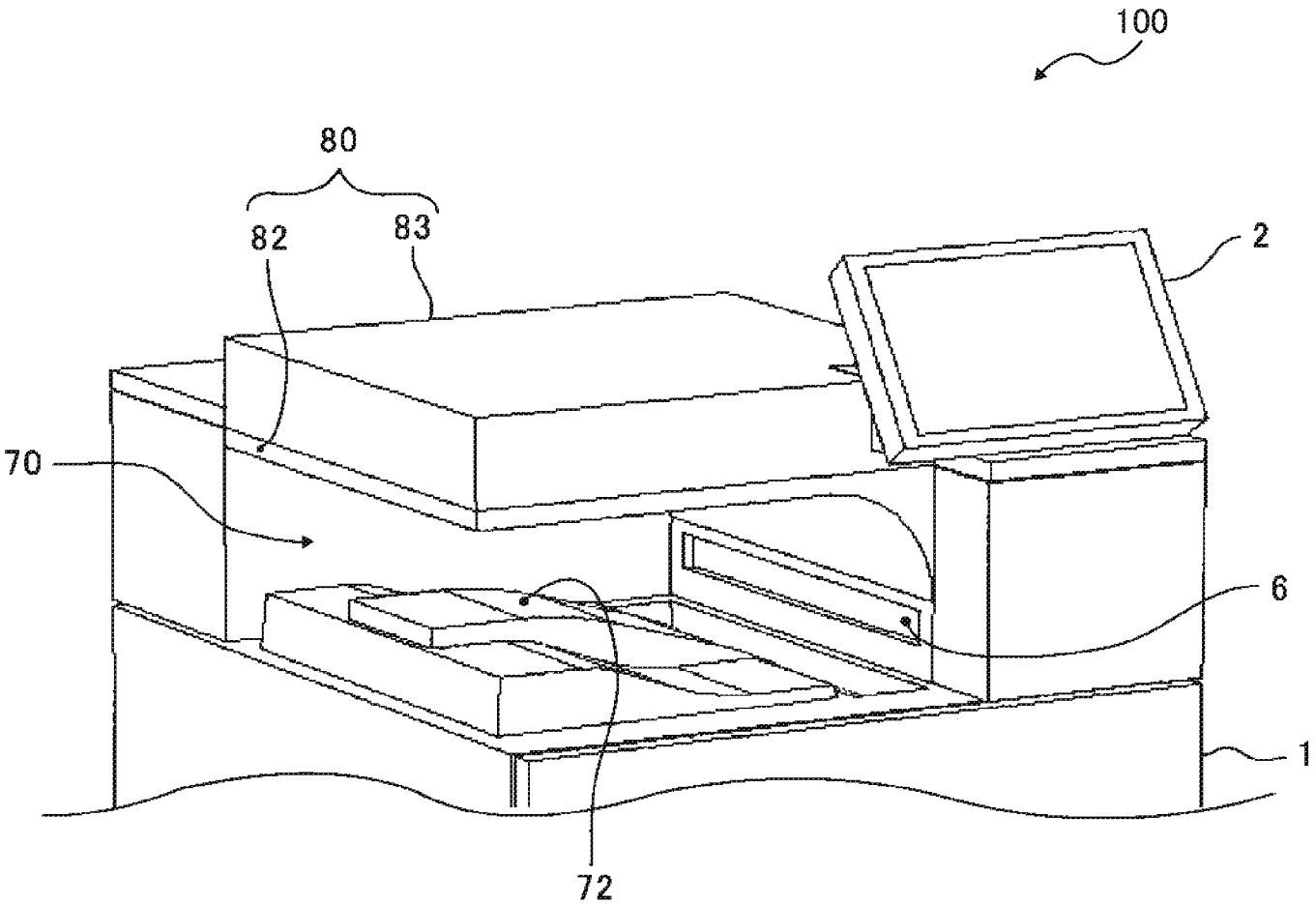
FIG. 40 is an external perspective view of an upper part of the printer.

FIG. 39 is a schematic perspective view of an upper part of the printer 100. The sheet reversing section 80 of the printer 100 in FIG. 39 overlaps a part of the sheet ejection section 70. An upper face of the sheet reversing section 80 projects upward from the upper face of the apparatus body 1. FIG. 40 is a schematic perspective view of an upper part of the printer 100. The sheet reversing section 80 of the printer 100 in FIG. 40 overlaps an entire upper part of the sheet ejection section 70. An upper face of the sheet reversing section 80 projects upward from the upper face of the apparatus body 1.

Figure 41:
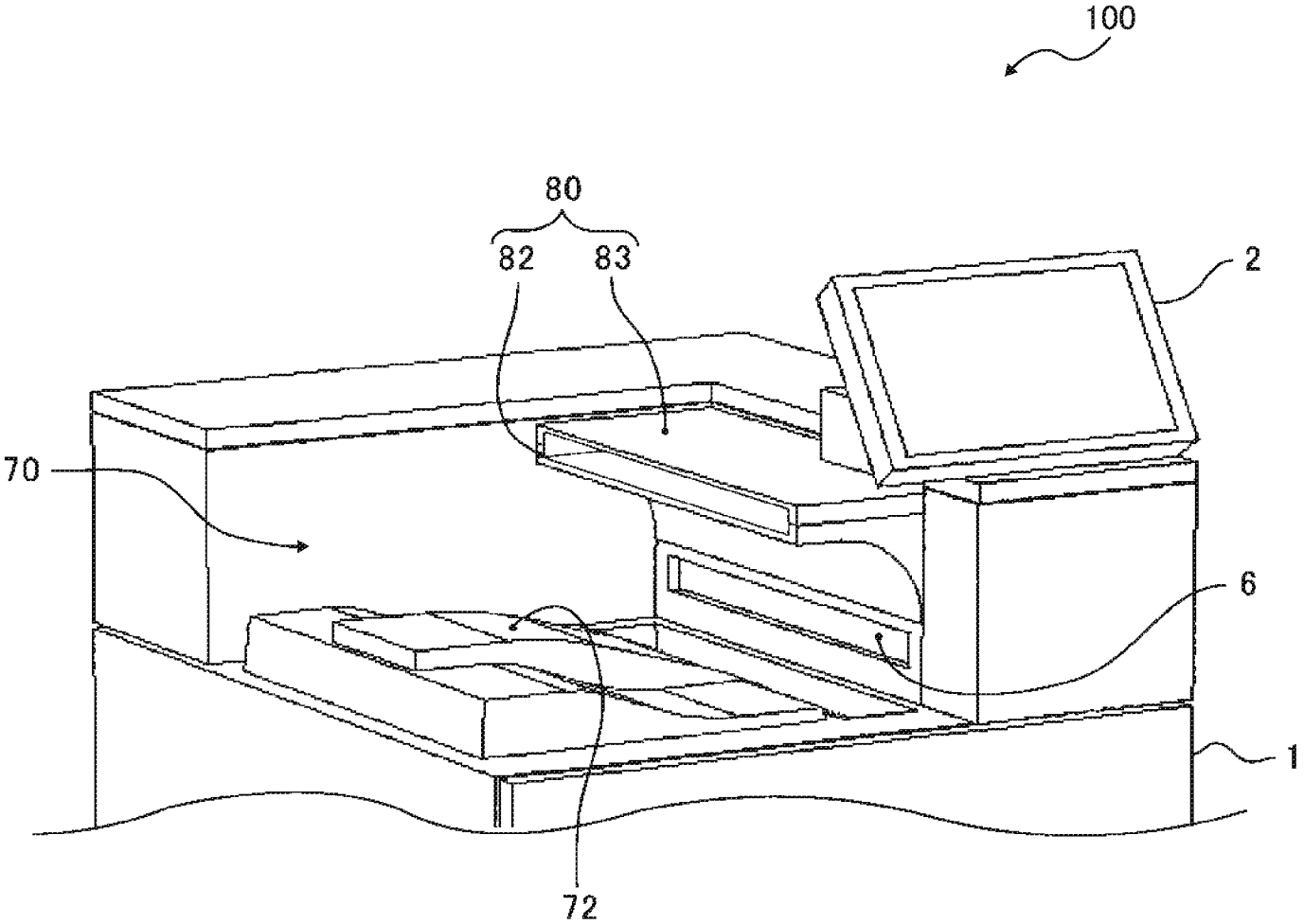
FIG. 41 is an external perspective view of an upper part of the printer.

FIG. 41 is a schematic perspective view of an upper part of the printer 100. The sheet reversing section 80 of the printer 100 in FIG. 41 overlaps a part of the sheet ejection section 70. An upper face of the sheet reversing section 80 is lower than the upper face of the apparatus body 1 in FIG. 41.

Figure 42:
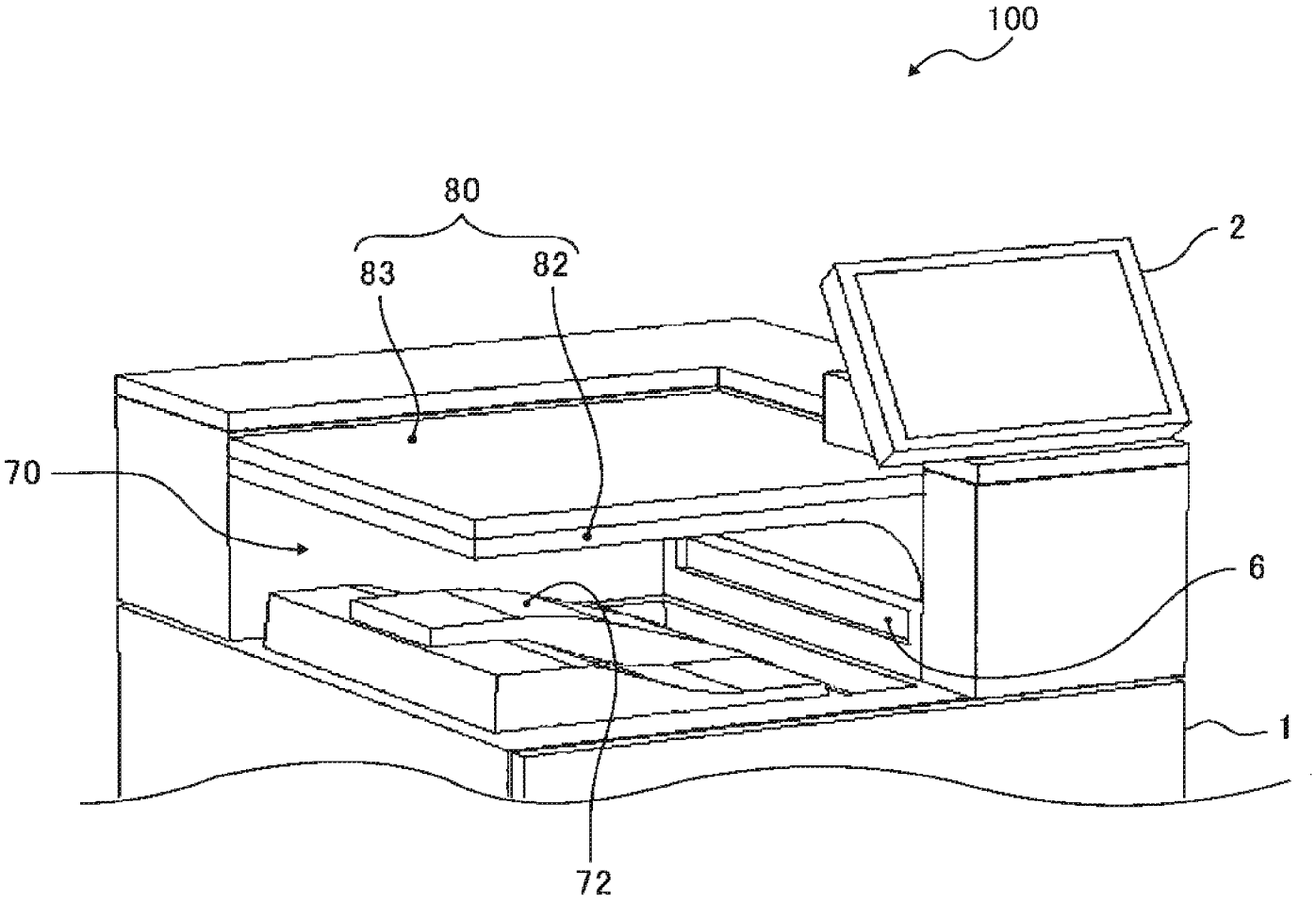
FIG. 42 is an external perspective view of an upper part of the printer.

FIG. 42 is a schematic perspective view of an upper part of the printer 100. The sheet reversing section 80 of the printer 100 in FIG. 42 overlaps an entire upper part of the sheet ejection section 70. An upper face of the sheet reversing section 80 is lower than the upper face of the apparatus body 1 in FIG. 42.

The printer 100 as illustrated in FIGS. 39 to 42 has a step between the upper face of the sheet reversing section 80 and the upper face of the apparatus body 1. Contrary, the printers 100 as illustrated in FIGS. 3 and 6 do not have a step between the upper face of the sheet reversing section 80 and the upper face of the apparatus body 1. Thus, the printers 100 as illustrated in FIGS. 3 and 6 includes a continuous plane having a large flat area on which a goods can be placed.

Figure 43:
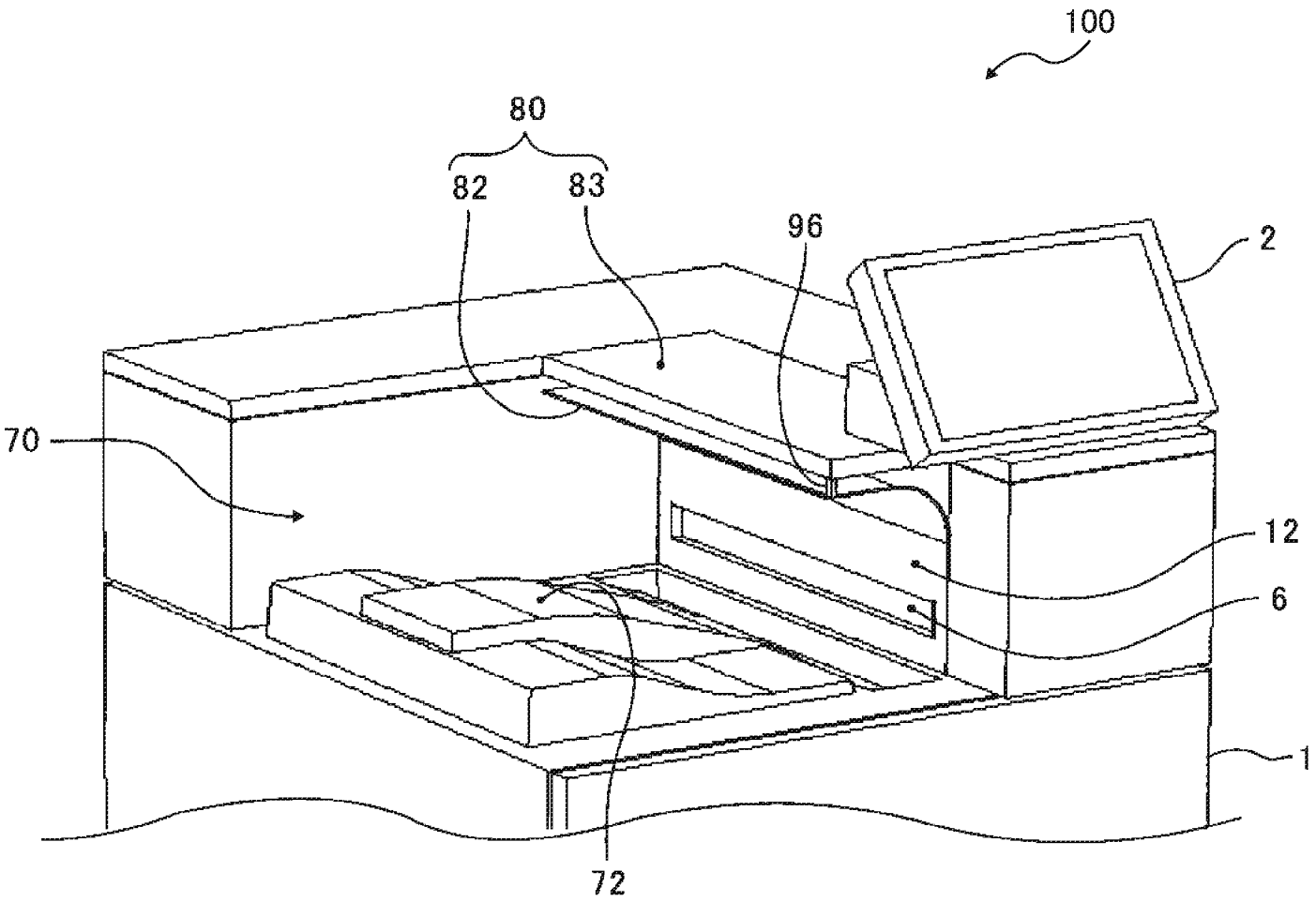
FIG. 43 is an external perspective view of an upper part of the printer.
Figure 44:
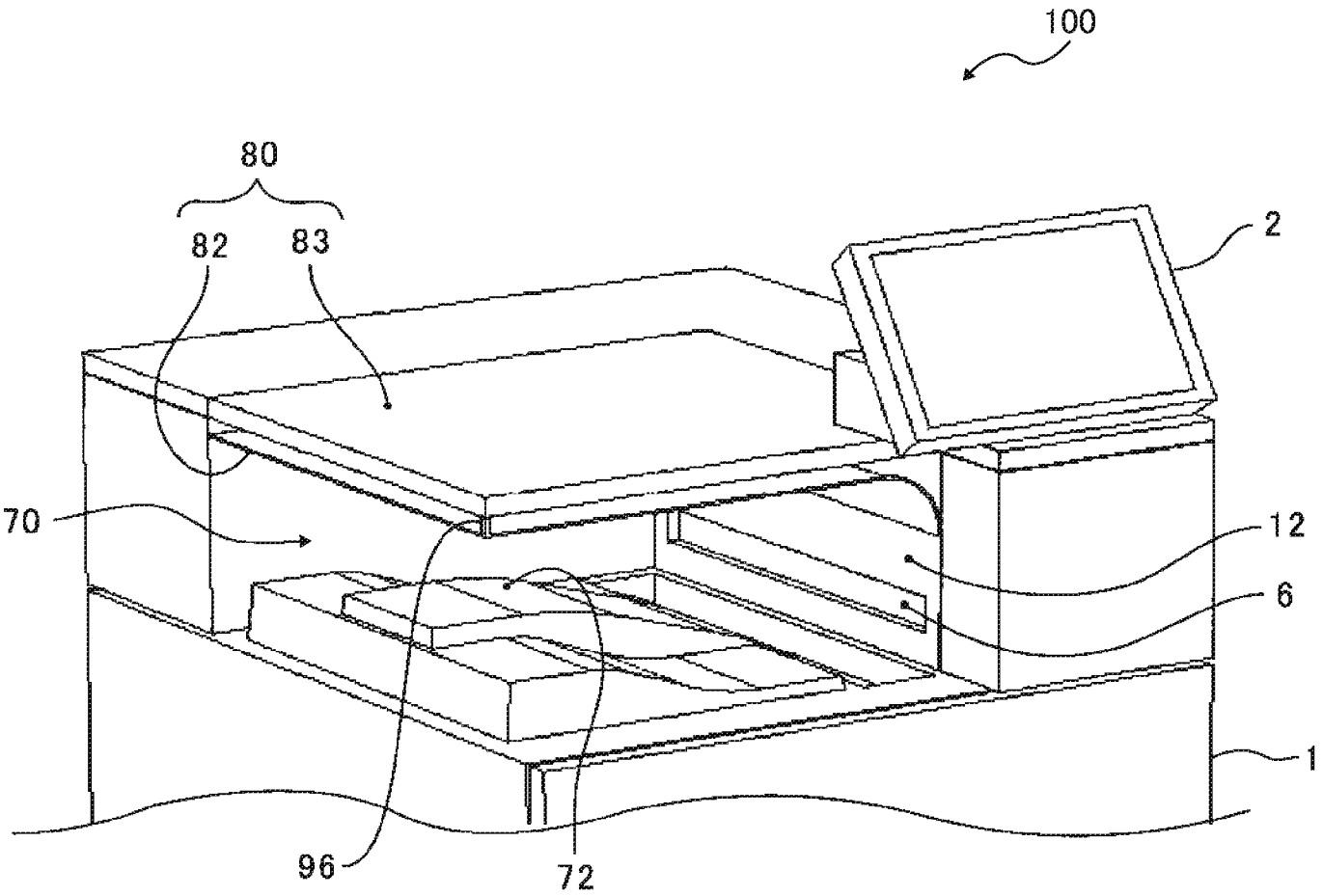
FIG. 44 is an external perspective view of an upper part of the printer.

FIG. 43 is a schematic perspective view of an upper part of the printer 100. The sheet reversing section 80 of the printer 100 in FIG. 43 overlaps a part of the sheet ejection section 70. The reversing tray 82 that supports the bottom face of the sheet P to be reversed is made of a thin plate. The stiffness of the sheet reversing section 80 is ensured by the reversing-tray cover 83. FIG. 44 is a schematic perspective view of an upper part of the printer 100. The sheet reversing section 80 of the printer 100 in FIG. 44 overlaps an entire upper part of the sheet ejection section 70. The reversing tray 82 that supports the bottom face of the sheet P to be reversed is made of a thin plate. The stiffness of the sheet reversing section 80 is ensured by the reversing-tray cover 83.

The lower end part of the reversing tray 82 of the printers 100 as illustrated in FIGS. 43 and 44 is fixed to the ejection wall face 12. The upper end part of the reversing tray 82 of the printers 100 as illustrated in FIGS. 43 and 44 is fixed to the reversing-tray cover 83 with a hanging member 96. The printers 100 in FIGS. 43 and 44 includes the reversing-tray cover 83 that extends in vertical direction at the reversal opening 5 side of the end of the stack opening 6. The sheet reversing section 80 in FIGS. 43 and 44 includes an abutting face 82*d* provided on the reversing tray 82 that contacts with the ejection wall face 12 of the apparatus body 1 as illustrated in FIG. 36A.

Further, the reversing-tray cover 83 includes a projection 83*d* that projects from the abutting face 82*d* in a direction opposite to a projection direction of the sheet guide 82*b*. The printer 100 includes fixing portions such as fixing screws 28 as illustrated in FIGS. 20 to 26 to fix the projection 82*c* to the apparatus body 1. The sheet reversing section 80 of the printer in FIGS. 43 and 44 can ensure the stiffness of the reversing-tray cover 83 and prevent the sheet reversing section 80 to be fallen off from the apparatus body 1 by the application of the load on the upper face of the sheet reversing section 80.

The structures described above are just examples, and the various aspects of the present specification attain respective effects as follows.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an apparatus body including, an upper-face frame having a horizontal plane disposed on an upper side of the apparatus body, and a vertical wall face having an ejection opening from which a sheet conveyed in a first horizontal direction is ejected;

a sheet support configured to support the sheet ejected from the ejection opening in the first horizontal direction;

a cover above the sheet support to cover the sheet support; and a mount configured to mount the sheet support to the apparatus body, the mount including, an abutting portion including a vertical abutting face that contacts the vertical wall face of the apparatus body, and a projection projecting in a second horizontal direction opposite to the first horizontal direction from the vertical abutting face, wherein the vertical abutting face extends in a vertically downward direction from the projection, and wherein the projection is configured to affix on the upper-face frame of the apparatus body in a substantially vertical direction.

2. The image forming apparatus according to claim 1, wherein the projection is configured to extend in a sheet width direction when the sheet support is mounted to the apparatus body.

3. The image forming apparatus according to claim 1, wherein the projection is configured to affix on the upper-face frame of the apparatus body with screws in a substantially vertical direction.

4. The image forming apparatus according to claim 1, wherein the cover includes, a plurality of first ribs on a bottom face of the cover, the plurality of first ribs extending in the first horizontal direction; and a plurality of second ribs extending in a direction perpendicular to the first horizontal direction, wherein the plurality of first ribs projects downward from the plurality of second ribs.

5. The image forming apparatus according to claim 1, wherein the sheet support is dimensioned to cover a leading end of the sheet having a largest conveyable length in the image forming apparatus when the sheet support is mounted to the apparatus body.

6. The image forming apparatus according to claim 1, wherein at least one of the sheet support and the cover is divided into two or more connectable parts in a sheet width direction perpendicular to the first horizontal direction and the second horizontal direction.

7. The image forming apparatus according to claim 1, wherein the cover includes a rib on a bottom face of a leading end of the cover.

8. The image forming apparatus according to claim 1, further comprising:

an openably closable cover by which a part of an upper cover face of the cover is openable.

9. The image forming apparatus according to claim 1, further comprising:

a cover affixing portion configured to affix the cover on the sheet support.

10. The image forming apparatus according to claim 1, wherein a first thickness in a height direction of an upstream end in the first horizontal direction of at least one of the sheet support and the cover is greater than a second thickness in the height direction of a downstream end in the first horizontal direction of the at least one of the sheet support and the cover.

11. The image forming apparatus according to claim 1, wherein the sheet support and the cover define a reverse conveyance route between the sheet support and the cover, and wherein the image forming apparatus is configured to pass the sheet through the reverse conveyance route before reversing a direction of conveyance of the sheet from the first horizontal direction to the second horizontal direction.

12. The image forming apparatus, according to claim 1, wherein at least one of the sheet support and the cover includes the projection.

13. The image forming apparatus according to claim 1, wherein an upper cover face of the cover and an uppermost face of the image forming apparatus are at a same height when the sheet support is mounted to the apparatus body.

14. The image forming apparatus according to claim 13, wherein the mount further includes a rear projection configured to project from the sheet support in a sheet width direction perpendicular to the first horizontal direction and the second horizontal direction, and wherein the rear projection is configured to overlap the upper-face frame of the apparatus body in a state in which the rear projection is affixed on the upper-face frame.

15. The image forming apparatus according to claim 1, further comprising:

an abutting face affixing portion configured to affix the vertical abutting face of the abutting portion on the vertical wall face of the apparatus body.

16. The image forming apparatus according to claim 1, further comprising:

a support having a pillar or a wall shape configured to support a downstream end of the sheet support in the first horizontal direction when the sheet support is mounted to the apparatus body.

* * * * *